US011476603B2

(12) United States Patent
Buck et al.

(10) Patent No.: US 11,476,603 B2
(45) **Date of Patent: *Oct. 18, 2022**

(54) COMPRESSION-MOUNTED ELECTRICAL CONNECTOR

(71) Applicant: Samtec, Inc., New Albany, IN (US)

(72) Inventors: Jonathan Earl Buck, Hershey, PA (US); Keith Guetig, Louisville, KY (US)

(73) Assignee: SAMTEC, INC., New Albany, IN (US)

( * ) Notice: Subject to any disclaimer, the term of this patent is extended or adjusted under 35 U.S.C. 154(b) by 14 days.

This patent is subject to a terminal disclaimer.

(21) Appl. No.: 17/126,117

(22) Filed: Dec. 18, 2020

(65) Prior Publication Data

US 2021/0151914 A1 May 20, 2021

Related U.S. Application Data

(63) Continuation of application No. 16/329,272, filed as application No. PCT/US2017/049367 on Aug. 30, 2017, now Pat. No. 10,985,479.

(60) Provisional application No. 62/534,938, filed on Jul. 20, 2017, provisional application No. 62/396,677, filed on Sep. 19, 2016, provisional application No. 62/381,437, filed on Aug. 30, 2016.

(51) Int. Cl.

| | |
|---|---|
| ***H01R 12/59*** | (2011.01) |
| ***H01R 12/70*** | (2011.01) |
| ***H01R 12/71*** | (2011.01) |
| ***H01R 12/85*** | (2011.01) |
| ***H01R 13/6471*** | (2011.01) |
| ***H01R 43/20*** | (2006.01) |

(52) U.S. Cl.

CPC ..... *H01R 12/59* (2013.01); *H01R 12/7047* (2013.01); *H01R 12/714* (2013.01); *H01R 12/85* (2013.01); *H01R 13/6471* (2013.01); *H01R 43/205* (2013.01)

(58) Field of Classification Search

CPC .. H01R 12/59; H01R 12/7047; H01R 12/714; H01R 12/85; H01R 13/6471; H01R 43/205

See application file for complete search history.

(56) References Cited

U.S. PATENT DOCUMENTS

| | | | | |
|---|---|---|---|---|
| 3,179,912 A | | 4/1965 | Huber et al. | |
| 4,770,645 A | | 9/1988 | Antes | |
| 5,599,192 A | * | 2/1997 | Olson | H01R 12/716 439/660 |
| 6,099,356 A | * | 8/2000 | Hwang | H01R 13/2442 439/862 |
| D452,479 S | * | 12/2001 | Hiramoto | D13/147 |

(Continued)

FOREIGN PATENT DOCUMENTS

| | | |
|---|---|---|
| CN | 101238613 A | 8/2008 |
| CN | 202840108 U | 3/2013 |

(Continued)

*Primary Examiner* — Abdullah A Riyami
*Assistant Examiner* — Nader J Alhawamdeh
(74) *Attorney, Agent, or Firm* — BakerHostetler

(57) ABSTRACT

An electrical connector includes electrical contacts that are configured to be mounted to an electrical cable, and mating ends that are configured to be surface mounted to a contact pad of an underlying substrate, such that the mating ends flex and apply a pressure against the contact pad.

24 Claims, 26 Drawing Sheets

(56) References Cited

U.S. PATENT DOCUMENTS

| | | | | |
|---|---|---|---|---|
| 6,786,762 | B2 | 9/2004 | Buck et al. | |
| 6,796,822 | B2 | 9/2004 | Sato et al. | |
| 7,377,804 | B2 | 5/2008 | Lin | |
| 7,470,155 | B1 | 12/2008 | Soubh et al. | |
| 7,637,767 | B2 | 12/2009 | Davis et al. | |
| 7,690,923 | B2 | 4/2010 | Horchler et al. | |
| 7,690,930 | B2 | 4/2010 | Chen et al. | |
| 9,645,172 | B2 | 5/2017 | Santos et al. | |
| 9,705,273 | B2 | 7/2017 | Vicich et al. | |
| 2004/0018766 | A1 | 1/2004 | Wu | |
| 2004/0077193 | A1 | 4/2004 | Peloza et al. | |
| 2006/0228912 | A1 | 10/2006 | Morlion et al. | |
| 2009/0191729 | A1 | 7/2009 | Kurimoto | |
| 2011/0151708 | A1* | 6/2011 | Kaneko | H01R 12/714 439/660 |
| 2013/0040482 | A1 | 2/2013 | Ngo et al. | |
| 2013/0188325 | A1 | 7/2013 | Garman et al. | |
| 2014/0170867 | A1 | 6/2014 | Hodge | |
| 2014/0187087 | A1 | 7/2014 | Mason et al. | |
| 2016/0156116 | A1* | 6/2016 | Kurachi | H01R 12/775 439/78 |
| 2019/0267732 | A1* | 8/2019 | Buck | H01R 13/6471 |

FOREIGN PATENT DOCUMENTS

| | | | |
|---|---|---|---|
| CN | 103094781 | A | 5/2013 |
| CN | 105655784 | A | 6/2016 |
| TW | 547832 | U | 8/2003 |

* cited by examiner

COMPRESSION-MOUNTED ELECTRICAL CONNECTOR

CROSS-REFERENCE TO RELATED APPLICATIONS

This application is a continuation of U.S. patent application Ser. No. 16/329,272, filed Feb. 28, 2019, which is a National Stage Application of International Patent Application No. PCT/US2017/049367, filed Aug. 30, 2017, which claims priority to U.S. Patent Application Ser. No. 62/534,938 filed Jul. 20, 2017, U.S. Patent Application Ser. No. 62/396,677 filed Sep. 19, 2016, and U.S. Patent Application Ser. No. 62/381,437 filed Aug. 30, 2016, the disclosures of each of which are hereby incorporated by reference as if set forth in their entireties herein.

BACKGROUND

Electrical connectors are typically mated to complementary electrical components so as to establish electrical communication therebetween. In one application, the electrical contacts are mounted to electrical cables, and are further compression-mounted to an underlying printed circuit board (PCB). Electrical contacts of the electrical connector are placed in electrical communication with electrical contact pads of the substrate when the electrical connector is compression-mounted to the PCB. Thus, the electrical connector places the electrical cables and the PCB in electrical communication with each other.

SUMMARY

In one aspect of the present disclosure, an electrical connector is configured to be mounted to a substrate. The electrical connector can include an electrically insulative connector housing body. The housing body can define a front end and a rear end opposite the front end along a longitudinal direction. The housing body can further define first and second sides that are spaced from each other along a lateral direction that is perpendicular to the longitudinal direction, wherein each of the first and second sides extends from the front end to the rear end. The housing body can further define upper and lower ends spaced from each other along a transverse direction that is perpendicular to each of the lateral direction and the longitudinal direction, wherein the lower end is configured to face the substrate when the electrical connector is mounted to the substrate. The electrical connector can further include at least one electrical contact supported by the connector housing body. The at least one electrical contact can define a resilient and flexible mating end that extends out from the housing body a first distance along a first direction that includes at least one of the lateral direction and the longitudinal direction, and a second distance along the transverse direction that is less than the first distance. The at least one electrical contact can further define a mounting end opposite the mating end and configured to be attached to an electrical conductor of an electrical cable. The electrical connector can be configured to be mounted to the substrate such that the resilient and flexible mating end is configured to flex from a relaxed position when placed in surface contact with a respective electrical contact pad that is carried by a surface of the substrate, such that the mating end applies a pressure against the contact pad along the transverse direction. The at least one electrical contact can configured to transmit data at frequencies between 5 GHz and 30 GHz while producing no more than −18 dB worst-case multi-active asynchronous cross talk.

BRIEF DESCRIPTION OF THE DRAWINGS

The following detailed description will be better understood when read in conjunction with the appended drawings, in which there is shown in the drawings example embodiments for the purposes of illustration. It should be understood, however, that the present disclosure is not limited to the precise arrangements and instrumentalities shown. In the drawings.

DETAILED DESCRIPTION

Figure 1:
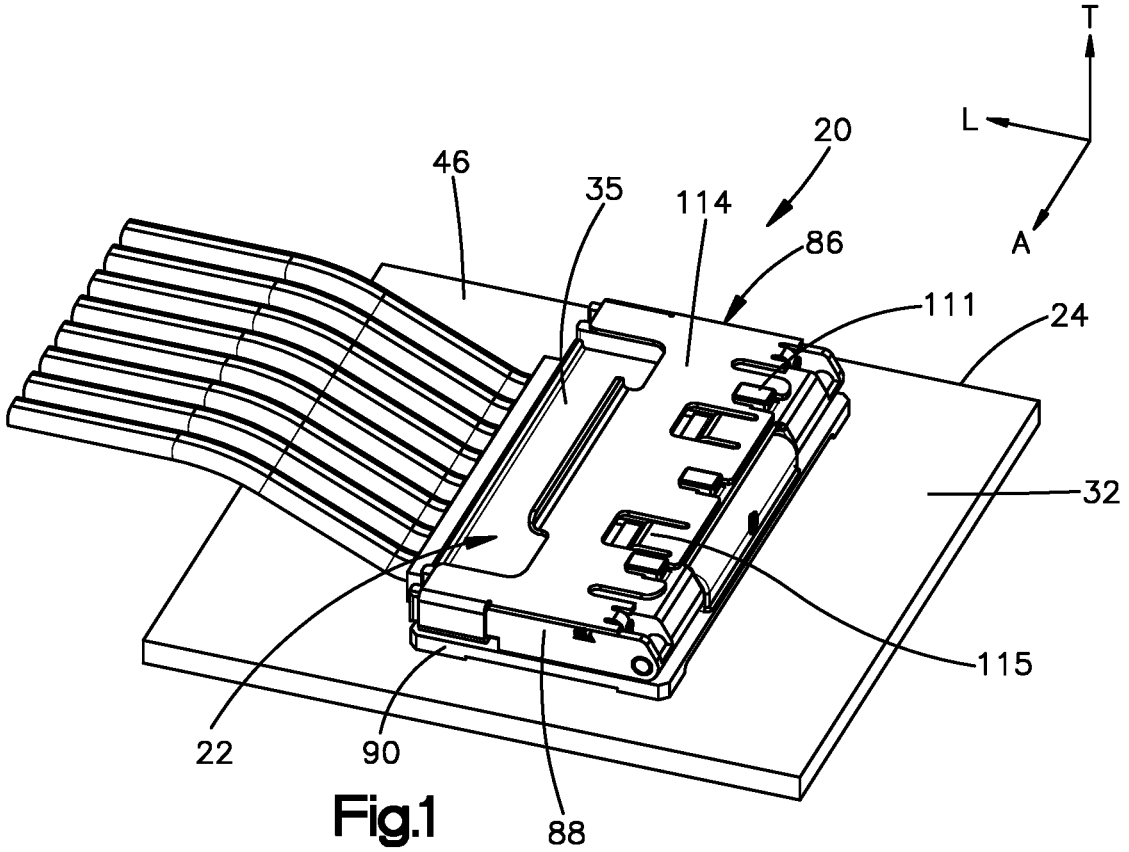
FIG. 1 is a perspective view of an electrical connector assembly constructed in accordance with one embodiment, including an electrical connector, a substrate, and a plurality of electrical cables.
Figure 2:
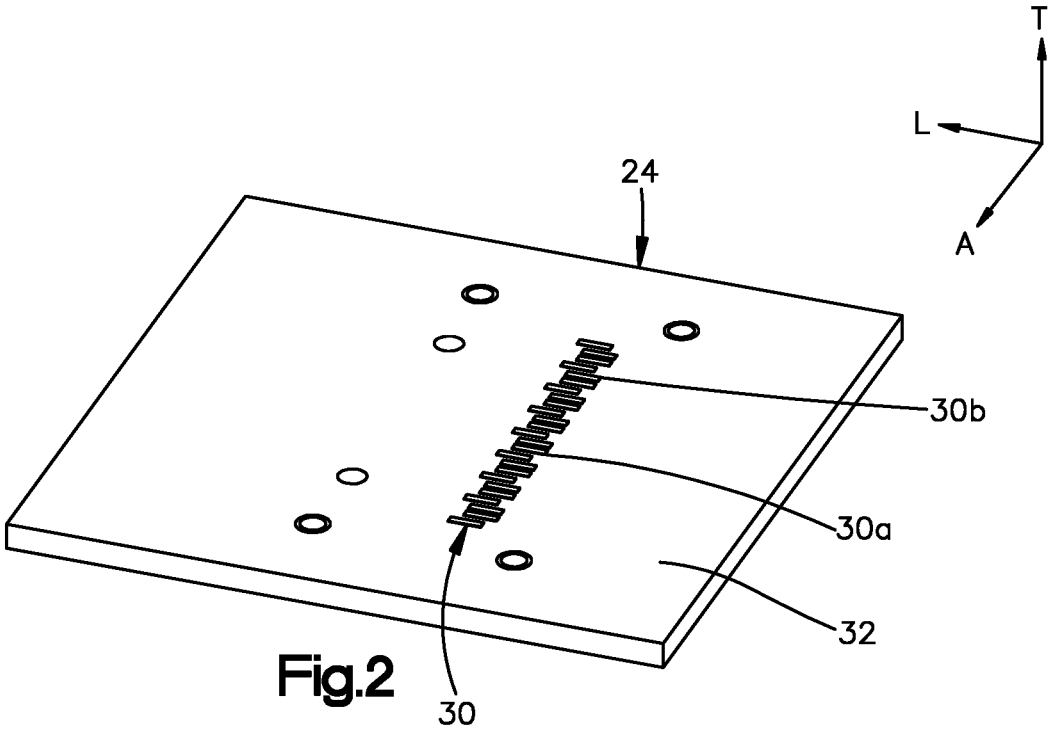
FIG. 2 is a perspective view of the substrate illustrated in FIG. 1.
Figure 3:
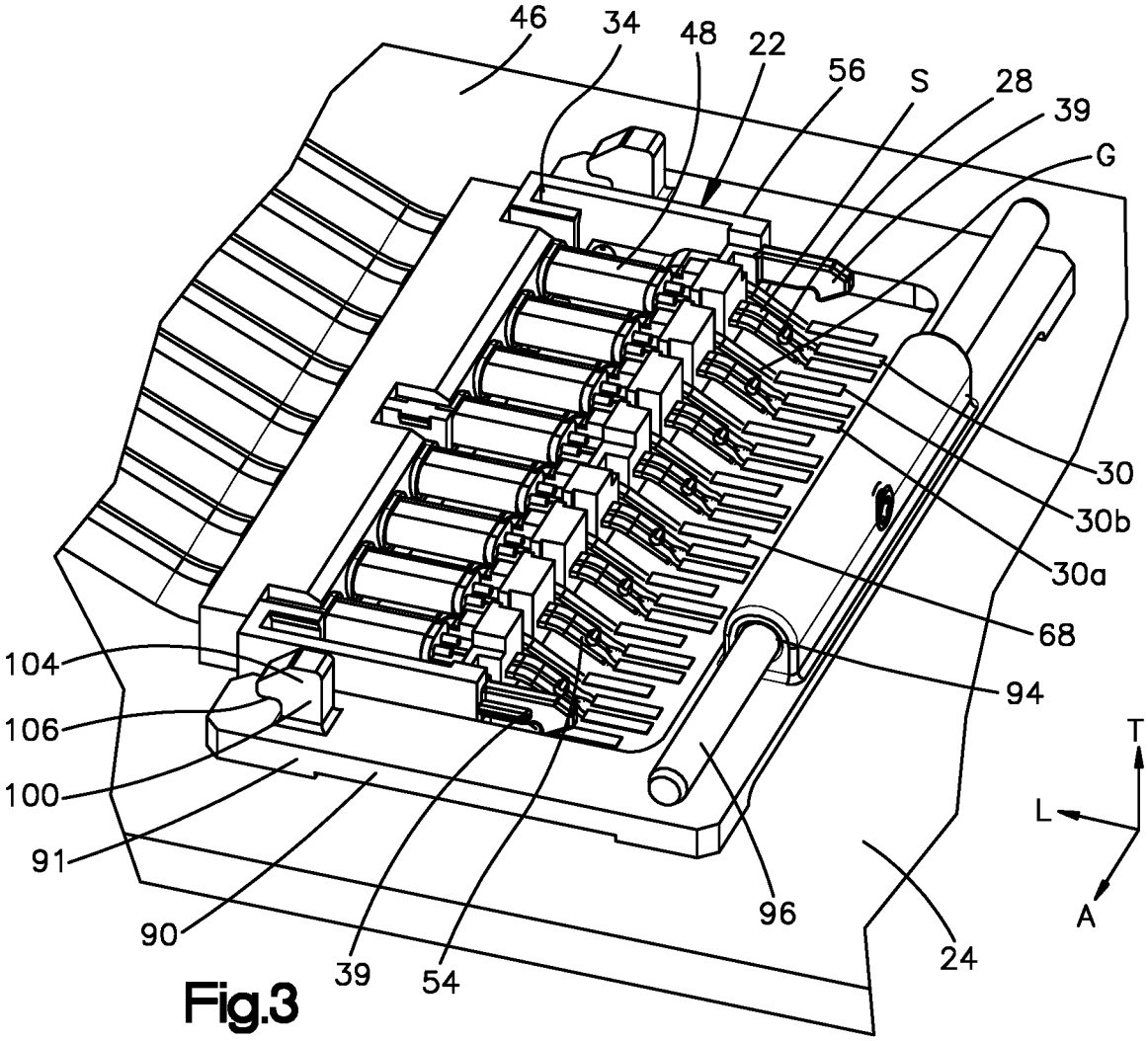
FIG. 3 is a perspective view of a portion of the electrical connector assembly illustrated in FIG. 1, showing a connector housing of the electrical connector.
Figure 4A:
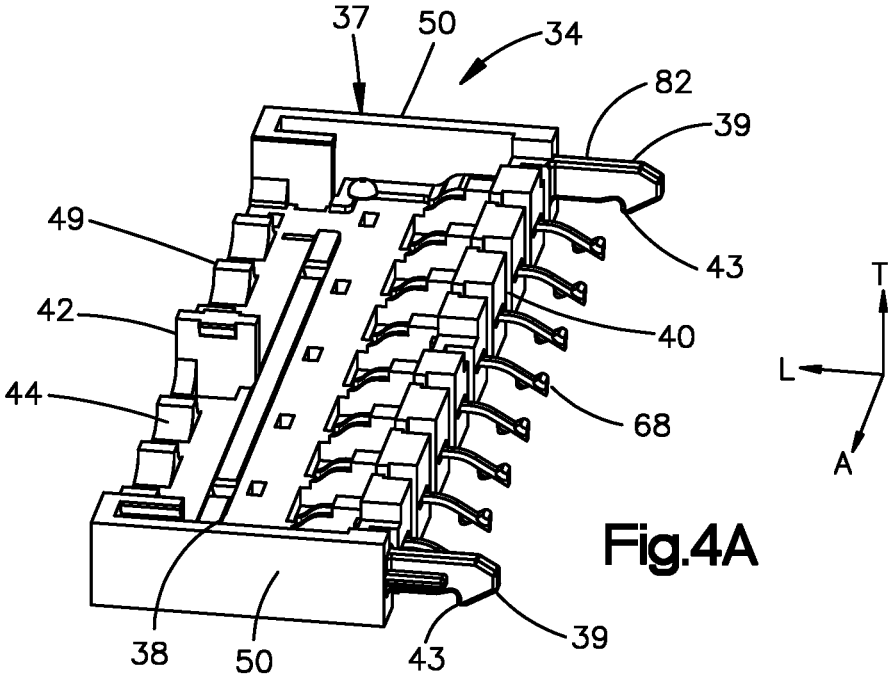
FIG. 4A is a perspective view of a connector housing of the electrical connector illustrated in FIG. 3.
Figure 4B:
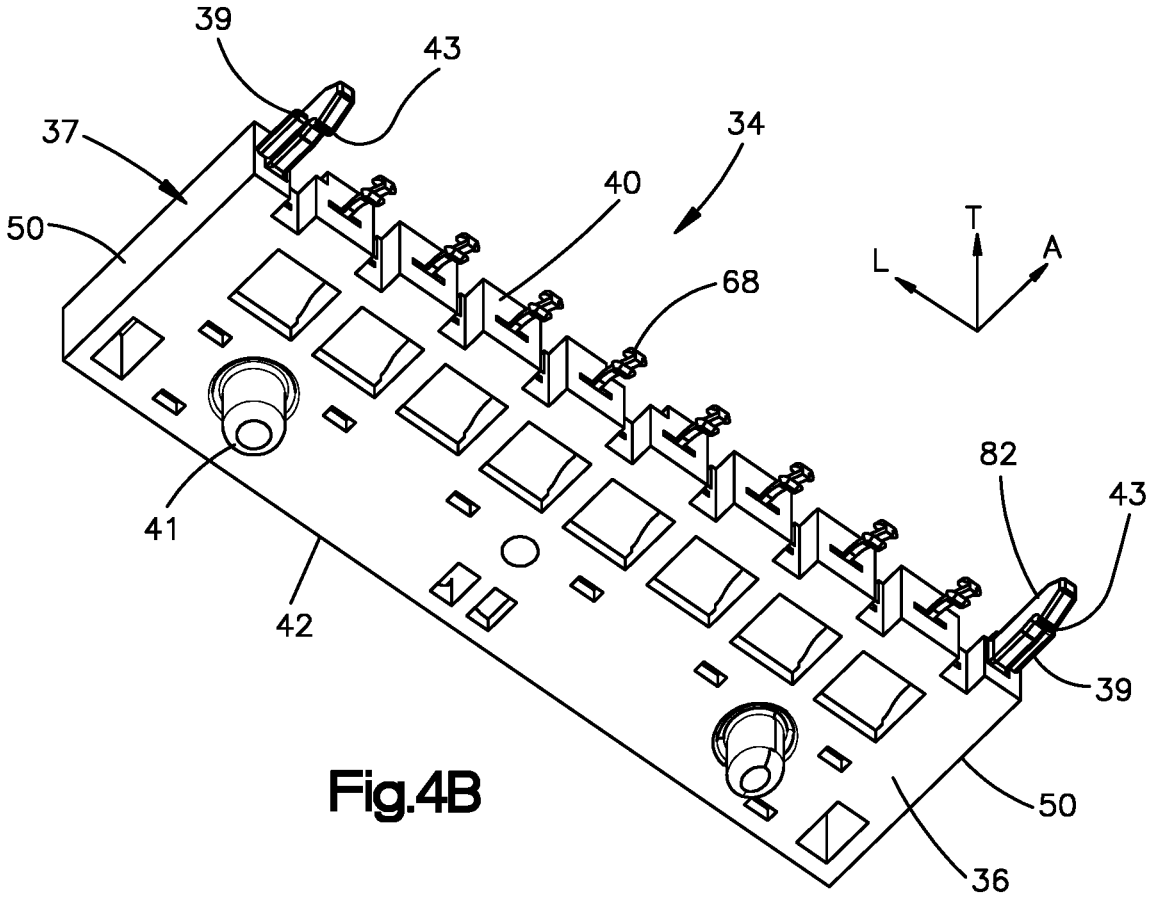
FIG. 4B is another perspective view of the connector housing illustrated in FIG. 4A.

The present disclosure recognizes that embodiments described in U.S. patent application Ser. No. 14/551,590 can be modified such that the mating ends of the electrical contacts can be surface mounted to the underlying substrate. In particular, the connector can be a compression connector, whereby the mating ends of the electrical contacts configured to be surface mounted to an underlying substrate. The mating ends can be resilient and flexible. Thus, the mating ends can flex upward as the electrical connector is mounted to the underlying substrate. The mating ends can define a separable interface with the substrate, such that the mating ends can be removed from the substrate without damaging either the mating ends or the substrate. The mating ends can be resilient as they flex upward from a neutral position to a flexed position when they bear against the contact pads of the substrate while the electrical connector is mounted to the substrate. Because the mating ends are resilient, the mating ends can apply a pressure against the contact pads when the electrical connector is mounted to the substrate. The mating ends and the contact pads can define a separable interface, such that when the pressure is removed, the mating ends can be removed from the contact pads without damaging either of the mating ends and the contact pads.

Referring now to FIGS. 1-5, an electrical connector assembly 20 includes an electrical connector 22, a substrate 24. The substrate 24 can be configured as a printed circuit board (PCB), a plurality of electrical cables 46, and an attachment mechanism 86 that is configured to secure the electrical connector 22 to the substrate 24. The electrical connector 22 is configured to be compression mounted to the substrate 24. In particular, the electrical connector 22 includes a plurality of electrical contacts 28 having mating ends that are configured to flex so as to become compressed against contact pads 30 that are disposed on a surface 32 of the substrate 24 when the electrical connector 22 is mounted to the substrate 24. Thus, in one example, the electrical contacts 28 do not extend into the substrate 24. The electrical contacts 28 can include ground contacts G and signal contacts S. Adjacent ones of the signal contacts S can define differential signal pairs. Alternatively, the signal contacts S can be single ended as desired. The electrical connector 22 can be repeatedly matable to the underlying substrate 24.

The substrate 24 can include a plurality of electrically conductive surface mount technology (SMT) contact pads 30 disposed on at least one side of the substrate. The at least one side can include a first surface 32 that is planar along a first or longitudinal direction L and a second or lateral direction A that is perpendicular to the longitudinal direction. Each of the contact pads 30 can be disposed at the first surface 32. Each of the contact pads 30 can include a first end, and a second end that is spaced from the first end along the longitudinal direction. Each of the contact pads pads can include a first side and a second side spaced from the first side along the lateral direction. The first and second sides can extend between the first and second ends. Further, each Contact pad can be elongate from its first end to its second end.

The plurality of contact pads 30 may be configured in a linear array although other pad configurations may be used. For instance, the plurality of contact pads 30 can be spaced from one another along the lateral direction, which can be referred to as a row direction. Further, the contact pads 30 can be in-line with one another along the lateral direction A. For instance, all of the contact pads 30 can be intersected by a line that extends along the lateral direction. In one example, the contact pads 30 can be in-line with the ends of some of the contact pads staggered along the lateral direction. For instance, the plurality of contact pads 30 can have first and second subsets 30*a* and 30*b* of contact pads 30. The first subset 30*a* of the contact pads 30 can have first ends that are substantially in-line with one another along the lateral direction, and second ends that are substantially in-line with one another along the lateral direction. The second subset 30*b* of the contact pads 30 can have first ends that are substantially in-line with one another along the lateral direction, and second ends that are substantially in-line with one another along the lateral direction. However, the first ends of the second subset 30*b* of the contact pads 30 can be in-line with the contact pads of the first subset 30*a* at a location between the first and second ends of the contact pads 30 of the first subset 30*a* along the lateral direction. Thus, the first ends of the contact pads of the second subset 30*b* are not in-line with the first ends of the contact pads 30 of the first subset 30*a*. Similarly, the second ends of the contact pads 30 of the second subset 30*b* are not in-line with the second ends of the contact pads of the first subset 30*a*. In one example, the first subset 30*a* can be configured to mate with the signal contacts S, and the second subset can be configured to mate with the ground contacts G. Thus, the first subset 30*a* can be spaced from respect to the second subset 30*b* in the forward direction.

The electrical connector 22 can include an electrically insulative connector housing 34 and at least one electrical contact 28 such as a plurality of electrical contacts supported by the connector housing 34. As will be described in more detail below, the electrical connector 22 can further include a connector cover 35 that can provide mechanical covering to the electrical contacts 28 that protects the electrical contacts 28 during operation. Further, the connector cover 35 can be made from a metallic material or non-metallic material that can electrically conductive or nonconductive (e.g., lossy material) material that is configured to provide electrical shielding to the electrical contacts 28.

The connector housing 34 can include a housing body 37 that defines a lower housing end 36 and an upper housing end 38 that are spaced from one another along a third or transverse direction T that is perpendicular to both the longitudinal and lateral directions. The lower housing end 36 can be configured to face the first surface 32 of the substrate 24 when the electrical connector 22, and thus connector housing 34, is mated with the substrate 24. For instance, the connector housing 34 can include mounting pins 41 that extend down from the lower housing end 36 and are configured to be press-fit or otherwise received in respective mounting apertures of the substrate 24. The housing body 37 can further include a front housing end 40 and a rear housing end 42 that are spaced from one another along the longitudinal direction L. The front housing end 40 is spaced from the rear housing end in a forward direction. Similarly, the rear housing end 42 is spaced from the front housing end 40 in a rearward direction opposite the forward direction. Each of the rearward direction and the forward direction can be oriented along the longitudinal direction L. The electrical contacts 28 can thus be supported by the housing body 37.

The front housing end 40 and the rear housing end 42 can extend between the lower and upper ends 36 and 38, respectively, of the housing 34. For instance, the front housing end 40 and the rear housing end 42 can extend from the upper housing end 38 to the lower housing end 36.

The housing body 37, and thus the connector housing 34, can define a plurality of cable bays 44 that extend in the rear housing end 42 along the forward direction. Each of the plurality of cable bays 44 can be configured to receive a respective one of the electrical cables 46. The cable bays 44 can extend into the upper housing end 38 toward the lower housing end 36. In one example, the cable bays 44 do not extend through the lower housing end 36. When the electrical cables 46 are received in the bays 44, the electrical cables 46 can extend out the rear housing end 42 in the rearward direction. Thus, the rear housing end 42 can define a mounting interface of the electrical connector 22. In one example, at least one or more of the bays 44 can be configured to receive more than one of the electrical cables 46, such as a pair of the electrical cables 46. In one embodiment, electrical cables 46 can include a drain wire or ground shield 48 that can each be mounted to the mounting end of a respective ground contact G in each of the cable bays 44. The connector housing 34 can include divider walls 49 that separate adjacent ones of the cable bays 44.

The housing body 37, and thus the connector housing 34, can further define first and second housing sides 50 that are spaced from each other along the lateral direction A. Each of the first and second housing sides 50 can extend between the lower and upper housing ends 36 and 38, respectively. For instance, each of the first and second housing sides 50 can extend from the upper housing end 38 to the lower housing end 36. Further, each of the first and second housing sides 50 can extend between the front and rear housing ends 40 and 42, respectively. For instance, each of the first and second housing sides 50 can extend from the front housing end 40 to the rear housing end 42. It should thus be appreciated that the front and rear housing ends 40 and 42 and the first and second housing sides 50 can define an outermost footprint of the housing body 37 along a plane that is defined by the longitudinal direction L and the lateral direction A. The connector housing 34 can further include a member that extends out from the housing body 37. For instance, the member can extend from the front end 40. In one example, the member can include one or more latch arms 39 that extend forward from the housing body 37 along the longitudinal direction L. The latch arms 39 can be configured to attach to the connector cover 35. The housing body 37 and the latch arms 39 can combine so as to define an outermost footprint of the connector housing 34. Thus, the front and rear housing ends 40 and 42, the first and second housing sides 50, and the latch arms 39, alone or in combination with a dielectric spacer 68 described below, can define the outermost footprint of the connector housing 34. The outermost footprint of the connector housing can be defined in a plane that is defined by the longitudinal direction L and the lateral direction A.

In one example, the housing body 37 can be a single monolithic housing body. Thus, the single monolithic housing body can define the front housing end 40, the rear housing end 42, the lower housing end 36, the upper housing end 38, and the first and second housing sides 50. The single monolithic housing body can define an outermost footprint in a plane that is defined by the longitudinal direction L and the lateral direction A. The outermost footprint of the housing body can be defined by the front housing end 40, the rear housing end 42, and the first and second housing sides 50. In one example, the connector housing 34 can be a single monolithic housing. Thus, the single monolithic housing can define the front housing end 40, the rear housing end 42, the lower housing end 36, the upper housing end 38, the first and second housing sides 50, and the latch arms 39. The single monolithic housing can define an outermost footprint in a plane that is defined by the longitudinal direction L and the lateral direction A. The outermost footprint of the housing 37 can be defined by the front housing end 40, the rear housing end 42, the first and second housing sides 50, and the latch arms 39.

As described above, the electrical contacts 28 of the electrical connector 22 can include signal contacts S and ground contacts G. The signal contacts S can be mounted to electrical conductors of the electrical cables 46. The ground contacts G can be mounted to grounds such as ground shields 48 or drain wires of the electrical cables 46. The signal contacts S can be arranged such that adjacent ones of the signal contacts define differential signal pairs. The ground contacts G can be disposed between adjacent ones of the differential signal pairs. Alternatively, the signal contacts can be single ended.

Figure 6B:
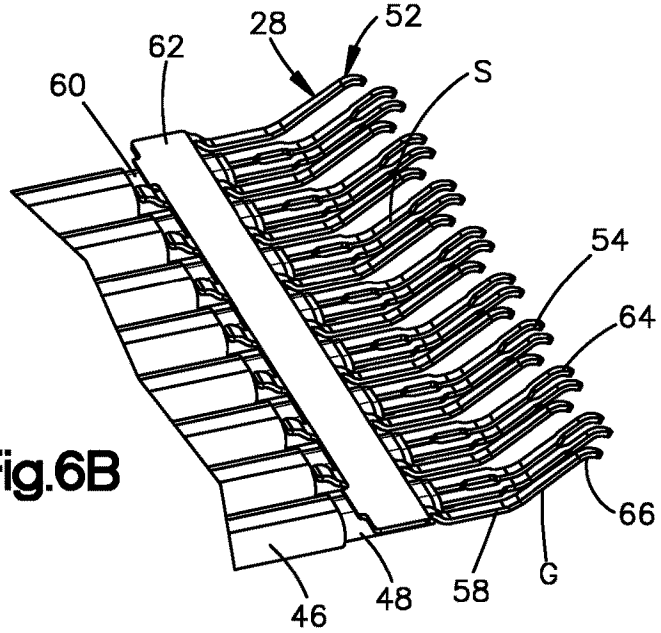
FIG. 6B is another perspective vie of the electrical contact assembly shown mounted to a plurality of electrical cables.
Figure 6C:
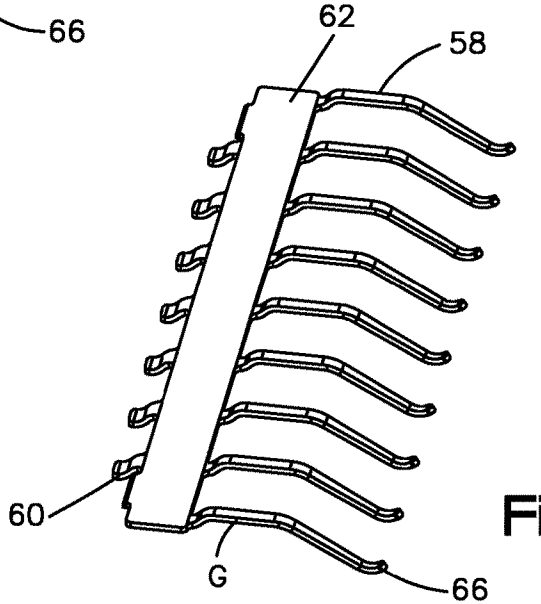
FIG. 6C is a perspective view of a ground plate and a plurality of ground contacts that extend from the ground plate.
Figure 6A:
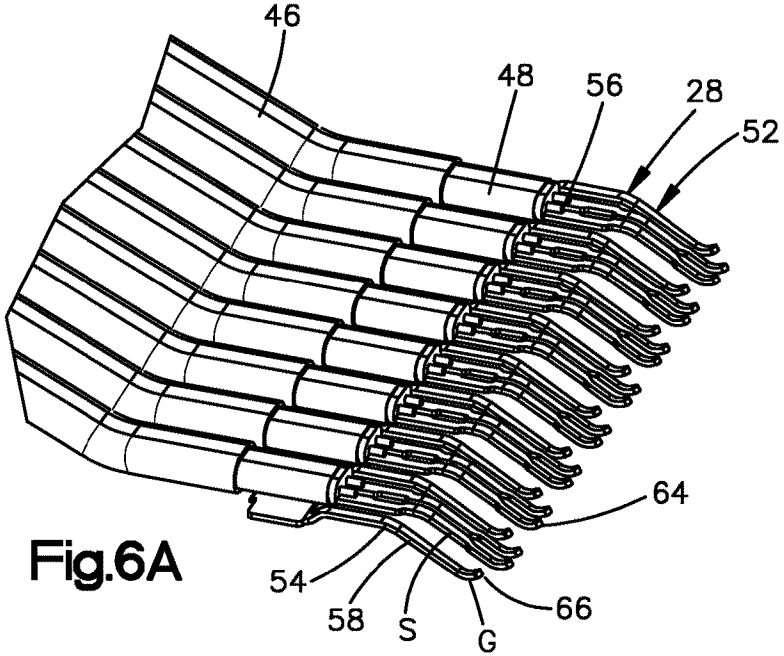
FIG. 6A is a perspective vie of an electrical contact assembly shown mounted to a plurality of electrical cables.

Referring now to FIGS. 6A-6C, the electrical connector 22 can include an electrical contact assembly 52 that includes the electrical contacts 28. The electrical contacts 28 can each define respective resilient and flexible mating ends. For instance, the signal contacts S can each define a respective resilient and flexible mating 54, and the ground contacts G can each define a respective resilient and flexible mating 58. Thus, reference to the mating ends of the electrical contacts 28 can include one or both of the mating ends 54 and 58. The mating ends of the electrical contacts 28 can extend out from the housing body 37, and thus the housing 34. For instance, the mating ends can extend out from the housing body 37, and thus the housing 34, a first distance along a direction that includes at least one of the lateral direction A and the longitudinal direction L, and a second distance along the transverse direction T that is less than the first distance. In one example, the first distance can be at least 3 times greater than the second distance. For instance, the mating ends of the electrical contacts 28 can extend from the front housing end 40 in a direction away from the rear housing end 42. Further, the electrical contacts 28 can extend out from the front end 40 of the connector housing 34. For instance, the electrical contacts 28 can be cantilevered from a surface of the housing body 37, and thus of the housing 34, that does not face the substrate when the electrical connector is mounted to the substrate. In one example, the electrical contacts 28 can be cantilevered from the front housing end 40.

The electrical contacts 28 can extend beyond the outermost footprint of the housing body 37. In particular, the mating ends of the electrical contacts 28 can extend beyond the outermost footprint of the housing body 37. Thus, the mating ends of the electrical contacts 28 can extend forward from the front housing end 40 to a free end that is offset with respect to the housing body 37 in the forward direction. Further, the mating ends can be configured such that no straight line exists that is oriented along the transverse direction T and extends through the mating end twice. It is appreciated that the transverse direction can be oriented substantially (e.g., within manufacturing tolerance, as used herein) perpendicular to the surface of the substrate to which the electrical connector is configured to be mounted.

Additionally, the electrical contacts 28 can extend beyond the outermost footprint of the connector housing 34 as defined by the housing body 37 and or both of the latch arms 39 and a dielectric spacer 68 as described below. In particular, the mating ends of the electrical contacts 28 can extend beyond the outermost footprint of the connector housing 34. Thus, the mating ends of the electrical contacts 28 can extend forward from the front housing end 40 to a free end that is offset with respect to the latch arms 39 in the forward direction. Further, the mating ends can be configured such that no straight line exists that is oriented along the transverse direction T and extends through the mating end twice. Accordingly, the electrical contacts 28 can be offset from respective entireties of the latch arms 39 in the forward direction.

The electrical contacts 28 can further define respective mounting ends opposite the mating ends. For instance, the signal contacts S can each define a mounting end 56 opposite the mating end 54. The mounting ends 56 of the signal contacts S can be configured to be attached to an electrical conductor of an electrical cable 46. The mating ends 54 of the signal contacts S can be monolithic with the mounting ends 56. Similarly, the ground contacts G can each define a mounting end 60 opposite the mating end 58. The mounting ends 60 of the ground contacts G can be configured to be attached to a ground, such as an electrical ground shield 48, of a respective one of the electrical cables 46. The mating ends 58 of the ground contacts G can be monolithic with the mounting ends 60.

Further, the electrical contact assembly 52 can include a ground plate 62 configured to support the ground contacts G. For instance, the mating ends 58 of the ground contacts G can extend out from the ground plate 62 in a first direction. The mounting ends 60 can also extend out from the ground plate 62. In particular, the mounting ends 60 can extend out from the ground plate 62 in a second direction opposite the first direction. The mounting ends 60 can then be mounted the ground shields 48 of the electrical cables 46. The ground plate 62 is electrically conductive, and thus electrically commons the ground contacts G together. In one example, the ground contacts G and the ground plate 62 can be stamped or otherwise formed form a single piece of electrically conductive material. In one example, the ground contacts G can be monolithic with the ground plate 62.

Referring now to FIGS. 11-16C, the mating ends 54 and 58 of the signal and ground contacts S and G, respectively can define respective distal tips 64 and 66. The distal tips 64 of the signal contacts S can be substantially in-line with one another along the lateral direction A. Further, the distal tips 66 of the ground contacts G can be substantially in-line with one another along the lateral direction A. In one example, the distal tips 66 of the ground contacts G can be staggered with respect to the distal tips 64 of the signal contacts S along the longitudinal direction L. For instance, the distal tips 66 of the ground contacts G can be in-line with the signal contacts S at a location between the distal tips 64 of the signal contacts S and the mounting ends 56 of the signal contacts S along the longitudinal direction L. Thus, the distal tips 66 of the ground contacts G are not in-line with the distal tips 64 of the signal contacts S.

The electrical contacts 28 can each include a contact body that defines first and second edges, and first and second broadsides. The first and second edges are spaced opposite from one another along the lateral direction. Thus, the first and second edges can face away from one another. At least respective portions of the first and second broadsides can be spaced opposite each other along the transverse direction. Thus, the first and second broadsides can face away from one another. Each of the first and second edges are connected between the first and second broadsides. Similarly, each of the first and second broadsides are connected between the first and second edges.

The edges and broadsides can define respective distances along a plane that is oriented normal to the contact body. For instance, the edges can each extend along a first distance from one of the first and second broadsides to the other of the first and second broadsides along the plane. The broadsides can each extend along a second distance from one of the first and second edges to the other of the first and second edges along the plane. The second distance can be greater than the first distance.

The electrical contacts are arranged edge-to-edge along the lateral direction A. In one example, the connector housing 34, and thus the electrical connector 22, can include a dielectric spacer 68 that extends out from the housing body 37. The dielectric spacer 68 can be disposed between the mating ends of adjacent ones of the signal contacts S. The dielectric spacers 68 can be monolithic with the connector housing body 37. Alternatively, the dielectric spacers can be formed separately from the connector housing body 37 and then inserted between the signal contacts S. In one example, the dielectric spacers 68 can extend in the forward direction from the front end 40 of the housing body 37. The signal contacts S and ground contacts G can extend forward with respect to the dielectric spacers 68. The dielectric spacer 68 can be disposed between adjacent signal contacts S of respective ones of the differential signal pairs. Each dielectric spacer 68 can extend from the inner edge of one of the signal contacts S of a differential signal pair to the inner edge of the other signal contact S of the differential signal pair. Without being bound by theory, it is believed that the dielectric spacers improve performance of the electrical connector assembly.

Referring again to FIGS. 1-5, the mating ends 54 and 58 of the electrical contacts 28 can extend from an end of housing body 37, and thus of the connector housing 34, that does not face the underlying substrate 24. For instance, the mating ends 54 and 58 of the electrical contacts 28 can extend from the front end 40 of the housing body 37, and thus of the connector housing 34. The electrical connector 22 can be configured to terminate the electrical cables 46 to the underlying substrate 24. The electrical connector 22 is configured to be mounted to the substrate 24 having the substrate surface 32 that carries at least one electrical contact pad 30 such as a plurality of electrical contact pads 30, such that the resilient and flexible mating ends 54 and 58 are configured to flex when placed in surface contact with respective ones of the contact pads 30, thereby applying a pressure against the contact pads 30. Thus, it is appreciated that the electrical contacts 28 can be bent such that, when they are pressed against the contact pads 30, they are elastically deformed and exert pressure against the contact pads 30. The contact pads 30 can be define surface mount technology (SMT) contact pads. At least a portion of the mating ends 54 and 58 can extend below the lower end 36 of the housing body 37, and thus of the connector housing 34, when in a relaxed non-compressed position. When the electrical connector 22 is mounted to the substrate 24, the mating ends 54 and 58 can be disposed in a flexed position that is disposed above the relaxed position. The term "above" refers to a direction from the lower housing end 36 to the upper housing end 38. For instance, the bottom-most surfaces of the mating ends can be substantially planar with a bottom surface of the lower housing end 36 when the electrical connector 22 is mounted to the substrate 24. The bottom surface of the connector housing 34 can abut the surface 32 of the substrate 24 that carries the electrically conductive contact pads 30 when the electrical connector 22 is mounted to the substrate 24.

Both the electrical contacts 28 and the contact pads 30 can be plated or otherwise coated with an electrically conductive material. The electrically conductive material can, for instance, be gold so as to provide a low loss electrical connection when the parts are in physical contact. Each contact may be soldered to an electrical conductor or ground of a cable on the end opposing the contact's connection with the substrate, as described in U.S. patent application Ser. No. 14/551,590. The cable 46 may be a coaxial cable, a twinaxial cable, a single conductor cable, or any alternative type of cable. Thus, the cable 46 can include at least one electrical conductor and an insulative layer that surrounds at least a portion of the length of each at least one electrical conductor. The cable 46 can further include a ground, such as a drain wire or ground shield.

The electrical contacts 28 can be overmolded by the housing body 37, and thus the connector housing 34. The overmolding may be formed by an injection molding process as described in U.S. patent application Ser. No. 14/551,590. Many types of plastic resins may be used in the overmold depending on the application. In some applications acrylonitrile butadiene styrene (ABS) resins may be used. These resins can be overmolded at lower temperature and pressure than some other resins and allow for tight mechanical tolerances on the contact array. Liquid crystal polymer (LCP) can be overmolded at a higher temperature and pressure than ABS resins. Though it can therefore be more difficult to maintain tight mechanical tolerances on the contacts with LCP resins, the resulting connector may be rated at a higher operating temperature.

Alternatively, the electrical contacts 28 can be stitched in the housing body 37, and thus the connector housing 34. Thus, the housing body 37, and thus the connector housing 34, is configured to provide mechanical support and electrical isolation between the electrical contacts 28. The electrical connector 22 can include a plurality of housing bodies 37, and thus housings 34. Thus, it can be said that the electrical connector 22 can include at least one connector housing 34 that includes a respective at least one housing body 37. The electrical connector 22 can further include a respective at least one electrical contact 28 such as a plurality of electrical contacts 28 supported by each at least one housing body 37, and thus the at least one connector housing 34. In one example, the electrical contacts 28 that are attached to the conductors of the cables 46 are not physically separable from the connector housing 34 without damaging or destroying the electrical contacts 28, the connector housing 34, or both. Each housing body 37, and thus connector housing 34, and its respective electrical contacts 28, in combination, can be referred to as connector housing assemblies. Thus, the electrical connector can include at least one connector housing assembly.

Figure 7:
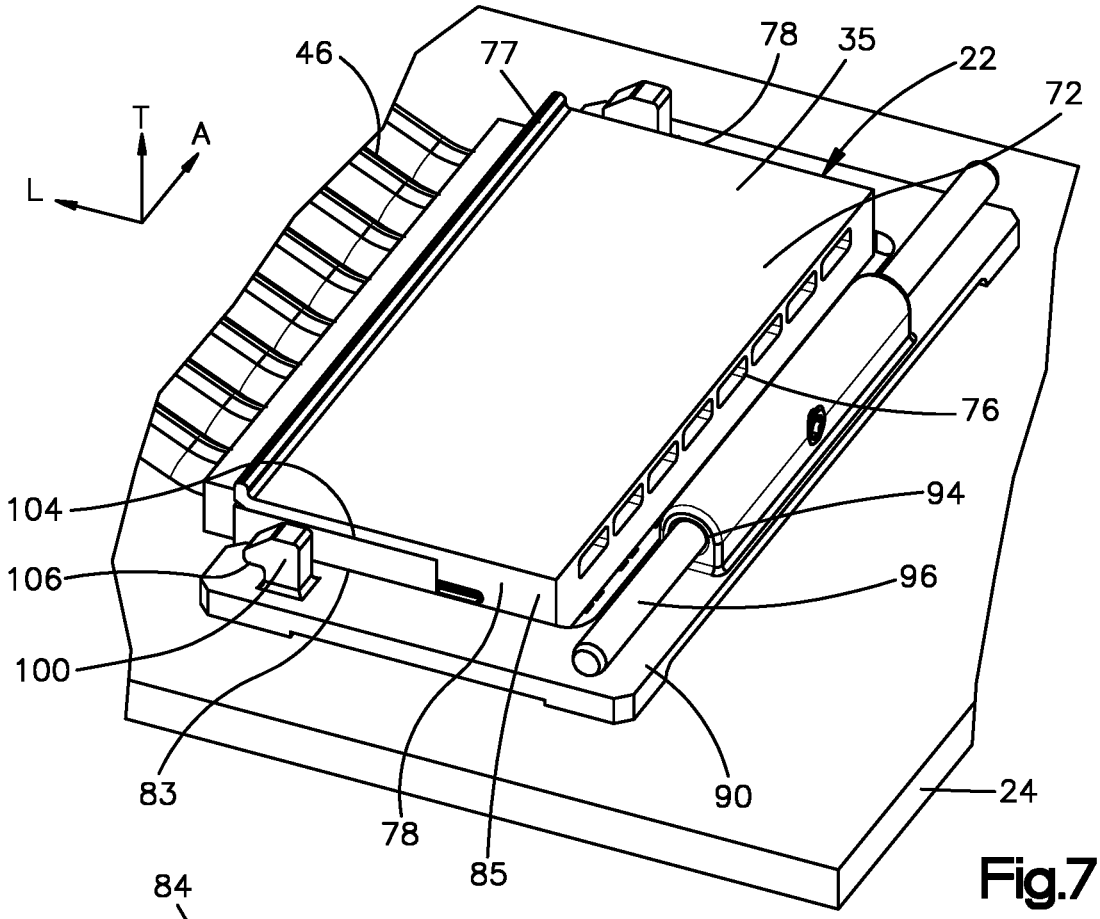
FIG. 7 is a perspective view showing the electrical connector mounted to the substrate.
Figure 8:
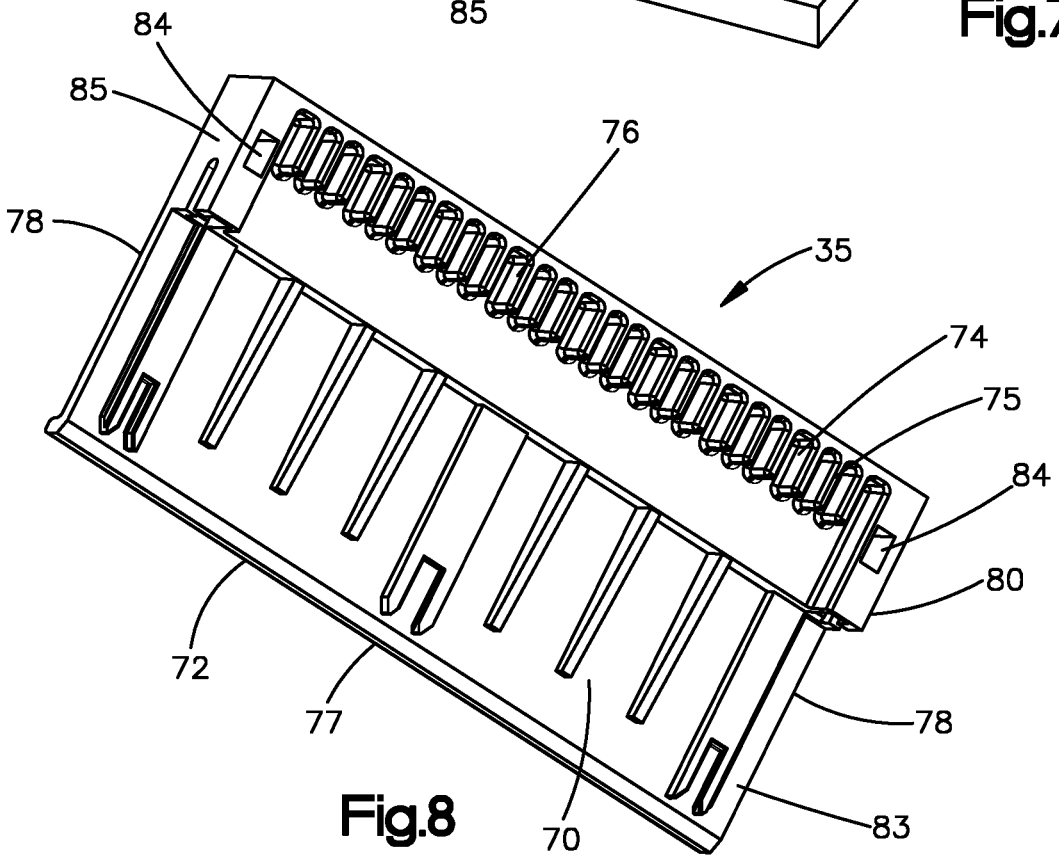
FIG. 8 is a perspective view of a cover of the electrical connector illustrated in FIG. 7.
Figure 9:
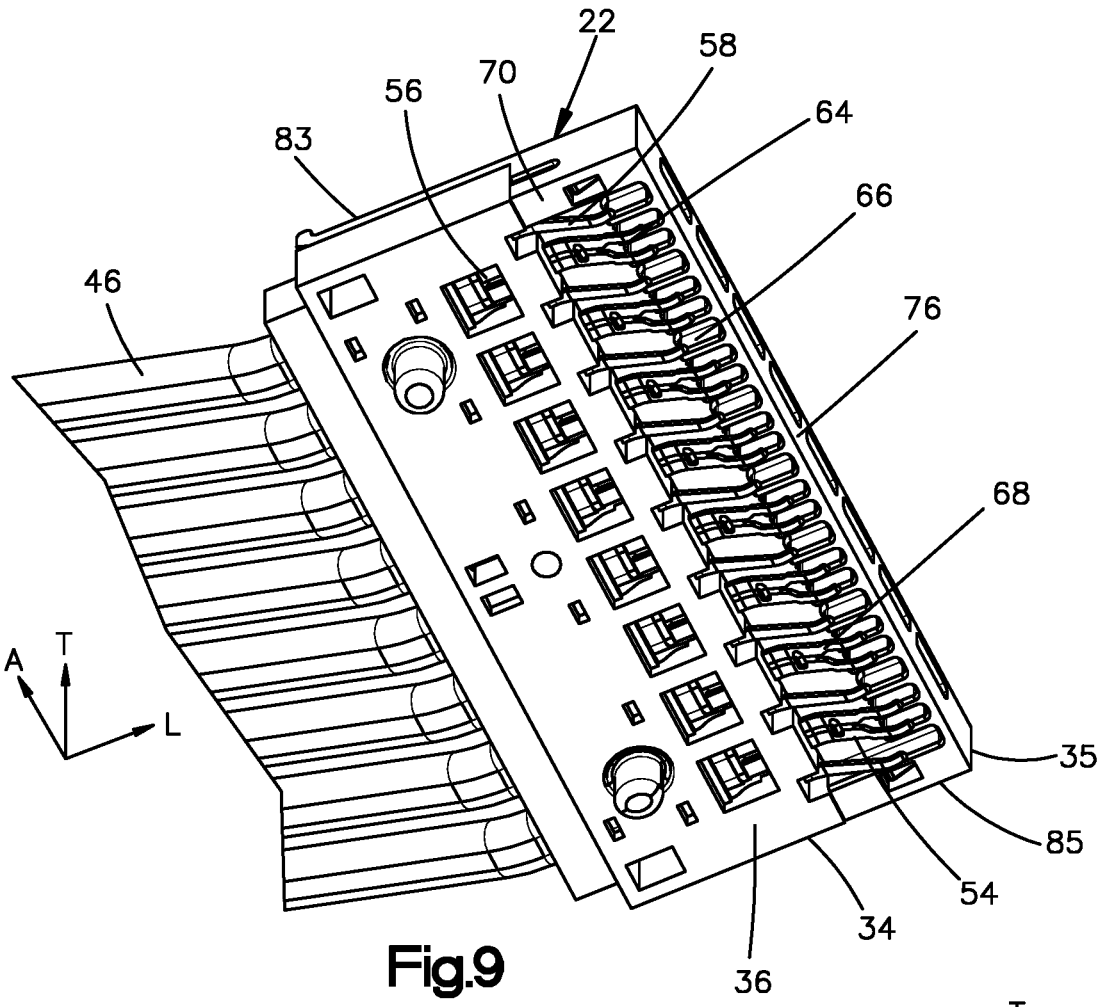
FIG. 9 is another perspective view of the electrical connector shown mounted to a plurality of cables.

Referring now to FIGS. 7-9, the electrical connector 22 can further include a cover 35 that can be attached to the housing body 37, and thus to the connector housing 34. Accordingly, each connector housing assembly can include its own cover 35, or a single cover 35 can be attached to one or more connector housings 34 of the respective connector housing assemblies. The connector cover 35 can be made of a metallic material. Alternatively, the connector cover 35 can be made of a non-metallic material. Further, the connector cover 35 can be made of an electrically conductive material so as to provide electrical shielding to the electrical contacts 28. Alternatively, the connector cover 35 can be made of an electrically nonconductive material as desired. The connector cover 35 can provide mechanical protection to the electrical contacts 28 that are supported by the connector housing 34. In particular, the connector cover 35 can define a lower cover end 70 that faces the connector housing 34, and an upper cover end 72 opposite the lower cover end 70 along the transverse direction T. The lower cover end 70 can define a bottom surface of the connector cover 35.

The upper cover end 72 can be defined by a top wall that is configured to cover at last a portion of the connector housing 34. In this regard, the connector cover 35 can include a housing portion 83 that is configured to cover at least a portion of the connector housing 34. In this regard, the lower and upper housing ends 36 and 38 of the connector housing 34 can be open at locations aligned with the connection between the electrical contacts 28 and the cables 46. When the connector cover 35 is attached to the connector housing 34, the housing portion 83 of the connector cover 35 can extend over the connection between the electrical contacts 28 and the cables 46. For example, the lower cover end 70, and thus the bottom surface of the connector cover 35, can extend over and cover the cable bays 44 of the connector housing 34 at the housing portion 83.

The connector cover 35 can define a plurality of contact openings 74 that extend into the lower cover end 70 in a direction toward the upper cover end 72. The contact openings 74 can terminate between the lower and upper cover ends 70 and 72, respectively, without extending through an upper surface of the upper cover end 72 of the connector cover 35. The housing body 37, and thus the connector housing 34, can define a plurality of divider walls 75 that separate the contact openings 74 from each other. The contact openings 74 can be elongate along the longitudinal direction L, and spaced from each other along the lateral direction A. Each of the contact openings 74 can be aligned with a respective one of the mating ends 54 and 58 of the electrical contacts 28. For instance, the tips 64 and 66 can extend into respective ones of the contact openings 74 when the electrical connector 22 is compression mounted to the substrate 24.

The connector cover 35 can define a front wall 76 and a rear wall 77 opposite the front wall 76 along the longitudinal direction L. The connector cover can further define opposed side walls 78 that are opposite each other along the lateral direction A. The front wall 76 can be disposed forward with respect to the tips 64 and 66. The side walls 78 can be disposed such that the mating ends 54 and 58 are disposed between the sides 78 when the connector housing 34 is attached to the cover. Thus, when the electrical connector 22 is mounted to the substrate 24, the substrate, the front housing end 40, the front wall 76 of the connector cover 35, the upper cover end 72, and the side walls 78 of the connector cover 35 can encapsulate the mating ends 54 and 58 of the electrical contacts. Otherwise stated, the electrical connector and the substrate 24 can combine so as to surround all sides of the mating ends 54 and 58 of the electrical contacts 28.

In particular, the connector cover 35 can include a contact portion 85 that defines the contact openings 74. Thus, it should be appreciated that the lower cover end 70 at the contact portion 85 is configured to face the substrate 24. For instance, the lower cover end 70 at the contact portion 85 can abut the substrate 24 at the substrate surface 32. The contact portion 85 can be monolithc with the housing portion 83. Alternatively, the contact portion 85 can be separate from the housing portion 83 and attached to the housing portion 83.

The contact portion 85 can define the front wall 76, which can also be referred to as an end wall of the cover. Thus, the contact portion 85 can extend from the housing portion 83 to the front wall 76. The front wall 76 can be disposed outward from the mating ends 54 and 58 of the electrical contacts 28 with respect to the forward direction. Further, the tips of the mating ends of the electrical contacts 28 can be in-line with the front wall 76 wall along the longitudinal direction such that the front wall 76 protects the tips of the electrical contacts 28.

At least a portion of the mating ends 54 and 58 of the electrical contacts 28 can extend below the bottom surface of the contact portion 85 when the mating ends 54 and 58 are in the relaxed position. For example, a bottom-most surface of each of the mating ends can extend below the bottom surface of the contact portion 85 when in the relaxed position. In addition, the tips of the mating ends of the electrical contacts 28 can extend above or below the bottom surface of the contact portion 85 when in the relaxed position. When the electrical connector is mounted to the substrate, the mating ends 54 and 58 of the electrical contacts can be disposed in a flexed position that is disposed above the relaxed position. For instance, the bottom-most surfaces of the mating ends 54 and 58 can be substantially planar with the bottom surface of the contact portion 85 when the electrical connector 22 is mounted to the substrate 24. The bottom surface of the contact portion 85 can abut the surface 32 of the substrate 24 that carries the electrically conductive contact pads 30 when the electrical connector 22 is mounted to the substrate 24.

The connector cover 35 can be attached to the connector housing 34 in any manner desired. For instance, the connector cover 35 can include at least one attachment member 80 that is configured to attach to a complementary at least one attachment member 82 of the connector housing 34. For instance, the at least one attachment member 80 of the connector cover 35 can receive the complementary at least one attachment member 82 of the connector housing 34. The at least one attachment member 82 of the connector housing 34 can be configured as the latch arm 39 described above. In particular, the at least one attachment member of the connector housing 34 can include a pair of latch arms 39. Each latch arm 39 can define a barbed surface 43 that is configured to catch on a corresponding catch surface 84 of the connector cover 35 so as to attach the connector housing 34 and the cover to each other. Thus, the a least one attachment member 80 of the connector cover 35 can be configured as a catch surface 84 that is configured to interfere with the barbed latch surface 43 surface of the connector housing 34. For instance, the at least one attachment member 80 of the cover can include a pair of catch surfaces 84 spaced from each other along the lateral direction A. During operation, the latch arms 39 can be inserted into respective attachment openings of the connector cover 35 until the barbed latch surfaces 43 of the latch arms 39 catch onto the respective catch surfaces 84 of the connector cover 35. The attachment openings of the connector cover 35 can extend forward into the contact portion 85. Thus, the connector housing 34 can attach to the contact portion 85 of the connector cover 35. When the barbed latch surfaces 43 engage the respective catch surfaces 84, relative movement of the connector housing 34 with respect to the cover in the rearward direction is at least limited, such as prevented. In particular, the connector housing 34 can be mounted to the substrate 24, such that the electrical contacts 28 are mated with the respective contact pads 30. The connector housing 34 can subsequently be attached to the connector cover 35. It should be appreciated in alternative embodiments that the connector cover 35 can include the at least one latch arm 39, and the connector housing 34 can include the complementary at least one catch surface 84.

Referring now to FIGS. 10A-14, the electrical connector assembly 20 can further include at least one attachment mechanism 86 that is configured to attach the electrical connector 22 to the substrate 24. The attachment mechanism 86 can further apply a compression force to the electrical connector 22 against the substrate 24. The compression force provides a counterforce to the force that the electrical contacts 28 exert on the connector housing 34 in a direction away from the substrate 24. The at least one attachment mechanism 86 secures the electrical connector 22 to the substrate 24 so as to (i) maintain the electrical contacts 28 in their flexed positions against the contact pads 30 and (ii) resist separation forces that are exerted on one or both of the connector housing 34 and the substrate 24 to separate the connector housing 34 and the substrate 24 from one another. For instance, the at least one attachment mechanism 86 can resist separation forces exerted by the electrical contacts 28 on the connector housing 34 as a result of the electrical contacts 28 being compressed to their respective flexed positions.

Further, the at least one attachment mechanism 86 can be configured to resist separation forces applied by a source external to the electrical connector assembly 20 in one or both of a vertical direction and a horizontal direction. For instance, the external force could be exerted on the cables 46 in a downward vertical direction, which in turn causes a moment to be applied to the electrical connector 22 that biases the electrical connector 22 in an upward vertical direction at the mating ends 54 and 58 of the electrical contacts 28. Thus, the moment applies a separation force to the electrical connector 22 along an upward vertical direction away from the substrate 24.

Thus, the at least one attachment mechanism 86 can include a compression member 88 that is configured to apply an opposing compression force to the electrical connector 22 to the electrical connector 22 in a downward direction towards the substrate 24. The downward direction can be oriented along the transverse direction T. In one example, the compression member 88 can be configured to apply the compression force to the connector cover 35. Alternatively or additionally, the compression member 88 can be configured to apply the compression force to the connector housing 34.

The compression member 88 can be configured to attach to each of the electrical connector 22 and the substrate 24 so as to secure the electrical connector 22 to the substrate 24. In one example, the attachment mechanism 86 can include a support member 90 that is attached to the substrate 24. Thus, the compression member 88 can attach to the support member 90 that is in turn attached to the substrate 24. Accordingly, it can be said that the support member 90 attaches the compression member 88 to the substrate 24. The compression member 88 can be configured to extend over at least a portion of the electrical connector 22, such that the portion of the electrical connector 22 is disposed between the compression member 88 and the substrate 24. In one example, the compression member 88 can be disposed over the connector cover 35, such that the connector cover 35 is disposed between the compression member 88 and the substrate 24. It should thus be appreciated that the compression member 88 can be supported by the substrate 24, and apply a compression force against the electrical connector 22 against the substrate 24 from which the compression member 88 is supported. The compression member 88 can be formed from metal, plastic, or other suitably stiff material.

The compression member 88 can include any suitable fastening feature that is configured to secure the compression member 88 to the substrate 24. The fastening feature can be configured in accordance with any suitable embodiment as desired. For instance, in one example, the fastening feature can be configured as the support member 90. The support member 90 can be mounted to the substrate 24 using any known fastening system as desired. The support member 90 can include a support body 91 that is configured to be attached to the substrate 24, and a bore 94 that extends at least into the support body 91. For instance, the bore 94 can extend through the support body 91. The attachment mechanism 86 can further include a pivot member 96 that is received in the bore 94 while the pivot member 96 extends along a pivot axis. The compression member 88 can likewise define a bore 98 that receives the pivot member 96. Thus, the compression member 88 can be pivotable with respect to the support body 91, and thus the support member 90, about the pivot axis. The pivot member 96 can be configured as a pivot pin in one example.

Figure 10A:
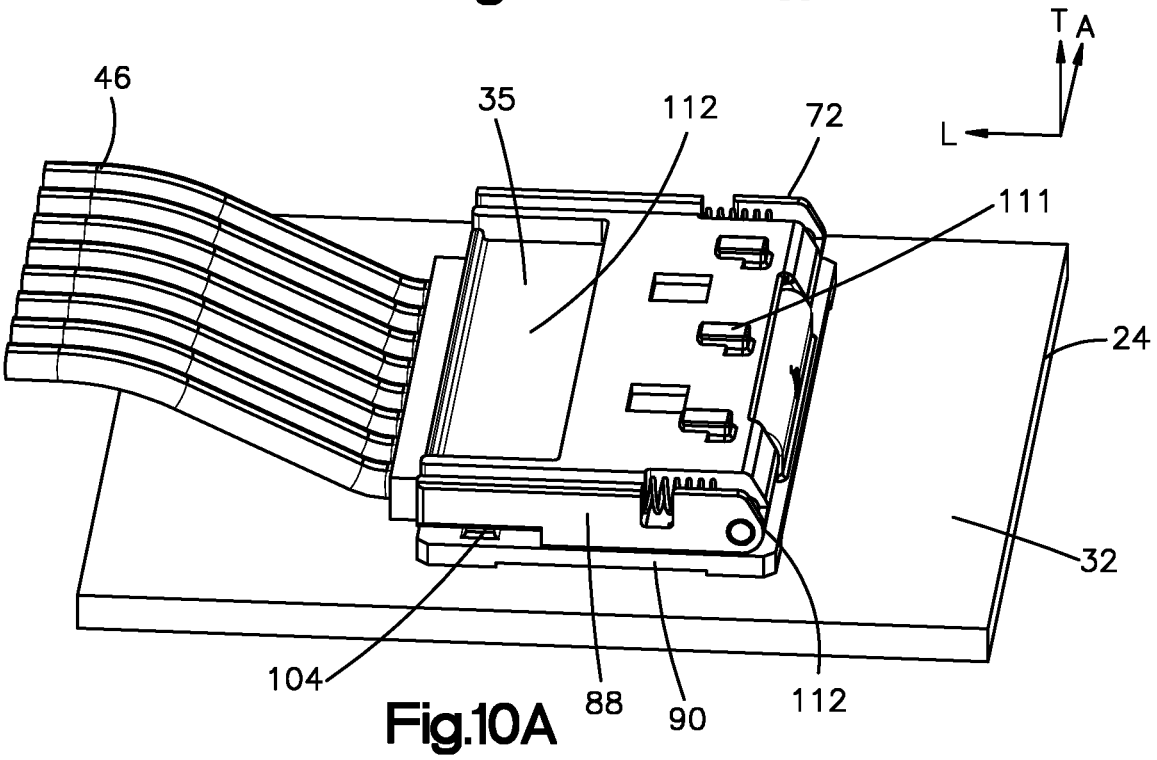
FIG. 10A is a perspective view of a portion of the electrical connector assembly illustrated in FIG. 1.
Figure 10B:
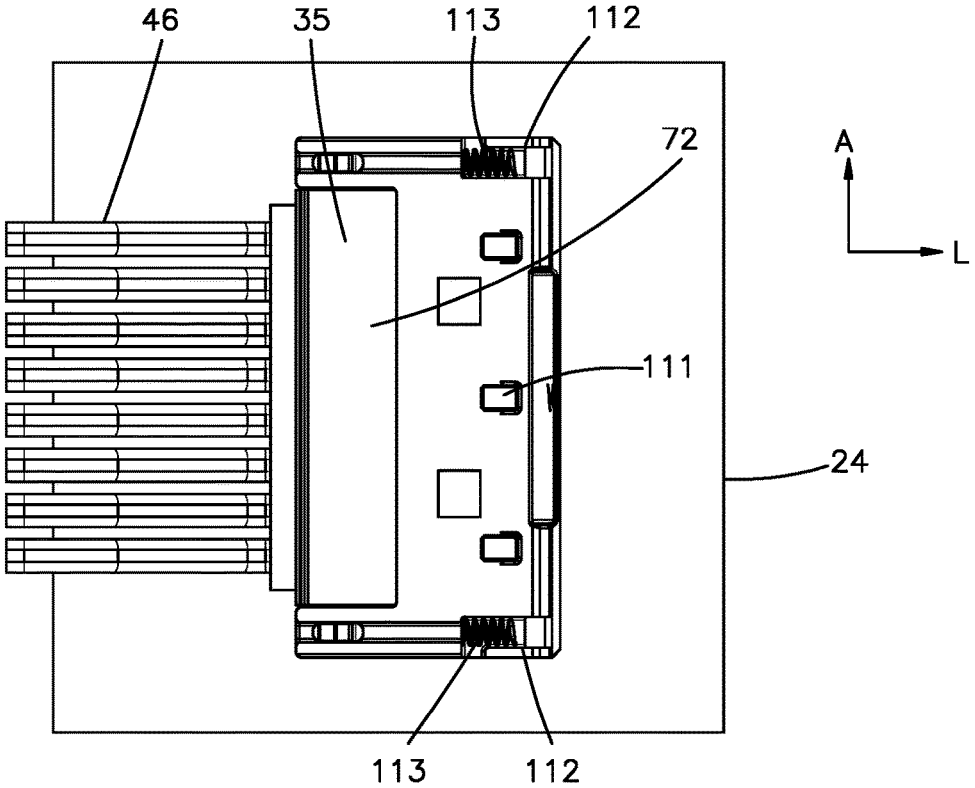
FIG. 10B is a top plan view of the portion of the electrical connector assembly illustrated in FIG. 10A.
Figure 10C:
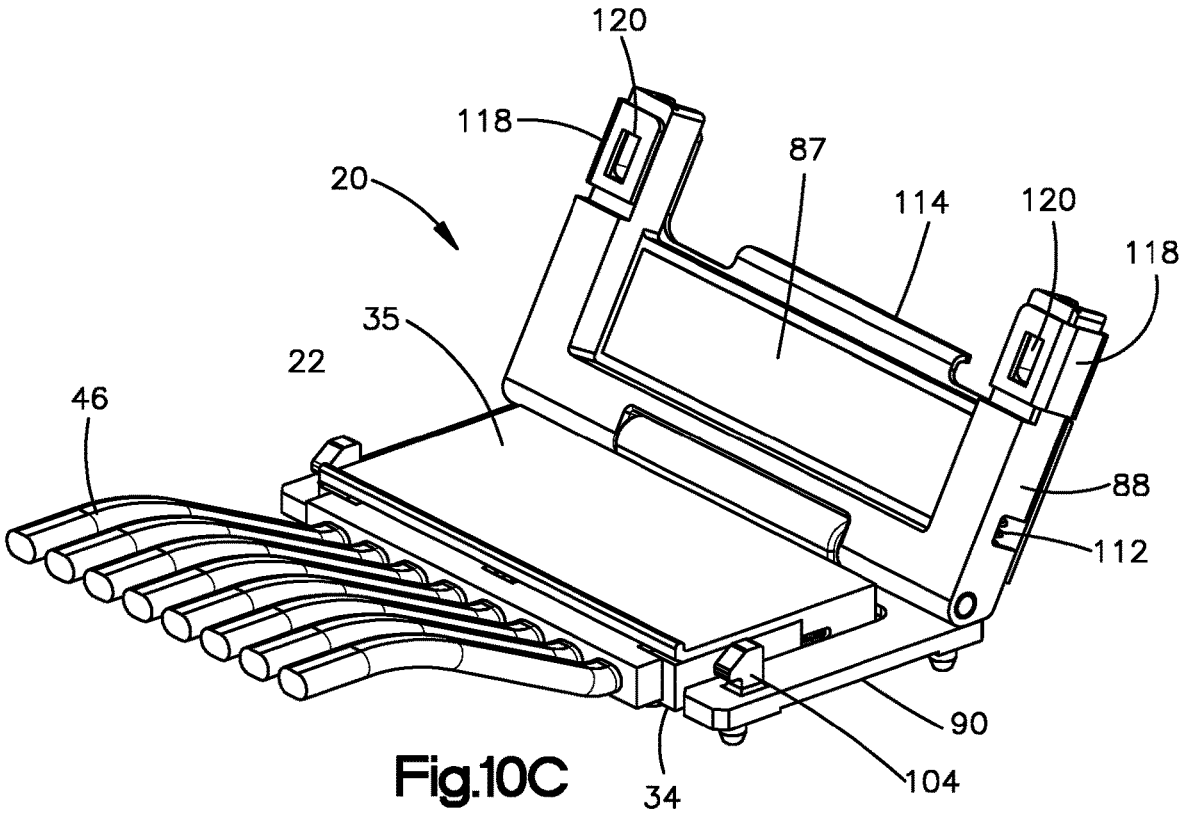
FIG. 10C is a perspective view of the electrical connector assembly illustrated in FIG. 1, shown in an unlocked position.

In particular the compression member 88 can pivot about the pivot member 96, and thus about the pivot axis, between an engaged position (FIG. 10A) and a disengaged position (FIG. 10C). When the compression member 88 is in the engaged position, the compression member 88 applies the compression force to the electrical connector 22 so as to maintain the mating ends 54 and 58 of the electrical contacts 28 in their compressed state against the contact pads 30 of the substrate 24. In particular, an abutment surface 87 of the compression member 88 abuts the upper cover end 72 and can apply the compressive force to the upper cover end 72. Alternatively, the abutment surface 87 of the compression member 88 can abut the upper housing end 38 of the connector housing 34. When the compression member 88 is in the disengaged position, the compression member 88 can be spaced from the connector 22 such that the compression member 88 does not apply the compression force to the electrical connector 22. The pivot axis can be oriented along the lateral direction A. It should be appreciated that the pivot axis can alternatively be oriented along any suitable alternative direction as desired. For instance, the pivot axis can be oriented along the longitudinal direction L or a direction that is angled with respect to each of the longitudinal direction L and the lateral direction A. Thus, the pivot axis can be oriented in a plane defined by the longitudinal direction L and the lateral direction A.

While the compression member 88, the support member 90, and the pivot member 96 can be separate from each other and attached to each other in one example, it should be appreciated that one or more up to all of the compression member 88, the support member 90, and the pivot member 96 can be monolithic with each other in accordance with an alternative embodiment. For instance, the pivot member 96 can be monolithic with the support member 90, and the compression member 88 attaches to the pivot member 96. Alternatively, the pivot member 96 can be monolithic with the compression member 88, and the support member 90 attaches to the pivot member 96. Alternatively still, the compression member 88 and the support body 91 can be monolithic with each other so as to define the pivot member 96 as a living hinge.

The compression member 88 can be attached to the support member 90 at a second attachment location different than the pivot member 96, so as to secure the compression member 88 in the engaged position. For instance, the compression member 88 can be attached to the support member 90 at a location offset from the pivot axis along a direction perpendicular to the pivot axis. The direction offset from the pivot axis can be defined in a plane that includes the longitudinal direction L and the lateral direction A. When the pivot axis extends along the lateral direction, the direction offset can be defined by the longitudinal direction L. The location whereby the compression member 88 is attached to the support member 90 can also be offset from the pivot axis along the transverse direction T. Further, because the compression member 88 can be attached to the support member 90 that, in turn, is attached to the substrate, it can be said that the compression member 88 can be secured to the substrate 24. In particular, the compression member 88 can be secured to the substrate at a location different than the location whereby the electrical connector 22 is attached to the substrate. Otherwise stated, the compression member 88 can be secured to the substrate independent of the electrical connector 22.

The compression member 88 can attach to the support member 90 at the second attachment location in any manner as desired. For instance, the support member 90 can include at least one attachment member 100 that is configured to attach to a complementary attachment member 102 of the compression member 88. For instance, the at least one attachment member 102 of the compression member 88 can be configured to receive the at least one attachment member 100 of the support member 90. The at least one attachment member 100 of the support member 90 can be configured as a latch arm 104 that extends out from the support body 91. For instance, the latch arm 104 can extend in the upward direction from the support body 91 away from the substrate 24 when the support member 90 is mounted to the substrate 24. In particular, the at least one attachment member 100 of the support member 90 can include a pair of latch arms 104. Each latch arm 104 can define a barbed surface 106 that is configured to catch on a corresponding catch surface 108 of the compression member 88 so as to attach the compression member 88 to the support member 90 at the second attachment location.

Thus, the at least one attachment member 102 of the compression member 88 can be configured as a catch surface 108 that is configured to interfere with the barbed latch surface 106 of the support member 90. For instance, the at least one attachment member 102 of the compression member 88 can include a pair of catch surfaces 108 spaced from each other along the lateral direction A. During operation, the latch arms 104 can be inserted into respective attachment openings 110 of the compression member 88 until the barbed latch surfaces 106 of the support member 90 catch onto the respective catch surfaces 108 of the compression member. The attachment openings 110 of the compression member 88 can extend upward along the transverse direction T. When the barbed latch surfaces 106 engage the respective catch surfaces 108, relative movement of the compression member 88 with respect to the support member 90 in the upward direction at the second attachment location is at least limited, such as prevented. Thus, the compression member 88 is unable to pivot about the pivot axis toward the disengaged position in an amount sufficient to remove the compression force. It should be appreciated in alternative embodiments that the compression member 88 can include the at least one latch arm 104, and the support member 90 can include the complementary at least one catch surface 108.

The attachment mechanism 86 can further include a biasing member 112 that urges the compression member 88 to remain attached to the support member 90 at the second attachment location. For instance, the biasing member 112 can be configured as a spring that extends from the compression member 88 to a second structure, such that the spring biases the compression member 88 in the rearward direction. Because the barbed latch surfaces 106 can extend in the forward direction, rearwardly biasing the compression member 88 causes the catch surfaces 108 to likewise be biased in the rearward direction in engagement with the latch surfaces 106. The second structure can be defined by one or both of the pivot member 96 and the support body 91. The biasing member 112 can be configured as a pair of springs that extend in respective pockets 113 of the compression member 88.

The attachment mechanism 86 can further include an attachment cover 114 that is configured to be secured to the compression member 88. The attachment cover 114 can be made of any suitable material, such as a metal or nonmetallic material, such as a polymer or lossy material. For example, the attachment cover 114 can be electrically conductive or electrically nonconductive as desired. The attachment cover 114 is configured to extend over the pockets 113. Thus, the attachment cover 114 is configured to provide mechanical protection to the biasing members 112. The attachment cover 114 is configured to attach to the compression member 88. For instance, the compression member 88 can define at least one attachment arm 111 that defines a respective at least one attachment slots 116 configured to receive the attachment cover 114. For instance, the at least one attachment slot 116 can be positioned and configured to receive the front end of the attachment cover 114. The at least one attachment arm 111 can include a plurality of attachment arms 111 that are spaced from each other along the lateral direction A. Thus, the at least one attachment slot 116 can include a plurality of attachment slots defined by the attachment arms 111, respectively.

The attachment cover 114 can further include at least one spring arm 105 that is configured to flex against the compression member 88 when the attachment cover 114 is attached to the compression member 88. Thus, the at least one spring arm 115 can provide a separation force against the compression member 88 that urges the compression member 88 and the attachment cover apart along the transverse direction T. Thus, the separation force urges the attachment cover 114 against the attachment arms 111, thereby maintaining the attachment between the attachment cover 114 and the compression member 88.

The attachment cover 114 can further include arms 118 that are configured to be disposed adjacent laterally opposed sides of the compression member 88 that define the respective attachment openings 110. The attachment openings 110 can be aligned with the arms 118. For instance, the attachment openings 110 can be aligned with the arms 118 along the transverse direction. In one example, the arms 118 can receive the opposed sides of the compression member 88. The cover 114 can thus define respective openings 120 that extend through at least one wall of the arms and are aligned with the attachment openings 110 of the compression member 88. The at least one wall of the cover can be disposed below the compression member 88. Thus, the respective openings 120 of the cover 114 are configured to receive the latch arms 104 of the support member 90. The latch arms 104 can thus extend through the openings 120 of the bracket arms 118 and into the attachment openings 110 of the compression member 88.

The attachment cover 114 can further include a seat 117 that extends into the a respective one of the pockets 113, such that a first end of the biasing member 112 abuts the seat 117. In particular, the attachment cover 114 can include first and second seats 117 that extend into respective ones of the pockets 113, such that a first end of the biasing members 112 abuts respective ones of the seats 117. A second end of the biasing members 112 opposite the first end can abut the compression member 88. The biasing members 112 can apply a force against the seats 117 that biases the attachment cover 114 in the forward direction to a forward position. When the attachment cover 114 is in the forward position, a locking region 119 is aligned with the barbed surfaces 106 of the latch arms 104 along the transverse direction T. The locking regions 119 can be defined by the attachment cover 114 and can partially define the attachment openings 120. Alternatively, the locking region 119 can be defined by the compression member 88 and can partially define the attachment openings 110. Thus, the locking regions 119 interfere with the latch arms 104 so as to prevent upward movement of the attachment cover 114 with respect to the support member 90, and thus away from the electrical connector 22. Further, because the attachment cover 114 is attached to the compression member 88, the compression member 88 is also prevented from moving away from the electrical connector 22 when the attachment cover 114 is in the forward position. Thus, the forward position can be referred to as a locked position. The biasing members 112 apply a biasing force against the attachment cover 114 that biases the attachment cover 114, and thus the attachment mechanism 86, to the locked position.

Figure 11A:
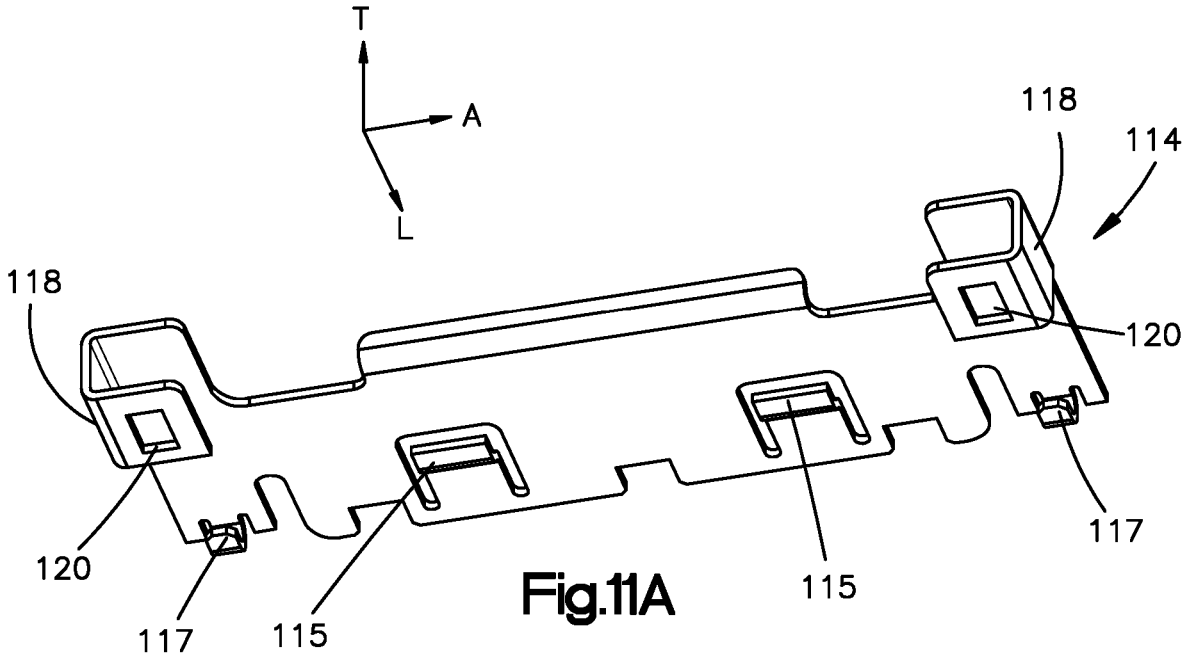
FIG. 11A is a perspective view of an attachment cover of the electrical connector assembly illustrated in FIG. 11.
Figure 11B:
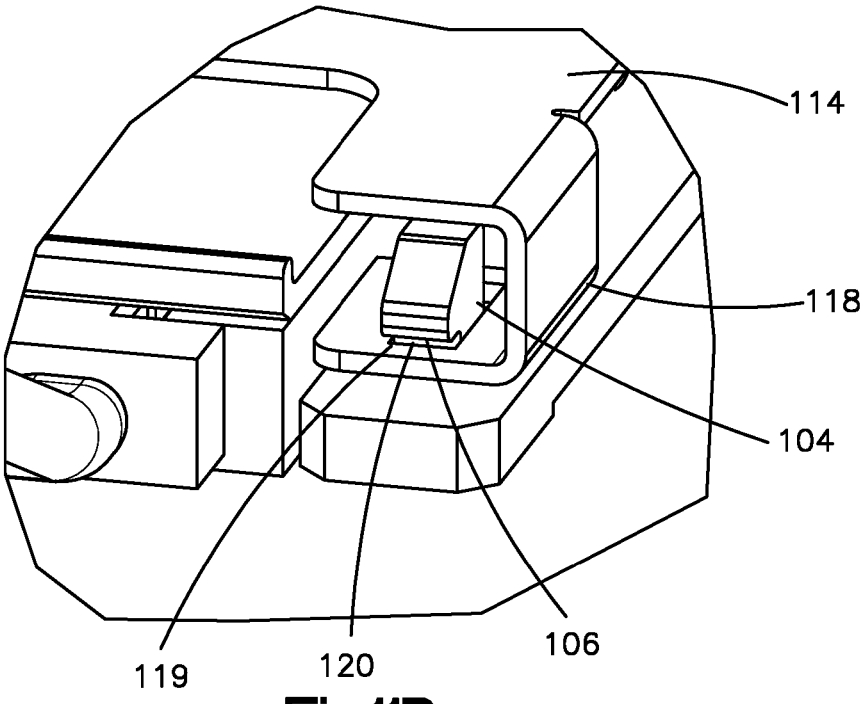
FIG. 11B is a perspective view of a portion of the electrical connector assembly, showing an attachment mechanism moved to an unlocked position.
Figure 12A:
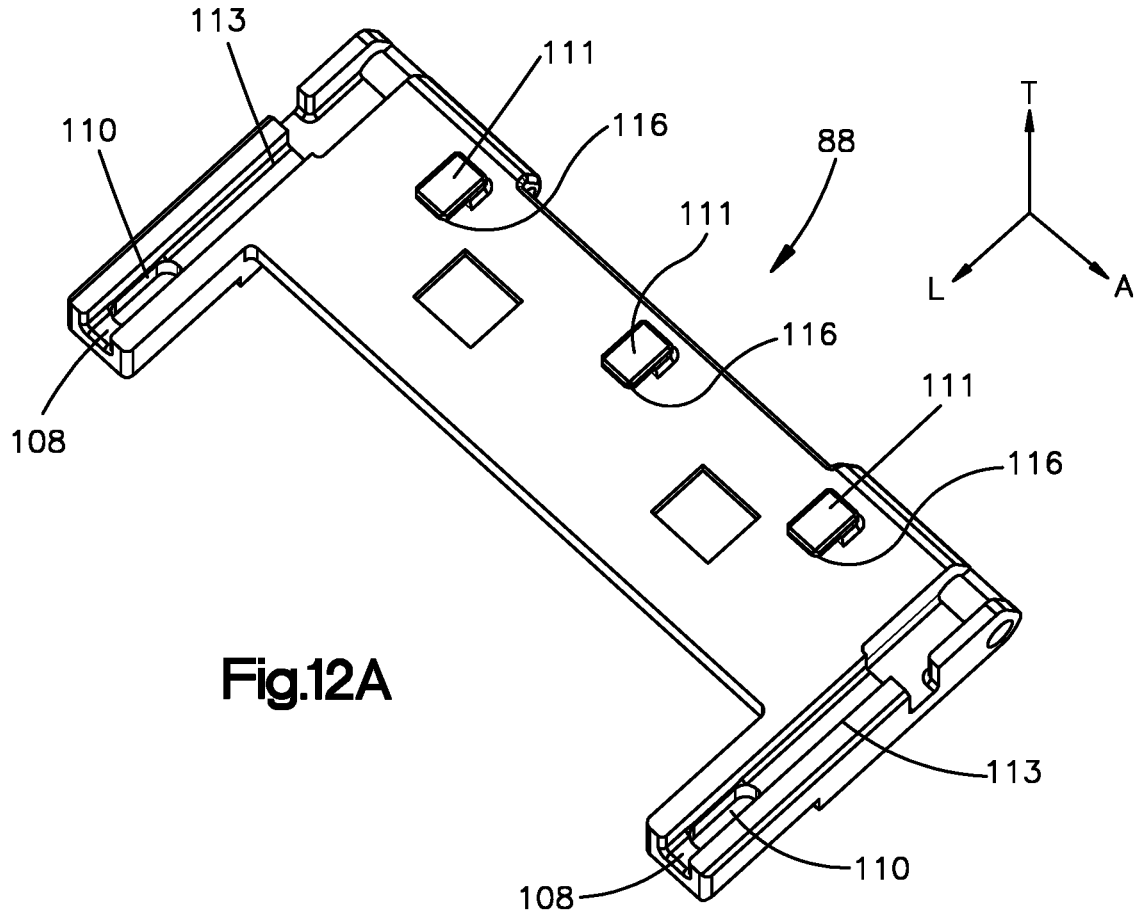
FIG. 12A is a perspective view of a compression member of the electrical connector assembly illustrated in FIG. 11.
Figure 12B:
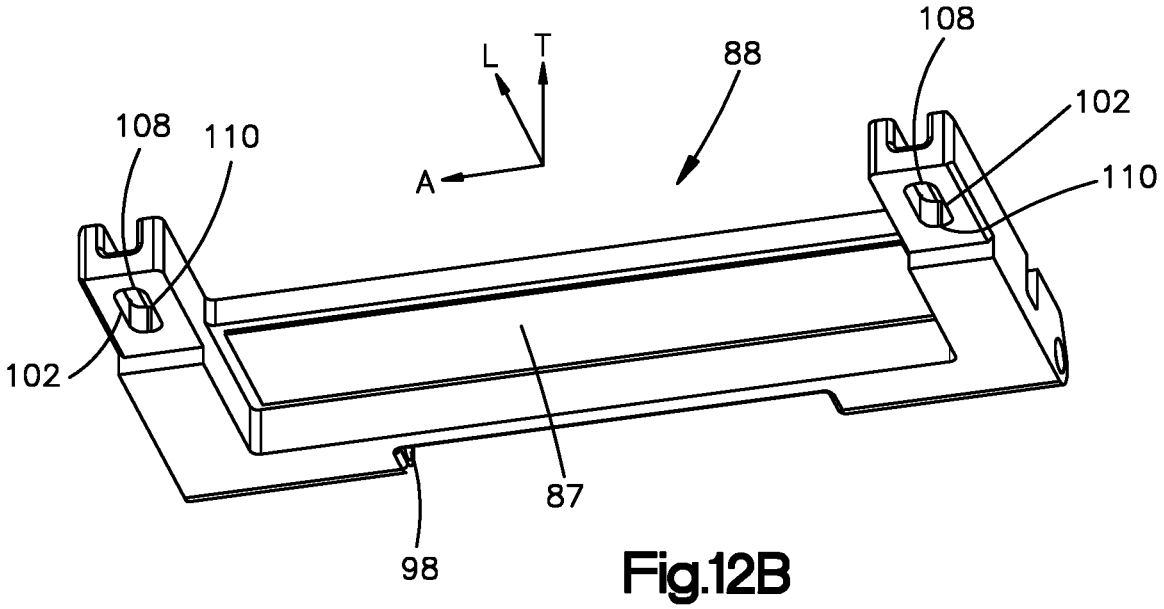
FIG. 12B is another perspective view of the compression member illustrated in FIG. 12A.
Figure 13:
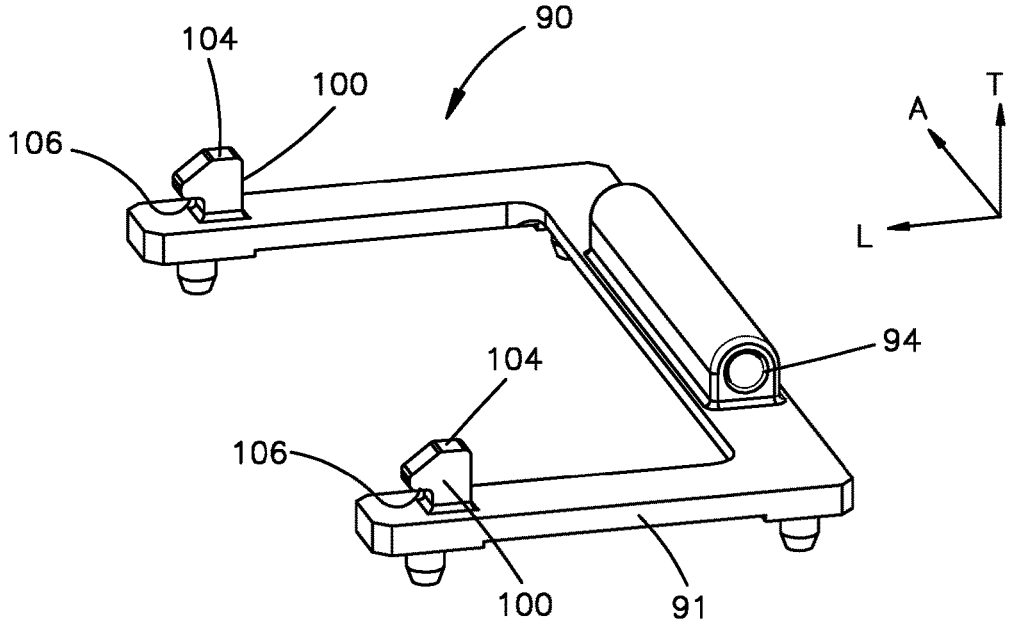
FIG. 13 is a perspective view of a support member of the electrical connector assembly illustrated in FIG. 1.
Figure 14:
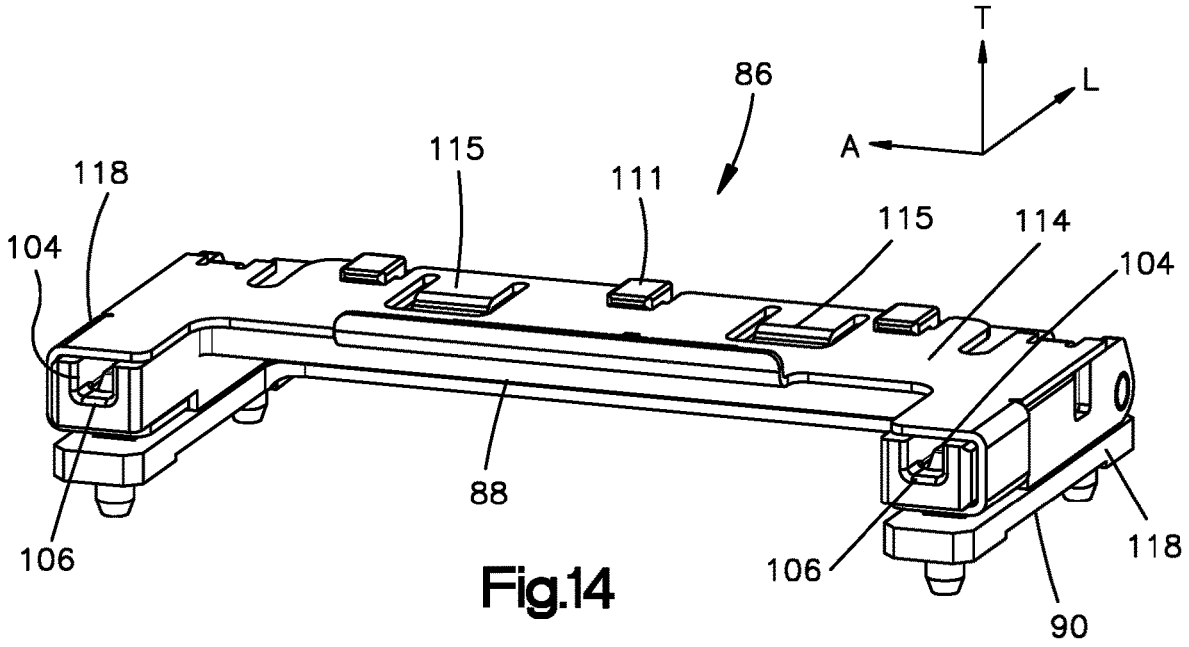
FIG. 14 is a perspective view of an attachment mechanism including the attachment cover illustrated in FIG. 11, the compression member illustrated in FIG. 12A, and the support member illustrated in FIG. 13.

The attachment cover 114 is movable in the rearward direction with respect to the support member 90 against the biasing force of the basing members 112 to an unlocked position (FIG. 11B shown with the compression member 88 removed for the purposes of illustration). When the attachment cover 114 is in the unlocked position, the locking regions 119 are spaced from the barbed surfaces 106 in the rearward direction. Thus, the latch arms 104 are aligned with the attachment openings 120, such that the attachment cover 114 can be removed from the support member 90. In one embodiment, the compression member 88 can pivot about the pivot axis so as to remove the attachment cover 114 from the support member 90. As the attachment cover 114 is removed from the support member 90, the compression member 88 is likewise removed from the electrical connector 22, thereby removing the compression force. As the attachment cover 114 is removed from the support member 90, the barbed surfaces 106 of the latch arms 104 move through the attachment openings 120 of the attachment cover 114 and the attachment openings 110 of the compression member 88. In this regard, it should be appreciated that because the attachment cover 114 is attached to the compression member 88, the compression member 88 can likewise move with the attachment cover 114 between the locked position and the unlocked position.

When it is desired to again apply the compression force to the electrical connector 22, the attachment mechanism 86 can again be moved from the unlocked position to the locked position. In particular, the attachment cover 114 can be moved down against the electrical connector 22, which causes the barbed surfaces 106 to be received in the attachment openings 110 and 120. Once the barbed surfaces 106 clear the locking regions 119, the biasing force of the biasing member 112 causes the attachment cover 114 to move in the rearward direction with respect to the support member 90 and the electrical connector 22 to the locked position.

In this regard, the attachment cover 114 can be referred to as a locking member. The locking member can be provided in the form of a cover 114, or it should be appreciated that the locking member can be defined by any suitable structure configured to move between a locked position that retains the compression member 88 in a position such that the compression member 88 applies the compression force to the electrical connector 22, and an unlocked position whereby the compression member 88 can be moved away from the electrical connector 22 to thereby remove the compression force.

Figure 5:
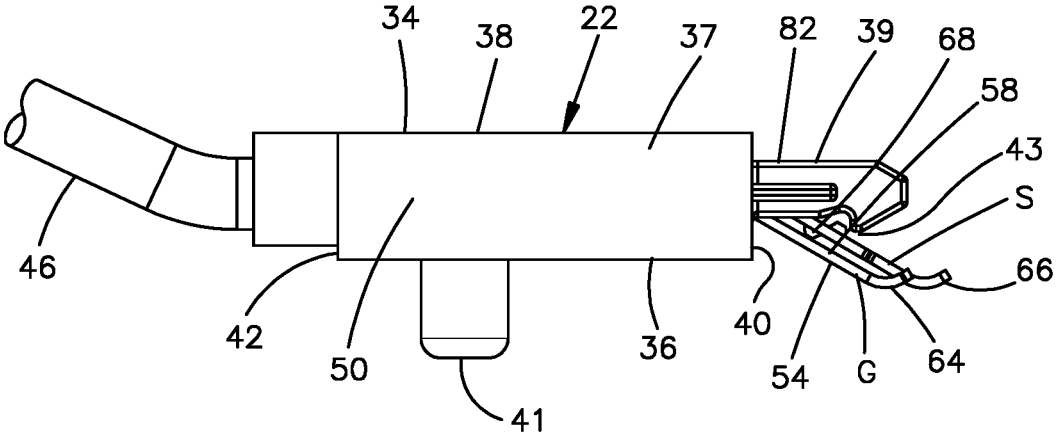
FIG. 5 is a side elevation view of the connector housing illustrated in FIG. 4A supporting a plurality of electrical contacts.
Figure 15:
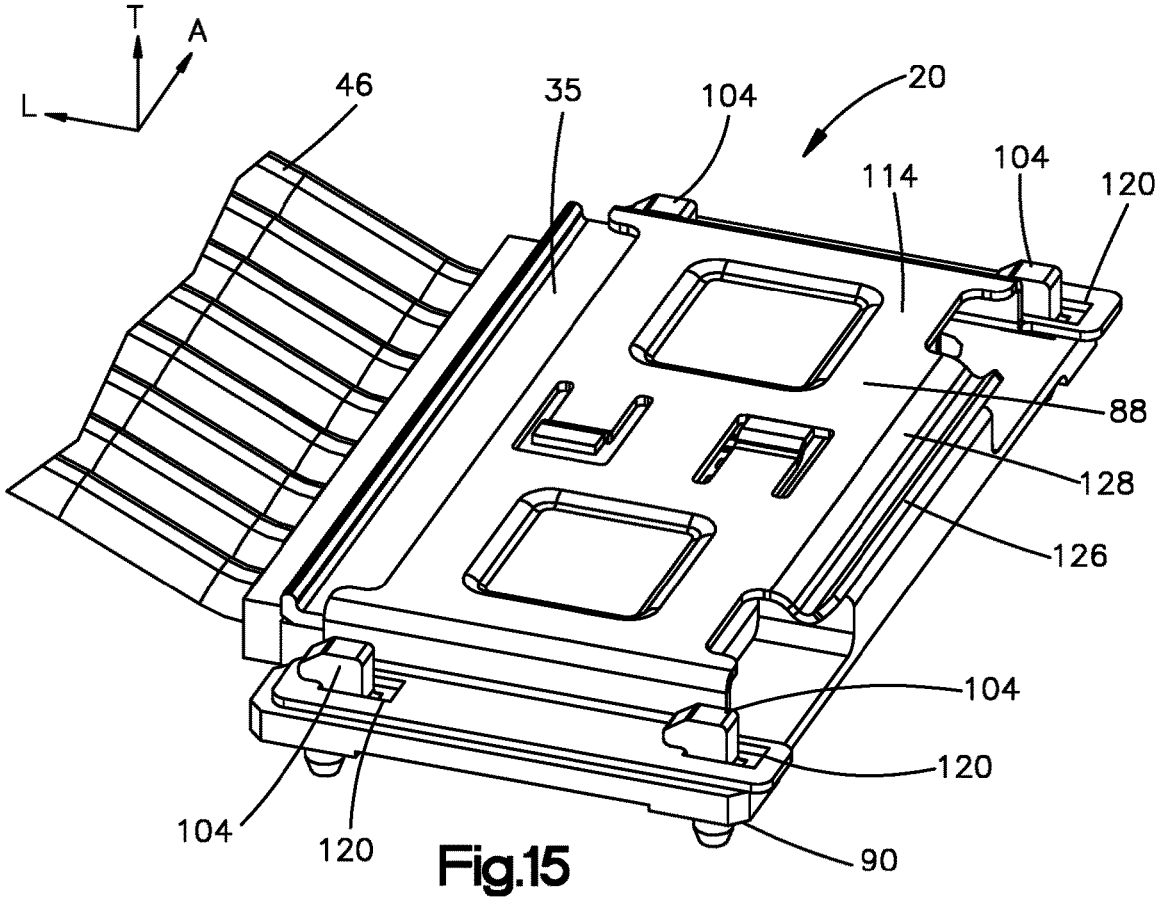
FIG. 15 is a perspective view of a portion of an electrical connector assembly including an attachment mechanism constructed in accordance with an alternative embodiment.

It should be appreciated that the attachment mechanism 86 can be configured to attach the electrical connector 22 to the substrate 24 in accordance with any suitable alternative embodiment. For instance, the compression member 88 can apply the compression force that biases the electrical connector 22 against the underlying substrate 24. Referring now to FIGS. 5-6, the attachment cover 114 can further define the compression member 88 that applies the compression force that biases the electrical connector 22 against the underlying substrate 24. Thus, the locking member can further define the compression member 88. Further, it should be appreciated that the attachment mechanism 86 can include the pivot member 96 illustrated in FIGS. 10A-14 or can be devoid of the pivot member 96 as illustrated in FIGS. 15-16.

Figure 16:
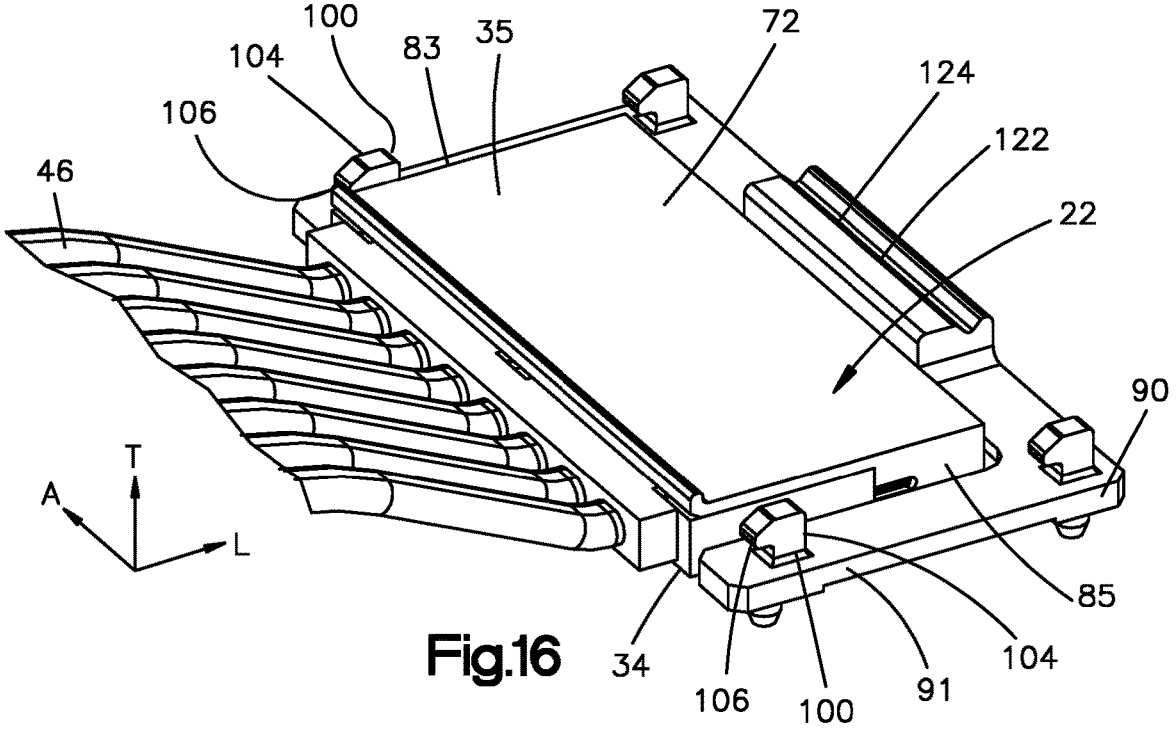
FIG. 16 is a perspective view of the portion of the electrical connector assembly illustrated in FIG. 15, shown with an attachment cover of the attachment mechanism removed.
Figure 17:
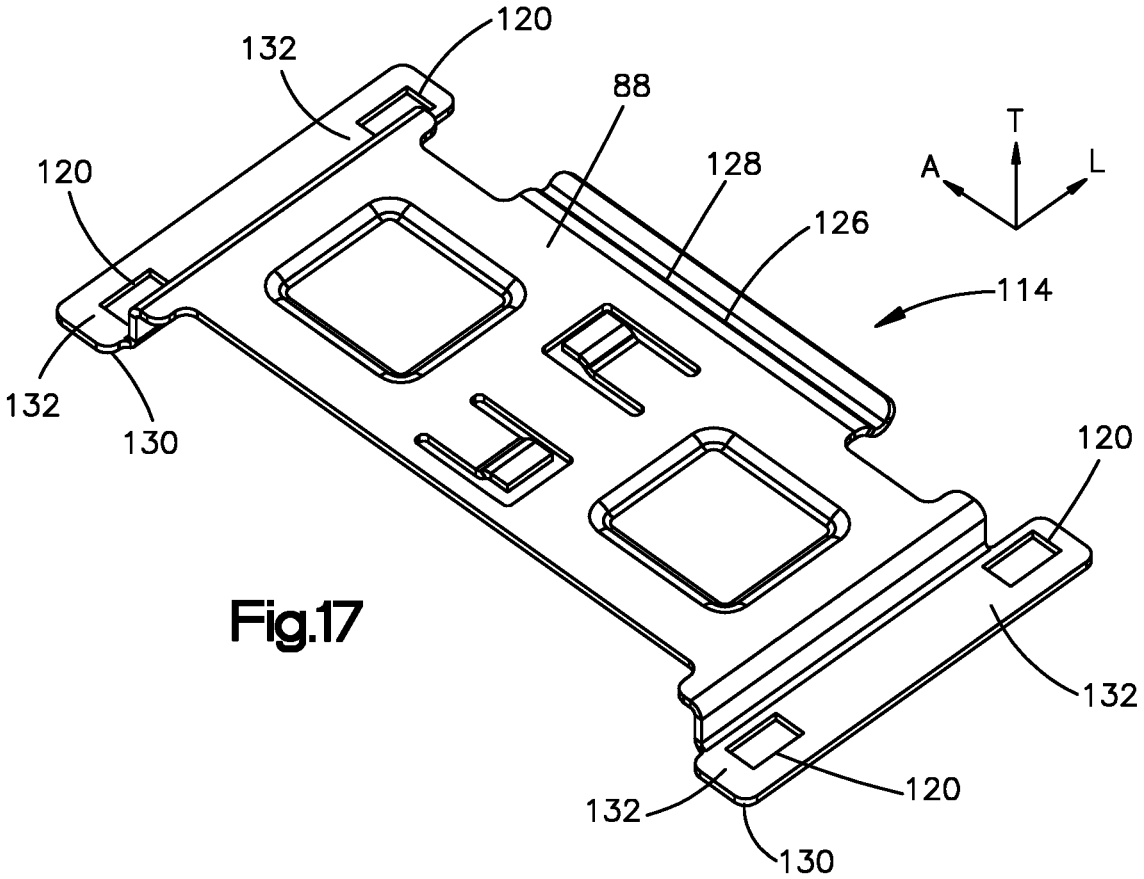
FIG. 17 is a perspective view of an attachment cover of the attachment mechanism illustrated in FIG. 15.

As illustrated in FIG. 16, the support member 90 can define a locating member 122 that is configured to engage the attachment cover 114 so as to positionally locate the attachment cover 114 with respect to the electrical connector 22 along the longitudinal direction L. For instance, the attachment cover 114 can define a complementary locating member 126 that is configured to mate with the locating member 122 of the support member 90. In one example, the locating member 122 of the support member 90 can be configured as a locating groove 124. The locating groove 124 can face the upward direction. The complementary locating member 126 of the attachment cover 114 can be configured as a locating projection 128 that is configured to be received in the locating groove 124. It should be appreciated, of course, that the locating member 122 of the support member 90 can alternatively be configured as a locating projection, and the complementary locating member 126 of the attachment cover 114 can be configured as a locating groove that receives the locating projection of the support member 90.

The attachment cover 114 attach to the support member 90 in any manner as desired. For instance, as described above, the support member 90 can include at least one attachment member 100. The at least one attachment member 100 can be configured to attach to a complementary attachment member 130 of the attachment cover 114. For instance, the at least one attachment member 130 of the attachment cover 114 can be configured to receive the at least one attachment member 100 of the support member 90. The at least one attachment member 100 of the support member 90 can be configured as a latch arm 104 that extends out from the support body 91. For instance, the latch arm 104 can extend in the upward direction from the support body 91 away from the substrate 24 when the support member 90 is mounted to the substrate 24. In particular, the at least one attachment member 100 of the support member 90 can include at least one pair of latch arms 104. The latch arms 104 of the pair can be spaced from each other along the lateral direction A. Further, the at least one pair of latch arms 104 can include first and second pairs that are spaced from each other along the longitudinal direction L.

Each latch arm 104 can define a barbed surface 106 that is configured to catch on a corresponding catch surface 132 of the attachment cover 114 so as to attach the attachment cover 114 to the support member 90. Thus, the at least one attachment member 130 of the attachment cover can be configured as a catch surface 132 that is configured to interfere with the barbed latch surface 106 of the support member 90. For instance, the at least one attachment member 130 of the attachment cover 114 can include at least a pair of catch surfaces 108 spaced from each other along the lateral direction A. The at least a pair of catch surfaces 108 can include first and second pairs of catch surfaces that are spaced from each other along the longitudinal direction L. During operation, the latch arms 104 can be inserted into the respective attachment openings 120 of the attachment cover 114 until the barbed latch surfaces 106 of the support member 90 catch onto the respective catch surfaces 132 of the attachment cover 114. The attachment openings 120 of the attachment cover 114 can extend upward along the transverse direction T. When the barbed latch surfaces 106 engage the respective catch surfaces 132, relative movement of the attachment cover 114 with respect to the support member 90 in the upward direction is at least limited, such as prevented. It should be appreciated in alternative embodiments that the attachment cover 114 can include the at least one latch arm 104 having the barbed latch surface 106, and the support member 90 can include the complementary at least one catch surface.

As described above, the attachment cover 114 can be attached to the support member 90 that, in turn, can be mounted to the substrate 24. It should be appreciated, of course, that the attachment cover 114 can be secured to the substrate 24 directly or indirectly in any manner desired. In one example, the attachment cover 114 can be secured to the substrate 24 independent of the electrical connector 22 as described above. The attachment cover 114 can further be configured to apply the compression force to the electrical connector 22 that biases the electrical connector 22 against the underlying substrate 24. In particular, the attachment cover 114 can include at least one spring arm 115 that bears against the electrical connector 22 when the electrical connector is mounted to the substrate 24, and the attachment cover 114 is secured to the substrate 24. The spring arm 115 can bear against the connector cover 114, and can be compressed when the attachment cover 114 is attached to the support member 90, and thus secured to the substrate 24. The spring arm 115 can be elastic and resilient, such that compression of the spring arm 115 causes the spring arm to exert the compression force to the electrical connector 22 that urges the electrical connector 22 and the connector cover 114 *t* to separate from each other. However, because the connector cover 114 is secured to the substrate 24 and thus unable to move away from the connector 22 in the upward direction, the compression force urges the electrical connector 22 to move against the underlying substrate 24 in the downward direction that is opposite the upward direction. The spring arm 115 can bear against the connector cover 35, the connector housing 34, or any alternative structure of the electrical connector 22. Alternatively, the spring arm 115 can bear against the electrical connector 22 by contacting an intermediate structure that, in turn, contacts the electrical connector 22. The attachment cover 114 can include a plurality of spring arms 115 as desired. The spring arms can, for instance, be spaced from each other along the lateral direction A.

Referring to FIGS. 19-22, 23-29, and 30-35, alternative embodiments of the electrical connector assembly 20 are shown. Each electrical connector assembly 20 can include the electrical connector 22 and the substrate 24 as described above. As described above, the electrical connector 22 can be configured to be compression mounted to the substrate 24. In particular, mating ends of electrical contacts 28 of the electrical connector 22 are configured to flex so as to become compressed against respective contact pads 30 that are disposed on a surface 32 of the substrate 24 when the electrical connector 22 is mounted to the substrate 24. Thus, the electrical contacts 28 do not extend into the substrate 24 in one example. Because the electrical contacts 28 can define a separable interface with the substrate 24, the electrical connector 22 can be repeatedly unmated from the underlying substrate 24 and mated to the underlying substrate 24 as desired.

The substrate 24 can include a plurality of electrically conductive surface mount technology (SMT) contact pads 30 disposed on at least one side of the substrate. The at least one side can include a first surface 32 that is planar along a first or longitudinal direction L and a second or lateral direction A that is perpendicular to the longitudinal direction L. Each of the contact pads 30 can be disposed at the first surface 32. Each of the contact pads 30 can include a first end, and a second end that is spaced from the first end along the longitudinal direction. Each of the contact pads can include a first side and a second side spaced from the first side along the lateral direction. The first and second sides can extend between the first and second ends. Further, each contact pad 30 can be elongate from its first end to its second end.

The plurality of contact pads 30 may be configured in a linear array although other pad configurations may be used. For instance, the plurality of contact pads can be spaced from one another along the lateral direction, which can be referred to as a row direction. Further, the contact pads 30 can be in-line with one another along the lateral direction A. For instance, all of the contact pads can be intersected by a single straight line is oriented along the lateral direction A. In one example (see, e.g., FIG. 19), the first ends of the contact pads 30 can be substantially in-line with one another along the lateral direction A, and the second ends of the contact pads 30 can be substantially in-line with one another along the lateral direction A. In another example (see, e.g., FIG. 30), one of the ends of the contact pads 30 can be in-line with the ends of some of the contact pads 30 along the lateral direction, and staggered with respect to the ends of others of the contact pads 30 along the lateral direction A. Thus, the plurality of contact pads 30 can include first and second subsets of contact pads 30. The first subset of the contact pads 30 can have first ends that are substantially in-line with one another along the lateral direction A, and second ends that are substantially in-line with one another along the lateral direction A. Further, the second subset of the contact pads 30 can have first ends that are substantially in-line with one another along the lateral direction A, and second ends that are substantially in-line with one another along the lateral direction A. However, the first ends of the second subset of the contact pads 30 can be in-line with the contact pads of the first subset at a location between the first and second ends of the contact pads 30 of the first subset along the lateral direction. Thus, the first ends of the contact pads 30 of the second subset are not in-line with the first ends of the contact pads 30 of the first subset. Similarly, the second ends of the contact pads 30 of the second subset are not in-line with the second ends of the contact pads 30 of the first subset.

As described above, the electrical connector 22 can include an electrically insulative connector housing 34, and at least one electrical contact 28 such as a plurality of electrical contacts 28 supported by the connector housing. Each connector housing 34 can include an electrically insulative housing body 37. The housing body 37, and thus the connector housing 34, can define the lower housing end 36 and the upper housing end 38 that are spaced from one another along a third or transverse direction T that is perpendicular to both the longitudinal L and lateral A directions. The lower housing end 36 can be configured to face the first surface 32 of the substrate 24 when the electrical connector 22 is mounted to the substrate 24. The housing body 37, and thus the connector housing 34, can further include a front housing end 40 and a rear housing end 42 that are spaced from one another along the longitudinal direction L. The front housing end 40 is spaced from the rear housing end 42 in a forward direction. Similarly, the rear housing end 42 is spaced from the front housing 40 end in a rearward direction opposite the forward direction. Each of the rearward direction and the forward direction can be oriented along the longitudinal direction L. The electrical contacts 28 can extend out from the front end 40.

Figure 24C:
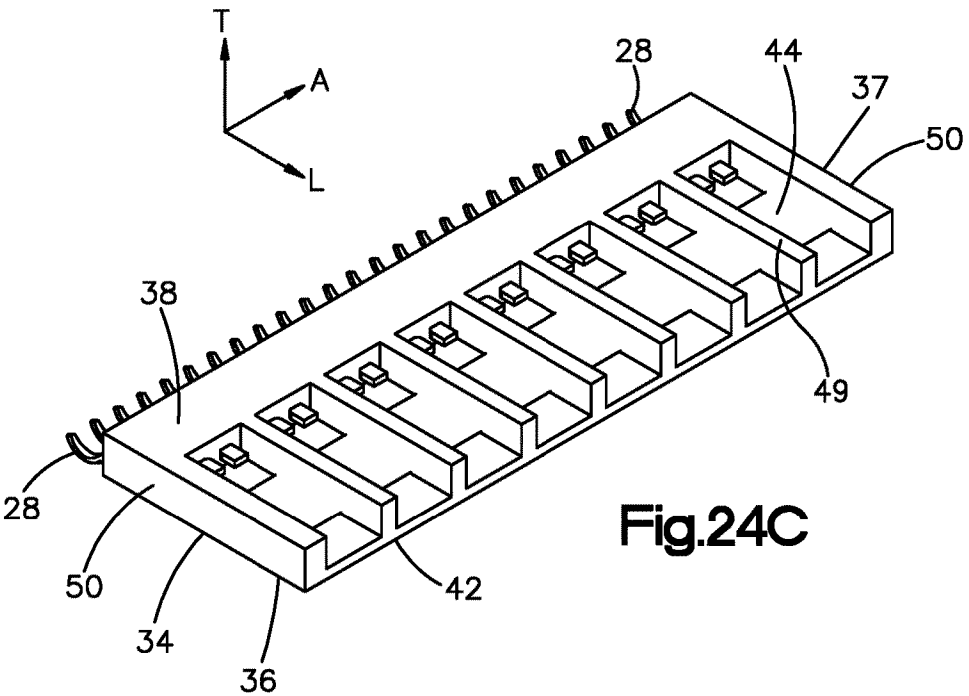
FIG. 24C is a perspective view of the connector housing assembly of FIG. 23.
Figure 30:
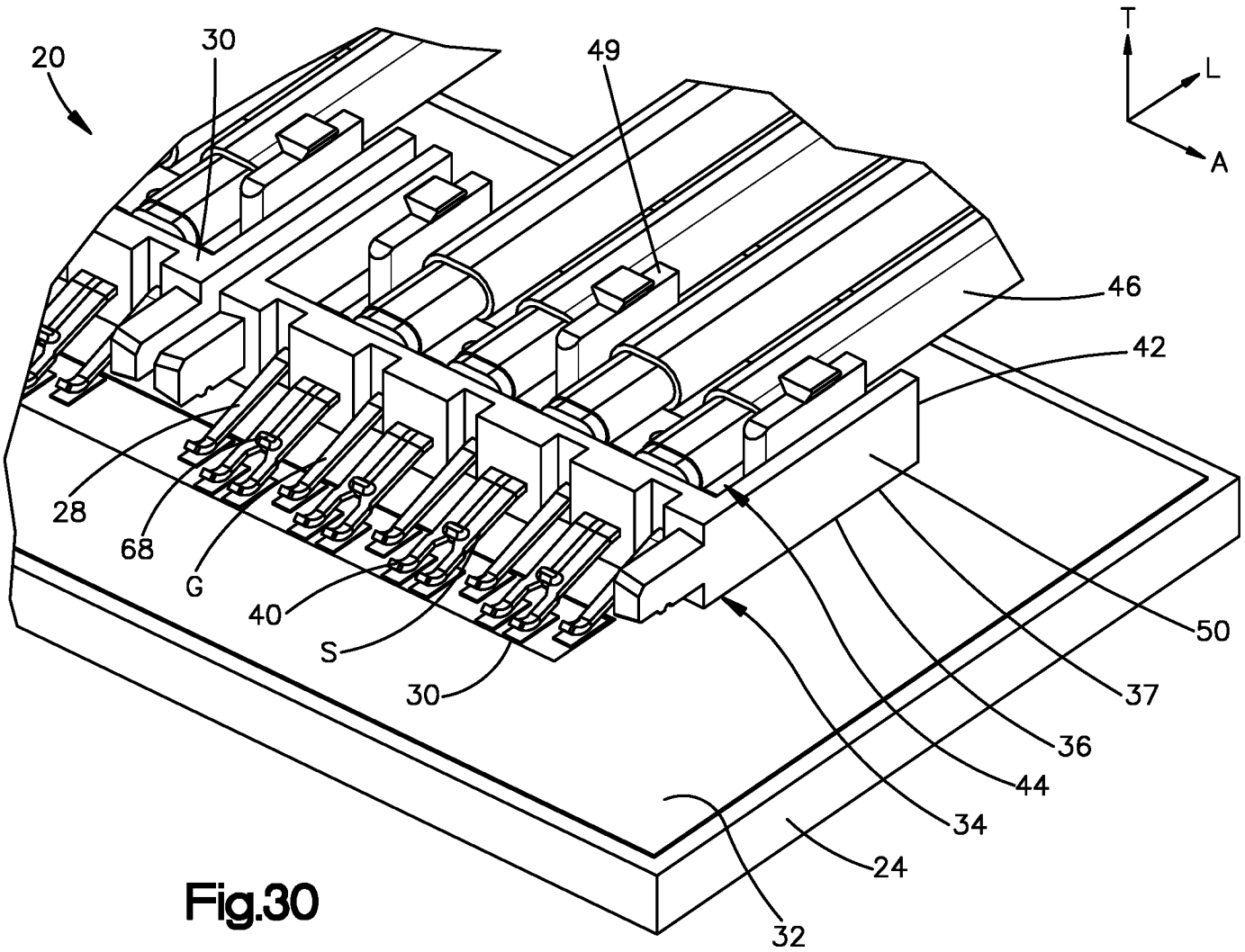
FIG. 30 is a top perspective view of an electrical connector assembly according to another embodiment with a cover of the electrical connector removed.

The front housing end 40 and the rear housing end 42 can extend between the upper and lower ends 36 and 38. For instance, the front housing end 40 and the rear housing end 42 can extend from the upper housing 38 end to the lower housing end 36. The electrical contacts 28 can extend from the front housing end 40 in a direction away from the rear housing end 42. Further, the electrical contacts 28 can be cantilevered from the front housing end 40 in the manner described above. Thus, the electrical contacts 28 can extend beyond the outermost footprint of both the housing body 37 and the connector housing 34 as described above. As illustrated at FIGS. 24C and 30, the connector housing 34 can define a plurality of bays 44 that extend in the housing body 37. For instance, the housing body 37, and thus the connector housing 34, can define a plurality of bays 44 that extend into the rear housing end 40 along the forward direction. Each of the plurality of bays 44 can be configured to receive an electrical cable 46 (see FIG. 30). When the electrical cables 46 are received in the bays 44, the electrical cables 46 can extend out the rear housing end 42 in the rearward direction. In one example (see FIGS. 22 and 32), at least one or more of the bays 44 can be sized to receive more than one of the electrical cables 46, such as a pair of the electrical cables 46. In one embodiment, the drain wire or ground shield of each of the electrical cables 46 can be mounted to a common ground contact of the electrical contacts 28 in each of the bays 24. The housing body 37, and thus the connector housing 34, can further include respective divider walls 49 that separate adjacent ones of the bays 44.

Figure 20A:
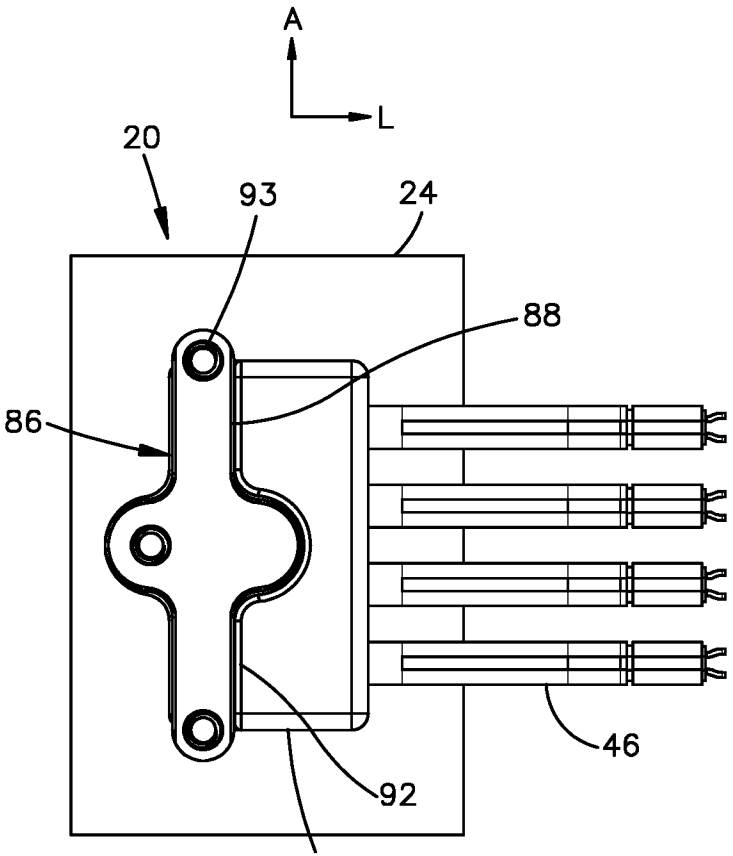
FIG. 20A is a top plan view of the electrical connector assembly illustrated in FIG. 19, in accordance with one embodiment.
Figure 20C:
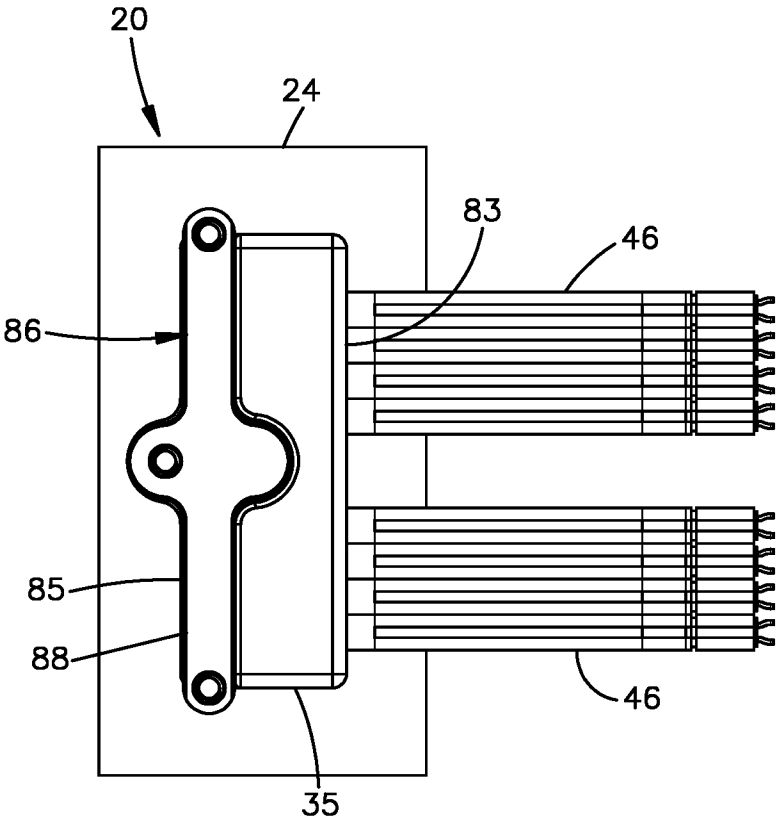
FIG. 20C is a top plan view of the electrical connector assembly illustrated in FIG. 19, in accordance with another embodiment.
Figure 20B:
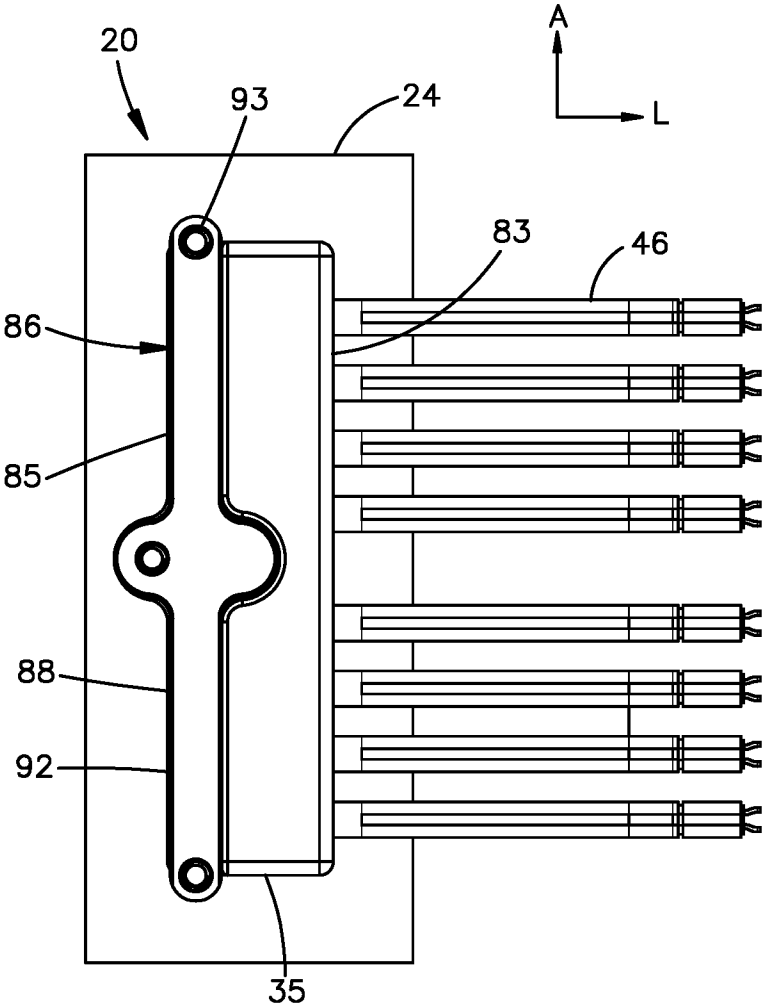
FIG. 20B is a top plan view of the electrical connector assembly illustrated in FIG. 19, in accordance with another embodiment.
Figure 21:
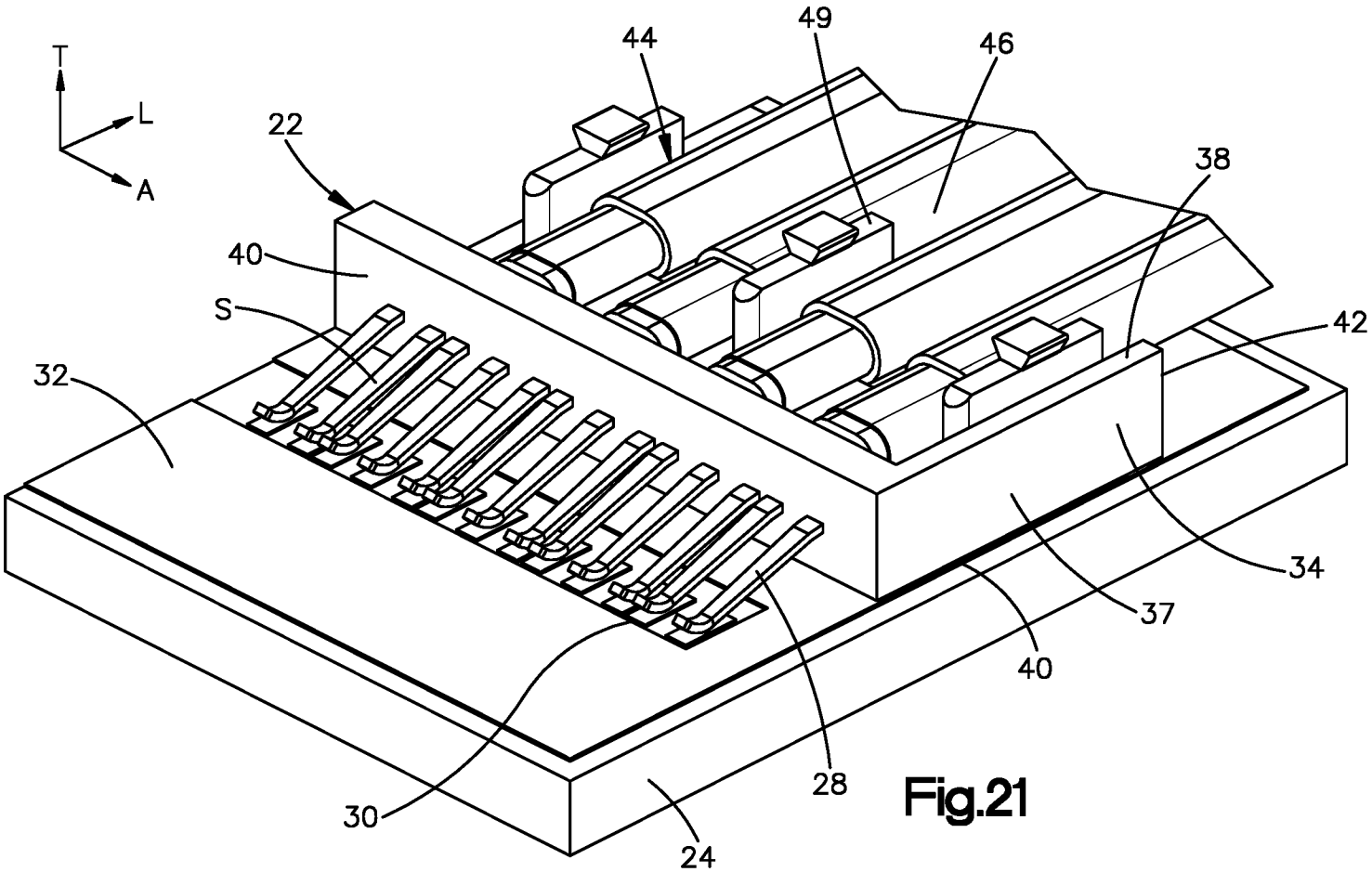
FIG. 21 is a perspective view of the electrical connector assembly illustrated in FIG. 19, showing the electrical connector mounted to the substrate.
Figure 22:
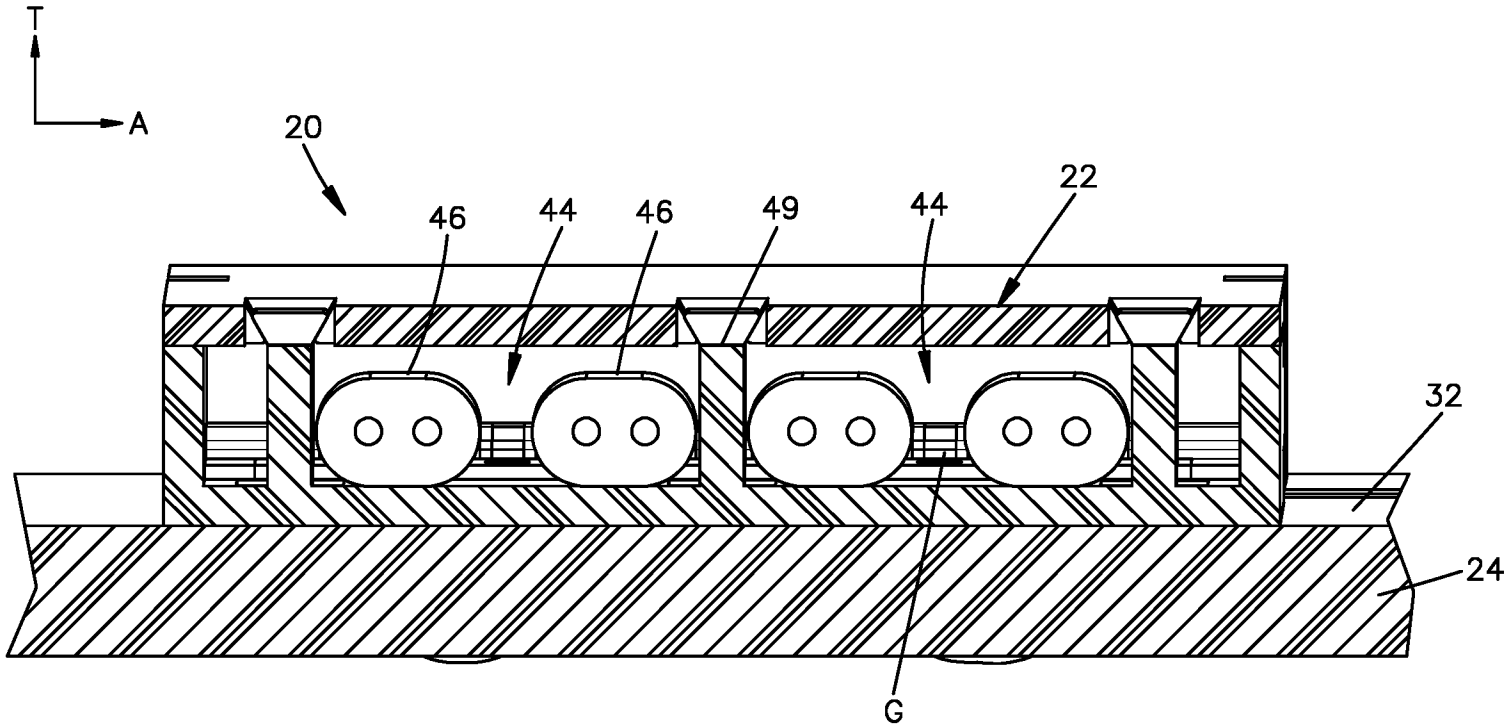
FIG. 22 is a showing of the cables of the electrical connector in cross-section in accordance with one embodiment.

FIG. 20A-20C illustrate some representative connector configurations. In FIG. 20A the connector 22 can terminate the electrical cables 46 to the substrate 24. While four electrical cables are shown, it is appreciated that any number of cables can be used. The cables may be shielded twin axial cables or can be configured in accordance with any suitable alternative embodiment. As illustrated in FIG. 20B the electrical connector 22 can include two sets of electrical cables 46, each cable set forming a cable assembly having the plurality of electrical cables. Again, while each set of cables can include four cables, the sets of cables can include any number of cables as desired. The electrical connector 22 can include respective connector housing assemblies, such that electrical conductors or drain wires of the electrical cables 46 are mounted to mounting ends of respective ones of the electrical contacts 28 of each of the connector housing assemblies. A cable assembly can thus include cables that are mounted to the electrical contacts of the connector housing assemblies. It should be appreciated that the cable assemblies allow for the assembly of electrical connectors with various numbers of cables using the connector housing assemblies and respective cables as building blocks of the electrical connector. As illustrated in FIG. 20C, the cables can be more closely spaced together than in FIG. 20B. Thus, it is appreciated that the cables can be spaced apart any suitable distance as desired. More closely spaced cables 46 allows for higher electrical contact densities for the electrical connector 22. In one example, the electrical connector only includes the connector housing, the electrical contacts, and the cables. The electrical connector 22 can further include cross-talk shields as desired.

Figure 29:
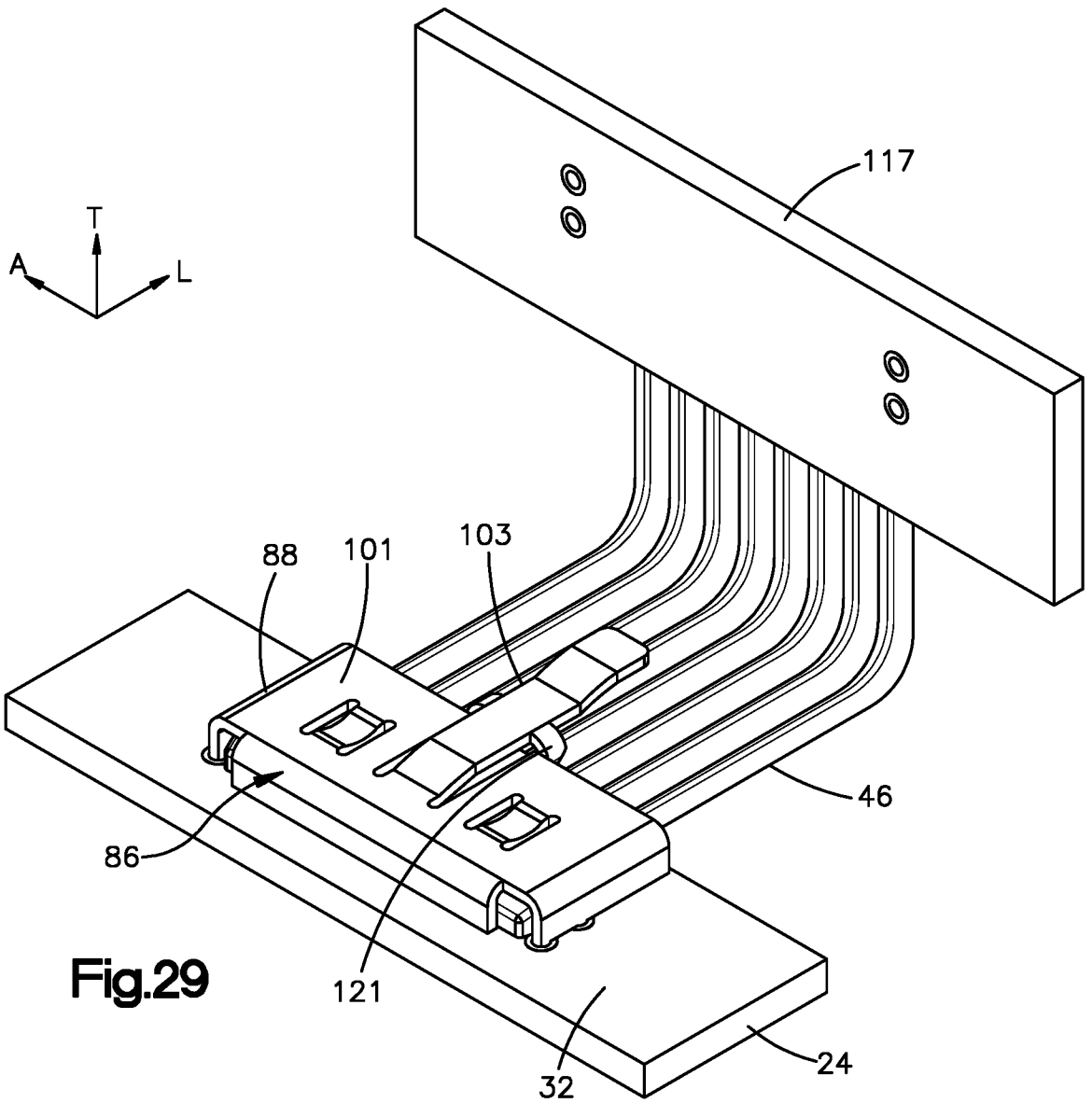
FIG. 29 is a right-angle application of the electrical connector of FIG. 23 in which two perpendicular substrates are connected to one another.

As illustrated at FIG. 29, the electrical cables 46 can be configured to establish electrical communication between the substrate 24 and a complementary electrical component. The complementary electrical component can be configured as a second substrate 117, with the substrate 24 being referred to as a first substrate. Thus, the electrical cables 46 can place the electrical connector assembly 20 in electrical communication with the complementary electrical component.

Referring again to the respective embodiments illustrated in FIGS. 19-22, 23-29, and 30-35, the connector housing 34 can further define first and second housing sides 50 that are spaced from each other along the lateral direction A. Each of the first and second housing sides 50 can extend between the upper housing end 38 and the lower housing end 36. For instance, each of the first and second housing sides 50 can extend from the upper housing end 38 to the lower housing end 38. Further, each of the first and second housing sides 50 can extend between the front housing end 40 and the rear housing end 42. For instance, each of the first and second housing sides 50 can extend from the front housing end 40 to the rear housing end 42. It should thus be appreciated that the front and rear housing ends 40 and 42 and the first and second housing sides 50 can define an outermost footprint of the housing body 37 along a plane that is defined by the longitudinal direction L and the lateral direction A. In certain embodiments (e.g., see FIG. 19), the front and rear housing ends 40 and 42 and the first and second housing sides 50 can also define an outermost footprint of the connector housing 34 along a plane that is defined by the longitudinal direction L and the lateral direction A. The electrical contacts 28 can be cantilevered from the housing body 37 so as to extend beyond the outermost footprint of the housing body 37. Further, the electrical contacts 28 can further be cantilevered from the housing body 37 so as to extend beyond the outermost footprint of the connector housing 34.

The electrical contacts 28 of each of the electrical connectors 22 described herein can include signal contacts S and ground contacts G. The signal contacts S can be mounted to electrical signal conductors of the electrical cables 46. The ground contacts G can be mounted to grounds such as ground shields or drain wires of the electrical cables 46. The signal contacts can be arranged such that adjacent ones of the signal contacts S define differential signal pairs. The ground contacts G can be disposed between adjacent ones of the differential signal pairs. Alternatively, the signal contacts S can be single ended.

For instance (referring also to FIGS. 33-34), the signal contacts S can each define a respective resilient and flexible mating 54, and the ground contacts G can each define a respective resilient and flexible mating 58. Thus, reference to the mating ends of the electrical contacts 28 can include one or both of the mating ends 54 and 58. The mating ends of the electrical contacts 28 can extend out from the housing body 37, and thus the housing 34. For instance, the mating ends can extend out from the housing body 37, and thus the housing 34, a first distance along a direction that includes at least one of the lateral direction A and the longitudinal direction L, and a second distance along the transverse direction T that is less than the first distance. In one example, the first distance can be at least 3 times greater than the second distance. For instance, the mating ends of the electrical contacts 28 can extend from the front housing end 40 in a direction away from the rear housing end 42. Further, the electrical contacts 28 can extend out from the front end 40 of the connector housing 34. For instance, the electrical contacts 28 can be cantilevered from a surface of the housing body 37, and thus of the housing 34, that does not face the substrate when the electrical connector is mounted to the substrate. In one example, the electrical contacts 28 can be cantilevered from the front housing end 40.

The electrical contacts 28 can extend beyond the outermost footprint of the housing body 37. In particular, the mating ends of the electrical contacts 28 can extend beyond the outermost footprint of the housing body 37. Thus, the mating ends of the electrical contacts 28 can extend forward from the front housing end 40 to a free end that is offset with respect to the housing body 37 in the forward direction. Further, the mating ends can be configured such that no straight line exists that is oriented along the transverse direction T and extends through the mating end twice. It is appreciated that the transverse direction can be oriented substantially (e.g., within manufacturing tolerance, as used herein) perpendicular to the surface of the substrate to which the electrical connector is configured to be mounted.

The electrical contacts 28 can further define respective mounting ends opposite the mating ends. For instance, the signal contacts S can each define a mounting end 56 opposite the mating end 54. The mounting ends 56 of the signal contacts S can be configured to be attached to an electrical conductor of an electrical cable 46. The mating ends 54 of the signal contacts S can be monolithic with the mounting ends 56. Similarly, the ground contacts G can each define a mounting end 60 opposite the mating end 58. The mounting ends 60 of the ground contacts G can be configured to be attached to a ground, such as an electrical ground shield 48, of a respective one of the electrical cables 46. The mating ends 58 of the ground contacts G can be monolithic with the mounting ends 60.

The electrical contact assembly 52 can further include an electrically conductive ground plate 62 that supports the grounds G. For instance, the mounting ends 60 of the ground contacts G can be electrically commoned together by the ground plate 62. Further, the ground contacts G can be monolithic with ground plate 62. For example, the ground contacts G and the ground plate 62 can be stamped or otherwise formed form a single sheet of electrically conductive material.

Figure 33:
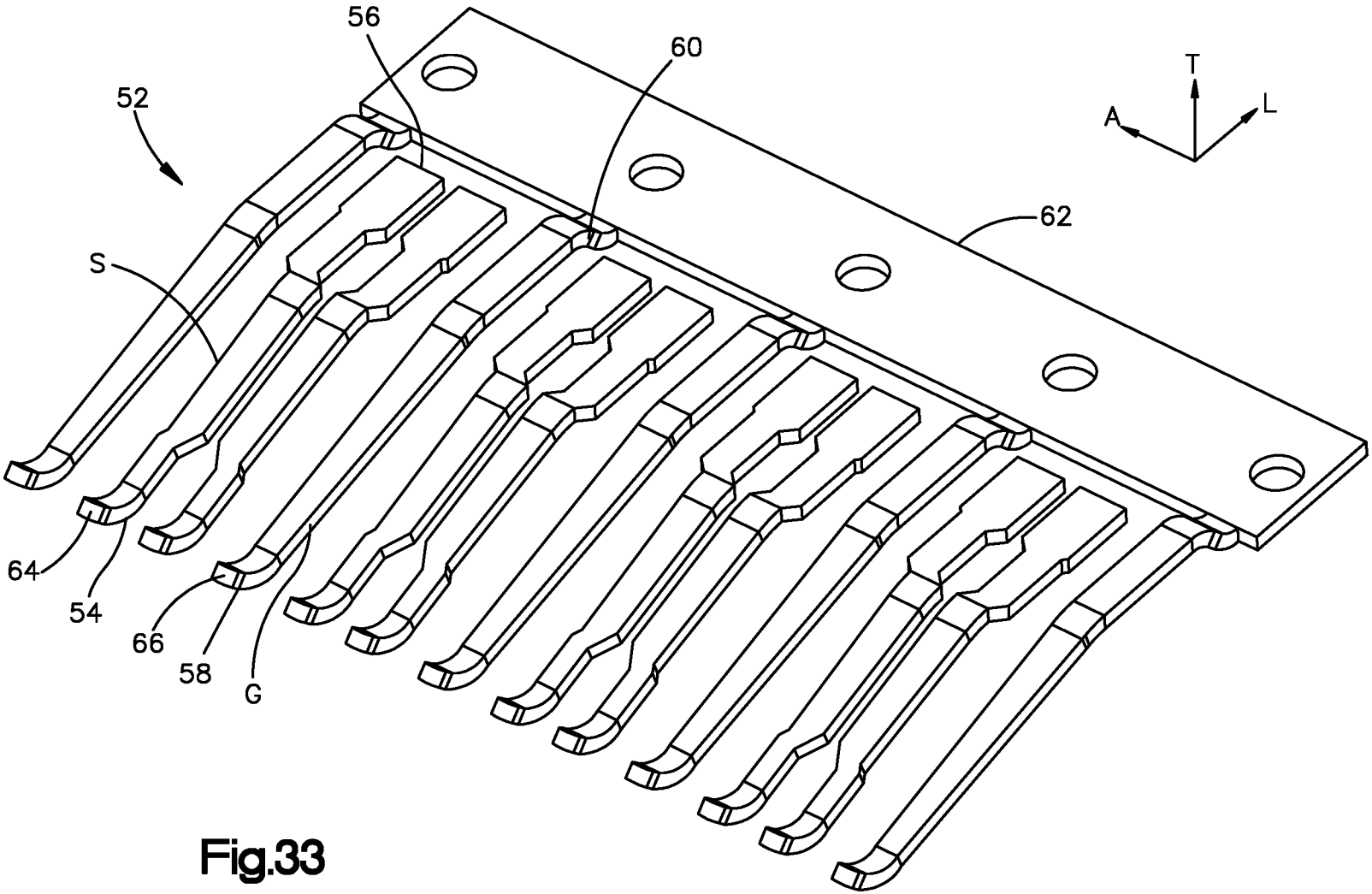
FIG. 33 is a perspective view of an electrical contact assembly according to one embodiment that can be implemented in any one of the electrical connectors described herein.
Figure 34:
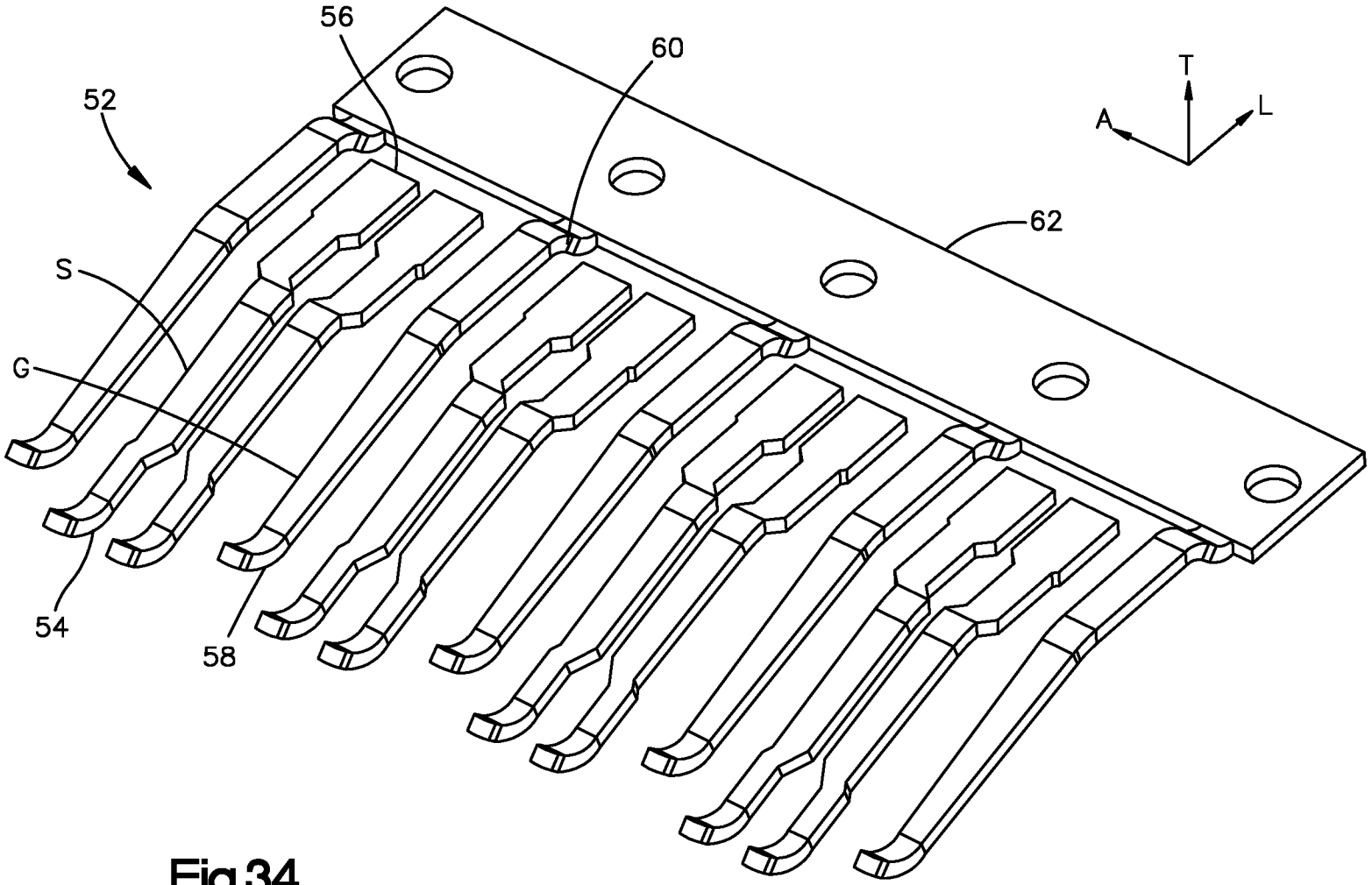
FIG. 34 is a perspective view of an electrical contact assembly according to another embodiment that can be implemented in any one of the electrical connectors described herein.

The mating end of the electrical contacts can define distal tips. For instance, the signal contacts S can define distal tips 64 that can be substantially in-line with one another along the lateral direction A. Further, ground contacts G can define respective distal tips 66 that are substantially in-line with one another along the lateral direction A. In one example, as shown in FIG. 33, the distal tips 66 of the ground contacts G can be substantially in-line with the distal tips of the signal contacts S along the lateral direction as shown in FIG. 33. In another example shown in FIG. 34, the distal tips 66 of the ground contacts G can be offset or staggered from the distal tips 64 of the signal contacts S relative to the lateral direction A. For instance, the distal tips 66 of the ground contacts G can be in-line with the signal contacts S at a location between the distal tips 64 of the signal contacts S and the mounting ends 56 of the signal contacts S with respect to the longitudinal direction L. Thus, the distal tips 66 of the ground contacts G are not in-line with the distal tips 64 of the signal contacts S along the lateral direction A in this example.

The electrical contacts 28 can each include a contact body that defines first and second edges, and first and second broadsides. The first and second edges are spaced opposite from one another along the lateral direction A. Thus, the first and second edges can face away from one another. At least respective portions of the first and second broadsides can be spaced opposite each other along the transverse direction T. Thus, the first and second broadsides can face away from one another. Each of the first and second edges are connected between the first and second broadsides. Similarly, each of the first and second broadsides are connected between the first and second edges.

The edges and broadsides can define respective distances along a plane that is oriented normal to the contact body. For instance, the edges can each extend along a first distance from one of the first and second broadsides to the other of the first and second broadsides along the plane. The broadsides can each extend along a second distance from one of the first and second edges to the other of the first and second edges along the plane. The second distance can be greater than the first distance.

The electrical contacts 28 can be arranged edge-to-edge along the lateral direction A. Thus, the edges of adjacent ones of the electrical contacts 28 can face each other along the lateral direction A. In one example shown in FIGS. 30-32, the connector housing 34, and thus, the electrical connector 22, and thus the electrical connector assembly 20, can include a dielectric spacer 68 that extends out from the housing body 37. In particular, the dielectric spacer 68 can extend forward from the housing body 37 to a location between mating ends of the signal contacts of each differential signal pair. Each dielectric spacer 68 can extend from the inner edge of one of the signal contacts of a differential signal pair to the inner edge of the other signal contact of the differential signal pair at the mating ends, wherein the inner edges face each other along the lateral direction A. The dielectric spacers 68 can be monolithic with the housing body 37. Alternatively, the dielectric spacers 68 can be formed separately from the housing body 37 and then inserted between the adjacent signal contacts S. Without being bound by theory, it is believed that the dielectric spacers improve performance of the electrical connector assembly 22.

As shown herein, the mating ends of the electrical contacts 28 can extend from an end or wall of the housing body 37, and thus of the connector housing 34, that does not face the substrate 24. For instance, the mating ends of the electrical contacts 28 can extend from the front end 40 of the connector housing 34. Thus, the electrical connector 22 can be configured to establish an electrical connection between the electrical cables 46 and the underlying substrate 24. The electrical connector 22 is configured to be mounted to the substrate 24 having the substrate surface 32 that carries at least one electrical contact pad 30 such as a plurality of electrical contact pads 30. The resilient and flexible mating ends of the electrical contacts 28 can be configured to flex along the transverse direction T when placed in surface contact with respective ones of the contact pads 30, thereby applying a pressure, or normal force, against the contact pads 30. Thus, it is appreciated that the electrical contacts 28 can be bent such that, when they are pressed against the contact pads 30, they are elastically deformed from a normal or relaxed position, and exert pressure against the contact pads 30. At least a portion of the mating ends of the electrical contacts 28 can extend below the housing body 37, and thus below the connector housing 34, when in the relaxed position. For example, a bottom-most surface of each of the mating ends can extend below the housing body 37 when in the relaxed position. When the electrical connector 22 is mounted to the substrate 24, the mating ends can be disposed in a flexed position that is spaced above the relaxed position. For instance, the bottom-most surfaces of the mating ends can be substantially planar with bottom surface of the connector housing when the electrical connector is mounted to the substrate. The bottom surface can be defined by the lower end 36, and can abut the surface 32 of the substrate 24 that carries the electrically conductive contact pads 30 when the electrical connector 22 is mounted to the substrate 24.

Both the electrical contacts 28 and the contact pads 30 may be plated or otherwise coated with an electrically conductive material. The electrically conductive material can, for instance, be gold so as to provide a low loss electrical connection when the parts are in physical contact. Each contact may be soldered to an electrical conductor or ground of a cable on the end opposing the contact's connection with the substrate, as described in U.S. patent application Ser. No. 14/551,590. The cable may be a coaxial cable, a twinax cable, a single conductor cable, or any alternative type of cable. Thus, the cable can include at least one electrical conductor and an insulative layer that surrounds at least a portion of the length of each at least one electrical conductor. The cable can further include a ground, such as a drain wire. In some embodiments some of the contacts may be electrically connected to a ground shield on the cable that is, in turn, in electrical communication with the drain wire.

The contacts can be overmolded by housing body 37, and thus by the connector housing 34. The overmolding may be formed by an injection molding process as described in U.S. provisional patent application Ser. No. 14/551,590. Many types of plastic resins may be used in the overmold depending on the application. In some applications acrylonitrile butadiene styrene (ABS) resins may be used. These resins can be overmolded at lower temperature and pressure than some other resins and allow for tight mechanical tolerances on the contact array. Liquid crystal polymer (LCP) can be overmolded at a higher temperature and pressure than ABS resins. Though it can therefore be more difficult to maintain tight mechanical tolerances on the contacts with LCP resins, the resulting connector may be rated at a higher operating temperature.

Alternatively, the electrical contacts 28 can be stitched into the housing body 37, and thus into the connector housing 34. Thus, the housing body 37 and connector housing 34 are configured to provide mechanical support and electrical isolation between the electrical contacts 28. One or more housing bodies 37, and thus connector housings 34, can be grouped together in a single electrical connector 22 (see, e.g., FIG. 19). Thus, it can be said that the electrical connector 22 can include at least one connector housing 34 and a respective at least one such as a plurality of electrical contacts 28 supported by each at least one connector housing 34. In one example, the electrical contacts 28 that are attached to the conductors of the electrical cables 46 are not physically separable from the housing without damaging or destroying the contacts 28, the housing 34, or both. Each housing 34 and its respective electrical contacts 28 can be referred to as a connector housing assembly.

Figure 19:
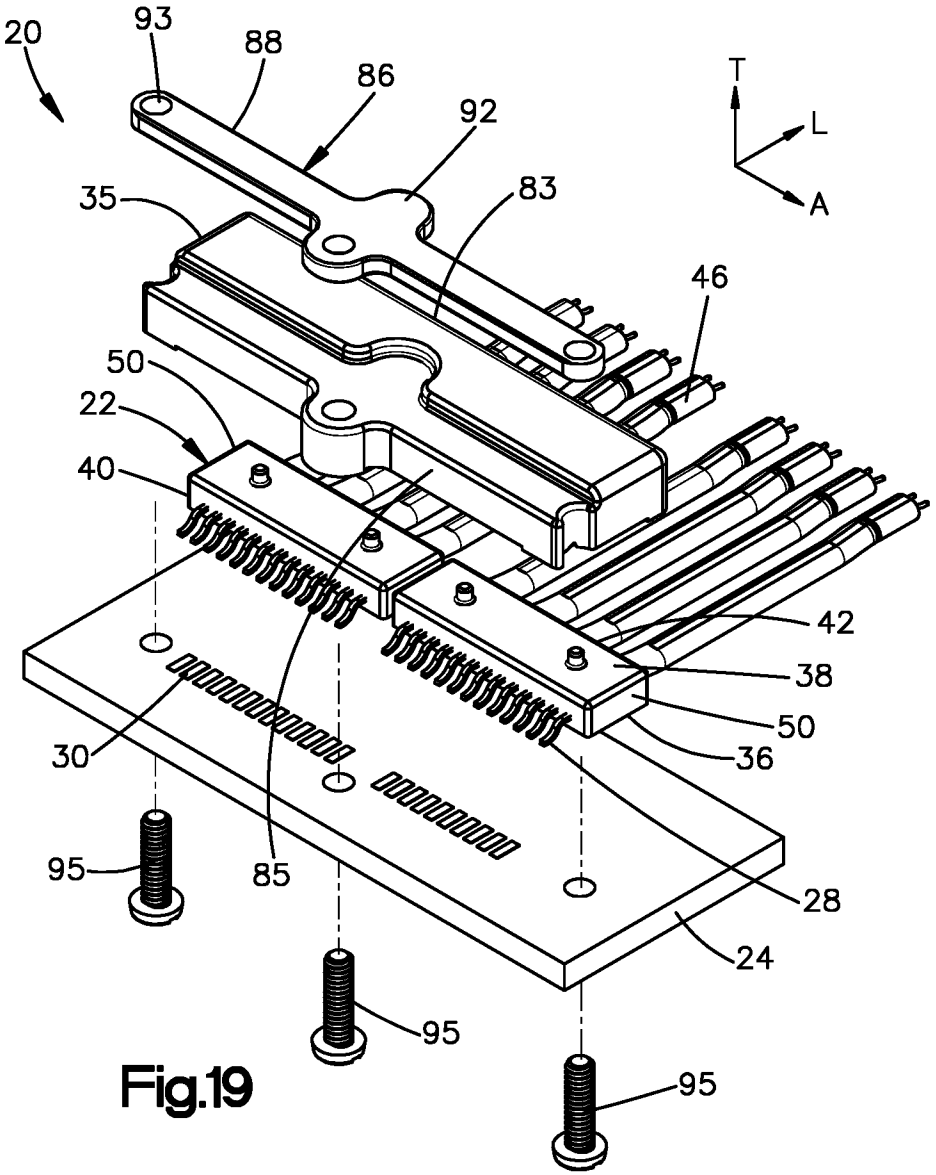
FIG. 19 is an exploded view of an electrical connector assembly constructed in accordance with one embodiment, showing an electrical connector configured to be mounted to an underlying substrate.
Figure 24A:
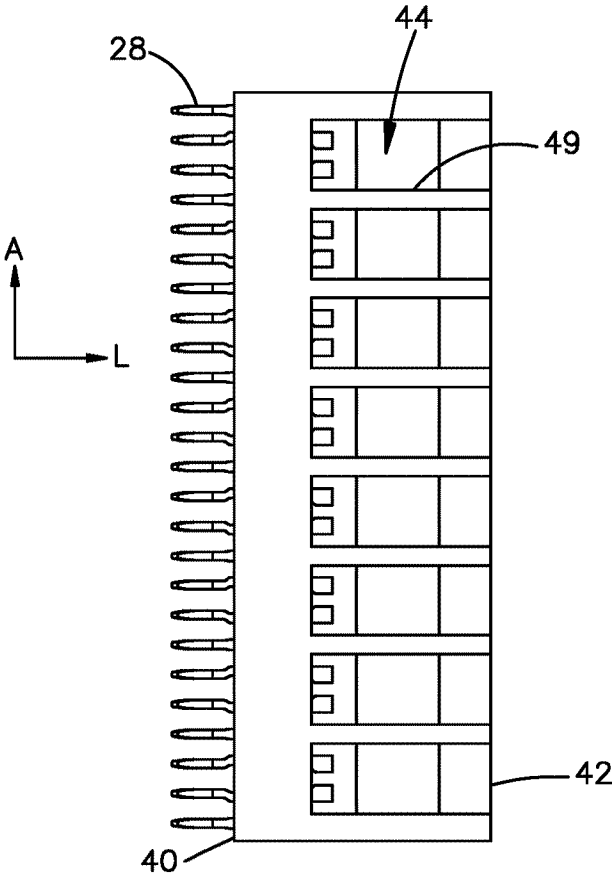
FIG. 24A is a top plan view of the connector housing assembly of FIG. 23.
Figure 24B:
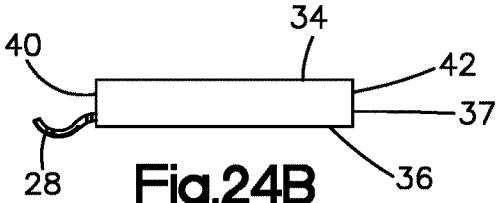
FIG. 24B is a side view of the connector housing assembly of FIG. 23.
Figure 25:
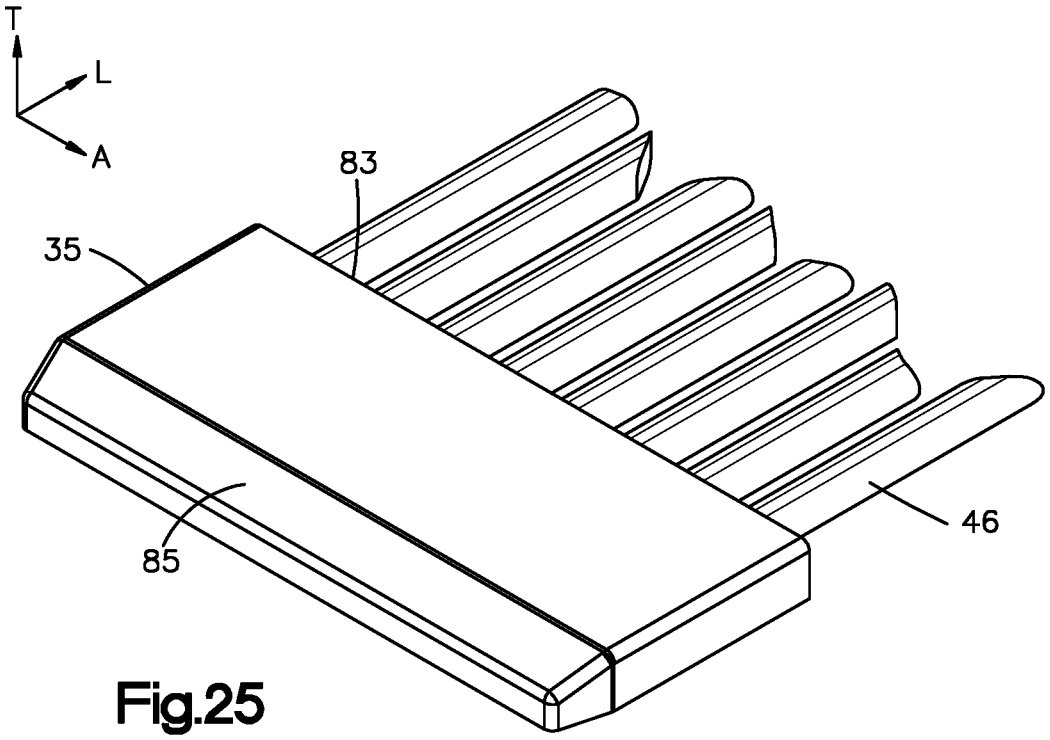
FIG. 25 is a top perspective view of the electrical connector of FIG. 23.
Figure 26:
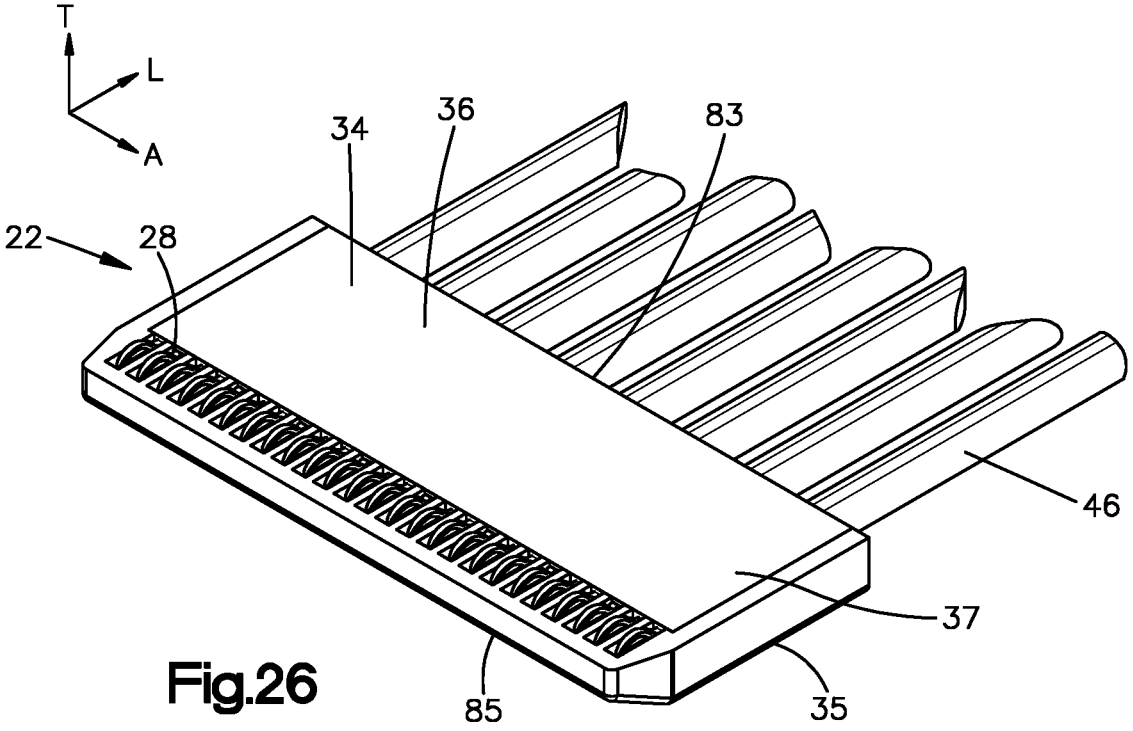
FIG. 26 is a bottom perspective view of the electrical connector of FIG. 23.
Figure 28A:
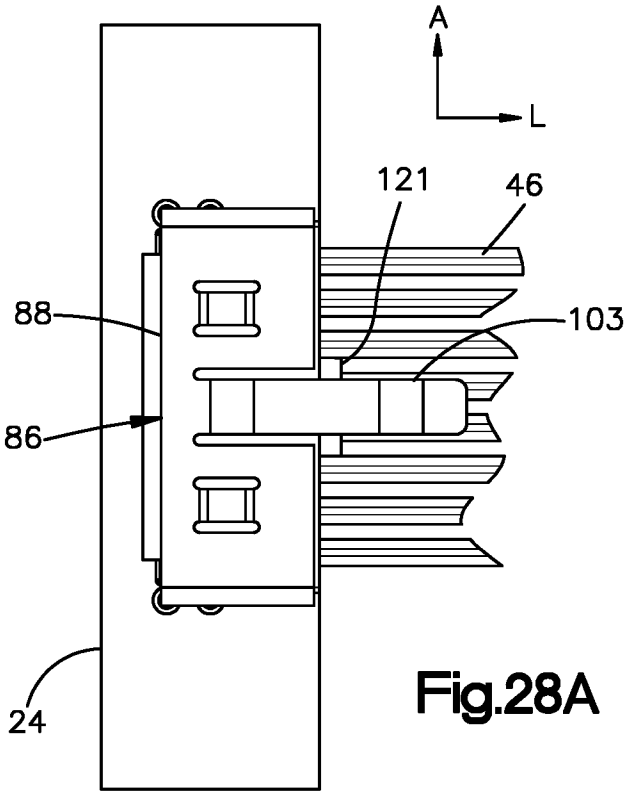
FIG. 28A is a top plan view of the electrical connector of FIG. 23 mated with the underlying substrate.
Figure 28B:
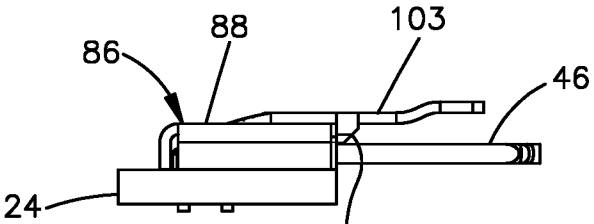
FIG. 28B is a side elevation view of the electrical connector of FIG. 23 mated with the underlying substrate.
Figure 27A:
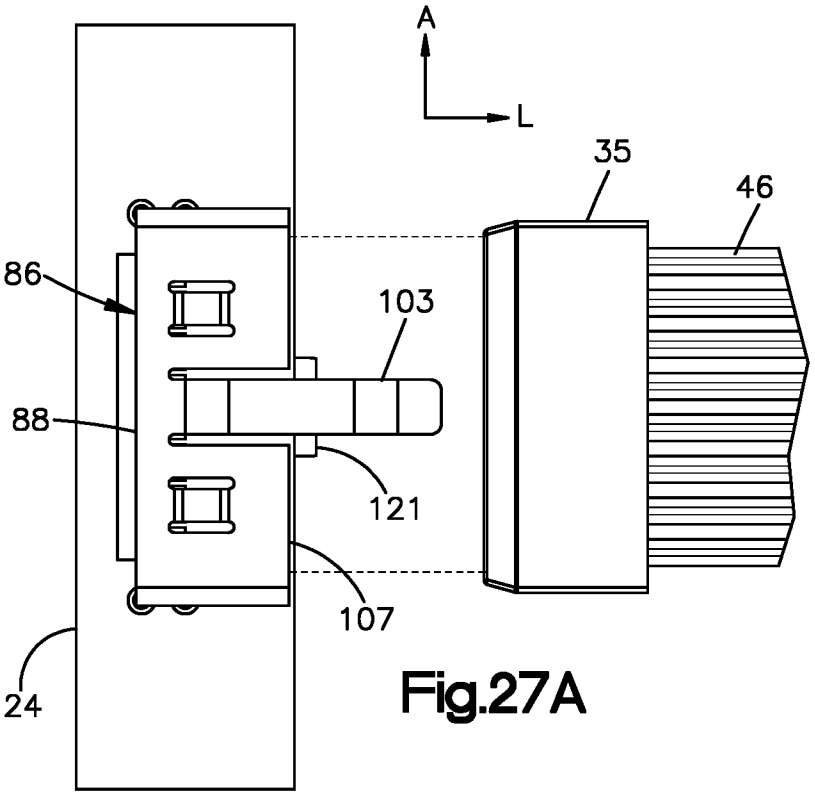
FIG. 27A is a top plan view showing a step of mating the electrical connector of FIG. 23 with the underlying substrate.
Figure 27B:
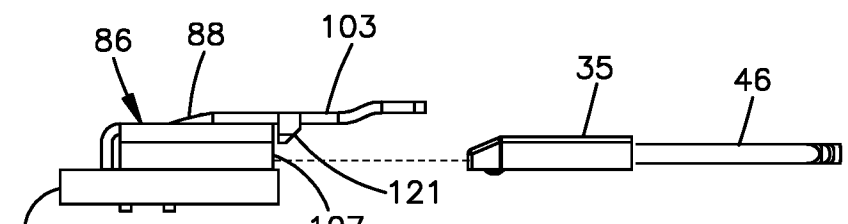
FIG. 27B is a side elevation view showing the step illustrated in FIG. 27A.
Figure 31:
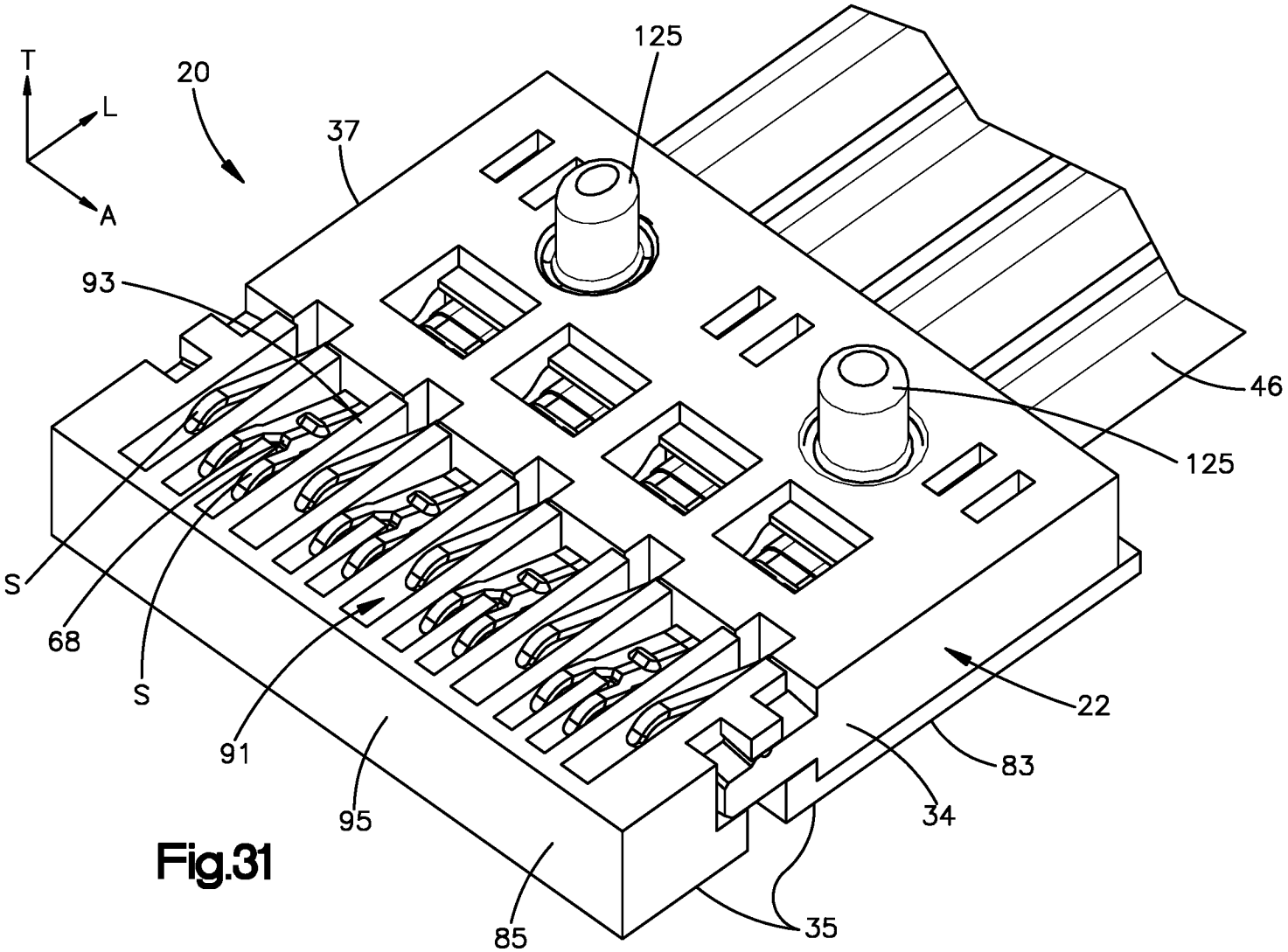
FIG. 31 is a bottom perspective view of the electrical connector of FIG. 30.
Figure 32:
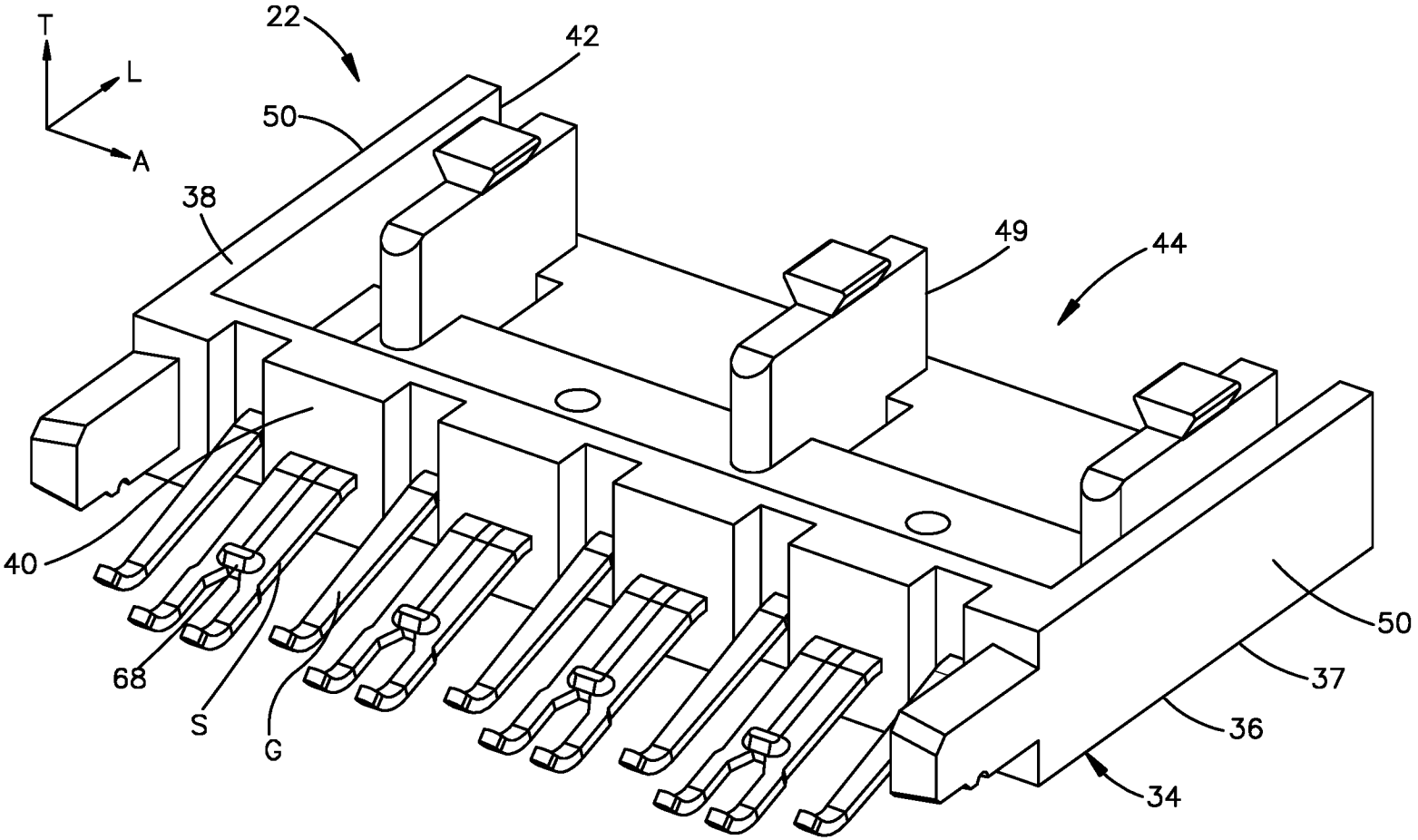
FIG. 32 is a to perspective view of the connector housing assembly of FIG. 30.

Referring to the embodiments illustrated in FIGS. 19-22, 23-29, and 30-35, as represented by FIGS. 19, 25-26, and 31, respectively, the electrical connector 22 can include a connector cover 35 that is configured to secure the housing body 37, and thus the connector housing 34, to the underlying substrate 24, thereby ensuring that the respective electrical contacts 28 are aligned with the respective contact pads 30 to which they are to be mated. For example, the cover 35 can retain two or more connector housing assemblies in place as shown in FIG. 19, or can retain a single connector assembly as shown in FIGS. 26 and 31. The cover 35 can include a housing portion 83 that is configured to cover at least a portion of the housing body 37, and thus the connector housing 34. For example, the housing portion 83 of the cover 35 can extend over and cover the cable bays 44 of the connector housing 34 at the housing portion 83, and thus can extend over a connection between the electrical cables 46 and the electrical contacts 28. The cover 35 can additionally or alternatively include a contact portion 85 configured to cover mating ends of the electrical contacts 28 as they extend from the housing body 37, and thus from the connector housing 34. The contact portion 85 can extend from the housing portion 83 in the forward direction. In some examples (e.g., FIGS. 19 and 26), the contact portion 85 can be monolithic with the housing portion 83. In other examples (e.g., FIG. 31), the contact portion 85 can be separate from the housing portion 83.

The housing portion 83 can include a top wall that is configured to cover at least a portion of the at least one housing body 37, and in particular the connector housing 34. For example, the top wall can cover the bays 44 of the housing body 37. The top wall can include an inner surface that is configured to face the housing body 37, and thus the connector housing 34, and an outer surface that is opposite the inner surface along the transverse direction T and is configured to face away from the housing body 37. In one example, the cover 35 can be configured such that the inner surface of the top wall compresses a ground shield or drain wire of each cable 46 against the ground plate 62.

As shown in FIG. 26, the housing portion 83 can include a bottom surface that is spaced from the top wall in the downward direction towards the substrate 24. For instance, the bottom surface can be configured to face the substrate 24. In some examples, the bottom surface of the cover 35 can be configured to abut the surface 32 of the substrate 24 that carries the electrically conductive contact pads 30 when the cover 35 is attached to the housing body 37, and thus the connector housing 34, and the electrical connector 22 is mounted to the substrate 24. Further, the bottom surface of the cover 35 can define at least one bottom opening in the housing portion 83 that is configured to receive at least a portion of the housing body 37, and thus of the connector housing 34.

With continued reference to FIG. 26, the housing portion 83 of the cover can include a first end and a second end spaced from the first end along the longitudinal direction L. The second end can be spaced forward from the first end. The first end can define at least one end opening configured to receive at least a portion of the connector housing assembly. Further, the electrical cables 46 can extend out of the at least one end opening when the cables 46 are mounted to the electrical contacts 28. The contact portion 85 of the cover 35 can extend forward from the second end of the housing portion 83, and thus in a direction away from the first end of the first portion along the longitudinal direction L.

The housing portion 83 can further include first and second side walls that are spaced from one another along the lateral direction A. The first and second side walls are spaced from one another so as to receive the housing body 37, and thus the connector housing 34, between the first and second side walls of the housing portion 83. The first and second side walls can extend from the top wall along the transverse direction T towards the substrate 24 when the electrical connector 22 is mounted to the substrate 22. Further, the first and second side walls can define the bottom surface of the housing portion 83.

Referring again to FIGS. 19, 25-26, and 31, the contact portion 85 of the cover can include an outer surface that covers the electrical contacts 28, and in particular the mating ends, along the transverse direction T. The contact portion 85 can further include a bottom surface that is spaced from the outer surface along the transverse direction T. As shown in FIGS. 19, 25, and 26, the outer surface of the contact portion 85 can be monolithic with the outer surface of the housing portion 83. Similarly, the bottom surface of the contact portion 85 can be monolithic with the bottom surface of the housing portion 83. Alternatively, as shown in FIG. 31, the outer surface of the contact portion 85 can be separate from the outer surface of the housing portion 83. Similarly, the bottom surface of the contact portion 85 can be separate from the bottom surface of the housing portion 83.

The bottom surface of the contact portion 85 can be configured to face the substrate 24. In some examples, the bottom surface of the contact portion 85 can be configured to abut the surface 32 of the substrate 24 that carries the electrically conductive contact pads 30 when the cover 35 is attached to the housing body 37, and the electrical connector 22 is mounted to the substrate 24. Further, as illustrated in FIG. 31, the bottom surface of the contact portion 85 can define at least one bottom opening 91 that is configured to receive the mating ends of the electrical contacts 28. For example, the contact portion 85 can include a plurality of divider walls 93 that are spaced from one another along the lateral direction A. The bottom openings 91 can extend between adjacent ones of the divider walls 93 along the lateral direction A. Each bottom opening 91 of the contact portion 85 can receive the mating end of at least a respective one of the electrical contacts 28. For example, each bottom opening 91 can receive the mating end of a respective different one of the electrical contacts 28.

The contact portion 85 can include an end wall 95 that is spaced from the housing portion 83 along the longitudinal direction. In particular, the end wall 95 can be spaced from the housing portion 83 in the forward direction. Thus, the contact portion 85 can extend from the housing portion 83 to the end wall 95. The end wall 95 can extend between the outer surface and the bottom surface of the contact portion 85. The end wall 95 can be disposed forward from the mating ends of the electrical contacts 28 along the longitudinal direction L when the cover 35 is attached to the housing body 37, and thus the connector housing 34. Further, the distal ends of the mating ends of the electrical contacts 28 can be in-line with the end wall 95 along the longitudinal direction L such that the end wall protects the distal ends of the electrical contacts 28. Further, the distal ends of the mating ends of the electrical contacts 28 can be disposed between the housing body 37 and the end wall 95.

At least a portion of the mating ends of the electrical contacts 28 can extend below the bottom surface of the contact portion 85 when the electrical contacts 28 are in their relaxed position. For example, a bottom-most surface of each of the mating ends can extend below the bottom surface of the contact portion 85 when the electrical contacts 28 are in the relaxed position. In addition, the tips of the mating ends of the electrical contacts 28 can extend above the bottom surface of the contact portion 85 when the electrical contacts 28 are in the relaxed position. When the electrical connector 22 is mounted to the substrate 24, the mating ends can be disposed in a flexed position that is disposed above the relaxed position. For instance, the bottom-most surfaces of the mating ends can be substantially planar with the bottom surface of the contact portion 85 when the electrical connector 22 is mounted to the substrate 24. The bottom surface of the contact portion 85 can abut the surface 32 of the substrate 24 that carries the electrically conductive contact pads 30 when the electrical connector 22 is mounted to the substrate 24.

With continuing reference to FIG. 31, the connector housing 34 can include a member that extends out from the housing body 37. For instance, the member can extend from the front end 40 of the housing body 37. In one example, the member can include one or more latch arms 39 that extend forward from the housing body 37 along the longitudinal direction L. The latch arms 39 can be configured to attach to the connector cover 35. In particular, the latch arms 39 can be configured to attach to the contact portion 85 of the connector cover 35. Thus, the latch arms 39 can be configured to attach the housing body 37, and thus the connector housing 34, to the connector cover 35. The housing body 37 and the latch arms 39 can combine so as to define an outermost footprint of the connector housing 34. Thus, the front and rear housing ends 40 and 42, the first and second housing sides 50, and the latch arms 39, alone or in combination with the dielectric spacer 68, can define the outermost footprint of the connector housing 34. The outermost footprint of the connector housing can be defined in a plane that is defined by the longitudinal direction L and the lateral direction A.

As described herein, the electrical connector assembly 22 can further include at least one attachment mechanism 86 that is configured to attach the electrical connector 22 to the substrate 24. The at least one attachment mechanism 86 is thus configured to secures the electrical connector 22 to the substrate 24 so as to (i) maintain the electrical contacts 28 in their flexed positions against the contact pads 30 and (ii) resist separation forces that are exerted on one or both of the housing body 37 and the substrate 24 to separate the housing body 37 from the substrate 24. For instance, the at least one attachment mechanism 86 can resist separation forces exerted by the electrical contacts 28 on the housing body 37 as a result of the forces that the electrical contacts 28 apply to the substrate 24 when the electrical contacts 28 are in their flexed position. Further, the at least one attachment mechanism 86 can resist separation forces applied by a source external to the electrical connector assembly 22 in one or both of the transverse direction T and a horizontal direction that is defined by one or both of the lateral direction A and the longitudinal direction L. For instance, the external force could be exerted on the cables 46 in the downward direction, thereby creating a moment force that is applied to the connector 22 that biases the mating electrical contacts 28 in the upward direction away from the substrate 24. Thus, the moment applies a separation force to the electrical connector 22 along the upward vertical direction away from the substrate 24.

Referring more specifically to FIGS. 19 to 20C, the at least one attachment mechanism 86 can include a compression member 88 that is configured to apply an opposing compression force to the electrical connector 22 to the electrical connector 22 in a downward direction towards the substrate 24. The downward direction can be oriented along the transverse direction T. In one example, the compression member 88 can be configured to apply the compression force to the connector cover 35. Alternatively or additionally, the compression member 88 can be configured to apply the compression force to the connector housing 34.

Figure 18:
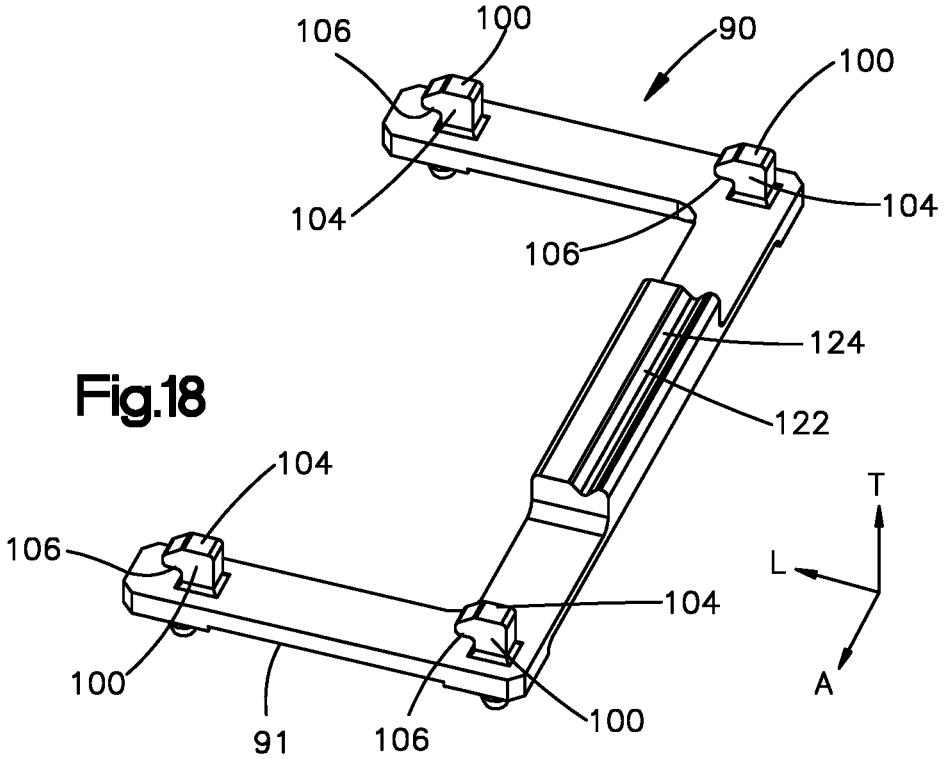
FIG. 18 is a perspective view of a support member of the attachment mechanism illustrated in FIG. 15.

The compression member 88 can be configured to apply an opposing downward force to the electrical connector 22 in a direction from the compression member 88 towards the substrate 24. The compression member 88 can be configured in accordance with any suitable embodiment as desired. In one example illustrated in FIG. 18, the compression member 88 can be configured as an attachment beam 92 that is configured to be attached to the substrate 24 so as to apply a compression force against the housing body 37 toward the substrate 24. For instance, the attachment beam 92 can be configured to extend over at least a portion of the housing body 37, such that the portion of the housing body 37 is disposed between the attachment beam 92 and the substrate 24. In one example, the attachment beam 92 can further extend over the cover 35, such that the cover 35 is disposed between the attachment beam 92 and the housing body 37. Thus, the cover 35 can further be disposed between the attachment beam 92 and the substrate 24. The attachment beam 92 can be attached to the cover 35. Alternatively or additionally, the attachment beam 92 can be attached to the housing body 37. The attachment beam 92 can be formed from any suitable metal, plastic, or other suitably stiff material.

The attachment beam 92 can include any suitable fastening member that is configured to fasten the attachment beam to one or more of the substrate 24, the cover 35, and the housing body 37. The fastening member can be configured in accordance with any suitable embodiment as desired. For instance, in one example, the fastening member can be configured as one or more through holes 93 that are configured to receive fasteners 95 that, in turn, are fastened to the substrate 24. Thus, the substrate 24 can include respective holes that also receive the fasteners 95, which can be configured as screws. The through holes 93 can be tapped, and the fasteners can be screws having threaded shafts. The screws are positioned in three thru holes on the substrate. When the fasteners are configured as screws, the screws can be tightened so as to secure the cover to the at least one housing, and the electrical connector to the underlying substrate. The fasteners may be tightened such that each mating end provides a mating force of at least 40 grams against the contact pads to which it is mated. The beam can be stiff so as to cause the tightening force of the fasteners to be substantially uniformly distributed to each of the contacts, such that the corresponding mating ends are configured to provide the mating force. Thus, the electrical connector can 22 be attached to the substrate 24 only by an external compression force in one example.

Figure 23:
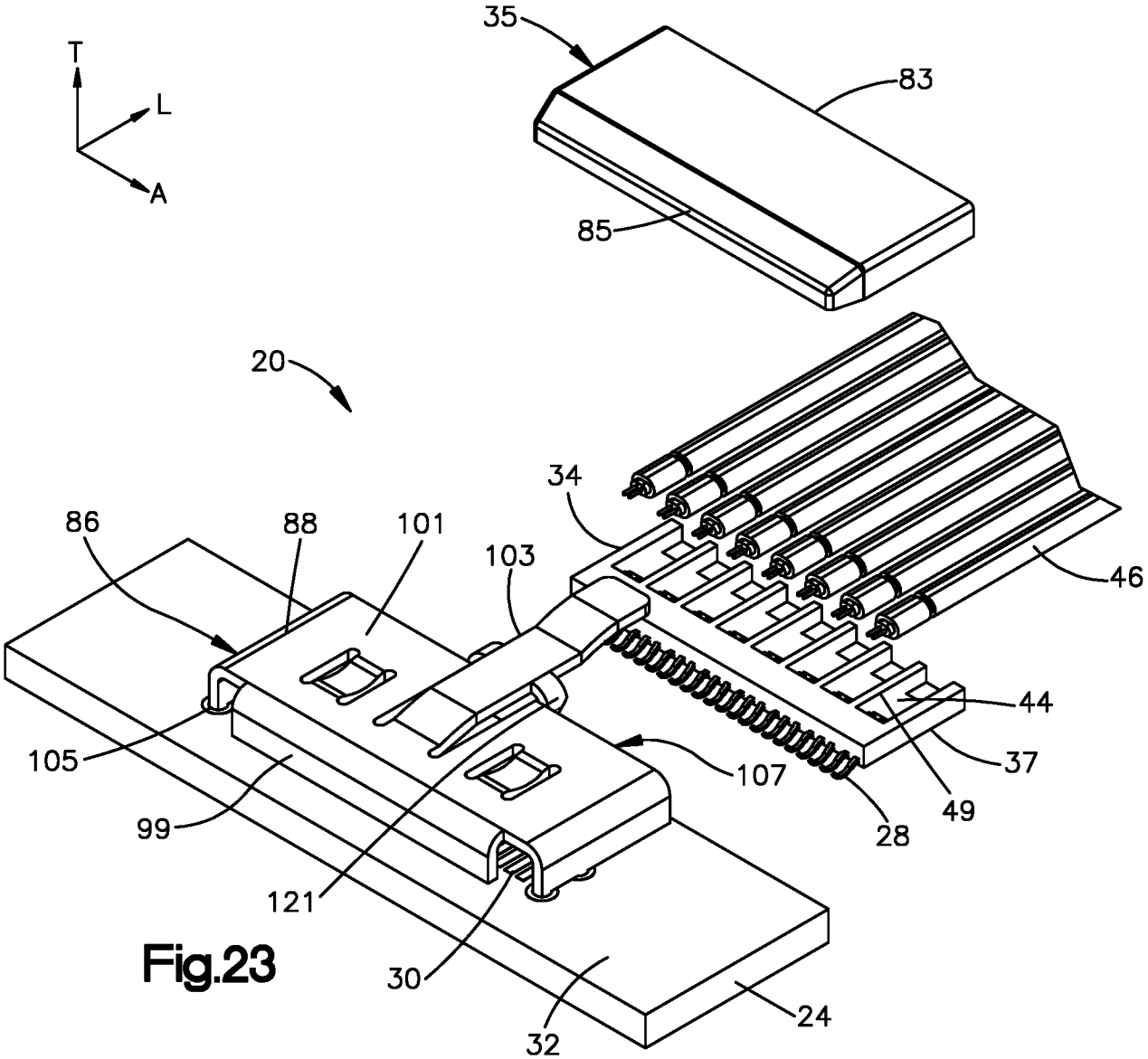
FIG. 23 is an exploded perspective view of an electrical connector assembly constructed in accordance with another embodiment, showing an electrical connector configured to be mounted to an underlying substrate.

Referring now to FIGS. 23-25, the at least one attachment mechanism 86 can include a bracket assembly 99 that is configured to secure the housing body 37, and thus the connector housing 34, to the substrate 24. The compression member 88 can be configured as a bracket body 101 of the bracket assembly 99. The bracket assembly 99 can further include at least one attachment arm 105. The compression member 88 is configured to apply a downward force to the housing body 37 in the downward direction towards the substrate 24 so as to cancel separation forces that would otherwise separate the housing body 37 from the substrate 24. The compression member 88 can apply the downward force directly to the housing body 37, or to the cover 35. The bracket assembly 99 can be formed from a conductive material, a polymer, or other suitable material. In one example, the bracket assembly 99 can be configured to provide electromagnetic interference (EMI) shielding to isolate the electrical connector from electrical devices external to the electrical connector.

The bracket assembly 99 can include at least one attachment arm 105 that is configured to extend from the compression member to the substrate. For instance, the attachment arm 105 can be press-fit into an aperture of the substrate 24 so as to attach the bracket assembly 99 to the substrate 24. The at least one attachment arm 105 can be monolithic with the compression member 88, or can be formed separately and attached to the compression member 88. The attachment arm 105 can include at least one fastening feature configured to attach the at least one attachment arm to the substrate. For example, the at least one fastening feature can include at least one post that extends in the downward direction and into an aperture of the substrate 24. The at least one post can be secured within the opening by any suitable method, including (without limitation) press-fitting, welding, or by threadedly engaging the opening of the substrate or a nut on the opposite surface of the substrate. In one example, the at least one post can contact a ground of the substrate so as to electrically ground the bracket assembly. As shown in FIG. 23, the at least one arm can include two or more, such as three arms. Further, the at least one fastening feature can include more than one fastening feature, such as a pair of fastening features.

Referring to FIGS. 23 and 27A-28B, the bracket assembly 99 can define an insertion slot 107 that extends therein in the forward direction. The insertion slot 107 can be defined between the compression member 88 and the substrate 24. The insertion slot 107 can be configured to receive the electrical connector 22 along the longitudinal direction L, and in particular in the forward direction. As the electrical connector 24 is received in the insertion slot 107, the electrical contacts 28 can wipe against the contact pads 30 as the electrical contacts 28 are flexed to the flexed position.

The bracket assembly 99 can further include a spring arm 103 that is configured to engage the electrical connector 22 when the electrical connector 22 is received in the insertion slot 107 so as to retain the electrical connector in the insertion slot. The spring arm 103 can include a spring-arm body that extends from the compression member 88 along the longitudinal direction L, and in particular in the rearward direction. The spring arm 103 is configured to flex along the transverse direction T. For example, the spring arm 103 can be resiliently biased in the downward direction towards the substrate 24, and configured to flex upwards away from the substrate 24. The spring arm 103 can further include at least one protrusion 121 that extends from the spring-arm body in the downward direction towards the substrate 24.

When the electrical connector 22 is received in the insertion slot 107, the spring arm 103 flexes upwards away from the substrate 24. In one example, the spring arm 103 flexes upwards as the at least one protrusion 121 rides along an upper end of the electrical connector 22, such as along an upper end of the cover 35. Once the mounting end of the electrical connector 22 passes the protrusion, the spring arm 103 springs downwards such that the at least one protrusion 121 interferes with the mounting end of the electrical connector 22 with respect to movement of the electrical connector 22 in the rearward direction with respect to the bracket assembly 99. Thus, the protrusion 121 can prevent the electrical connector 22 from backing out of the insertion slot 107 in the rearward direction.

Referring now to FIG. 31, the at least one attachment mechanism 86 can include at least one alignment member that extends from the housing body in a downward direction towards the substrate. The at least one alignment member can be configured as an alignment pin 115. The at least one alignment pin 115 can be monolithic with the housing body 37, and thus with the connector housing 34. Thus, the electrical connector housing 34 can include the at least one alignment pin 115 that extends down from the housing body 37. Alternatively, the at least one alignment pin 115 can be formed separately from the housing body 37 and attached to the housing body 37. The at least one alignment pin can be secured within an opening in the substrate 24 by any suitable method, including (without limitation) press-fitting, welding, or by threadedly engaging the opening of the substrate or a nut on the opposite surface of the substrate. In one example, the at least one alignment pin 115 can include at least two alignment pins or any number of alignment pins as desired. Further, the at least two alignment pins can have shapes that are different from one another so as to ensure proper orientation of the electrical connector 22 with respect to the substrate 24. The electrical connector of FIGS. 30-32 can be mated with the substrate along the transverse direction downward T towards the first surface of the substrate 24.

The electrical contacts 28 of the electrical connector 22 of any example disclosed herein can be configured to transmit data at frequencies up to 30 GHz while producing no more than −18 dB worst-case multi-active asynchronous cross talk. For instance, the electrical contacts 28 of the electrical connector 22 of any example disclosed herein can be configured to transmit data at frequencies between and including 5 GHz and 30 GHz while producing no more than −18 dB worst-case multi-active asynchronous cross talk. In one example, the electrical contacts 28 of the electrical connector 22 of any example disclosed herein can be configured to transmit data at frequencies between and including 10 GHz and 30 GHz while producing no more than −18 dB worst-case multi-active asynchronous cross talk. Further, the electrical contacts 28 of the electrical connector 22 of any example disclosed herein can be configured to transmit data at frequencies between and including 15 GHz and 30 GHz while producing no more than −18 dB worst-case multi-active asynchronous cross talk. For example, the electrical contacts 28 of the electrical connector 22 of any example disclosed herein can be configured to transmit data at frequencies between and including 20 GHz and 30 GHz while producing no more than −18 dB worst-case multi-active asynchronous cross talk. In particular, the electrical contacts 28 of the electrical connector 22 of any example disclosed herein can be configured to transmit data at frequencies between and including 25 GHz and 30 GHz while producing no more than −18 dB worst-case multi-active asynchronous cross talk.

Further, the electrical contacts 28 of the electrical connector 22 of any example disclosed herein can be configured to transmit data at data transfer rates up to 56 Gigabits per second while producing no more than −18 decibels (dB) worst-case multi-active asynchronous cross talk. For instance, the electrical contacts 28 of the electrical connector 22 of any example disclosed herein can be configured to transmit data at data transfer rates between and including 10 Gigabits per second and 56 Gigabits per second while producing no more than −18 dB worst-case multi-active asynchronous cross talk. In one example, the electrical contacts 28 of the electrical connector 22 of any example disclosed herein can be configured to transmit data at data transfer rates between and including 20 Gigabits per second and 56 Gigabits per second while producing no more than −18 dB worst-case multi-active asynchronous cross talk. For example, the electrical contacts 28 of the electrical connector 22 of any example disclosed herein can be configured to transmit data at data transfer rates between and including 20 Gigabits per second and 56 Gigabits per second while producing no more than −18 dB worst-case multi-active asynchronous cross talk. In particular, the electrical contacts 28 of the electrical connector 22 of any example disclosed herein can be configured to transmit data at data transfer rates between and including 40 Gigabits per second and 56 Gigabits per second while producing no more than −18 dB worst-case multi-active asynchronous cross talk.

It should be noted that the illustrations and discussions of the embodiments shown in the figures are for exemplary purposes only, and should not be construed limiting the disclosure. One skilled in the art will appreciate that the present disclosure contemplates various embodiments. Additionally, it should be understood that the concepts described above with the above-described embodiments may be employed alone or in combination with any of the other embodiments described above. It should further be appreciated that the various alternative embodiments described above with respect to one illustrated embodiment can apply to all embodiments as described herein, unless otherwise indicated.

What is claimed is:

1. An electrical connector configured to be mounted to a substrate, the electrical connector comprising:

an electrically insulative connector housing body that defines:

a front end and a rear end opposite the front end along a longitudinal direction;

first and second sides that are spaced from each other along a lateral direction that is perpendicular to the longitudinal direction, wherein each of the first and second sides extends from the front end to the rear end; and upper and lower ends spaced from each other along a transverse direction that is perpendicular to each of the lateral direction and the longitudinal direction, wherein the lower end is configured to face the substrate when the electrical connector is mounted to the substrate; and a plurality of electrical contacts supported by the connector housing body, wherein adjacent ones of the electrical contacts define differential signal pairs and each electrical contact of one or more of the plurality of electrical contacts defines:

a resilient and flexible mating end that extends out from the housing body a first distance along a first direction that includes at least one of the lateral direction and the longitudinal direction, and a second distance along the transverse direction that is less than the first distance; and a mounting end opposite the mating end and configured to be mounted to an electrical cable, wherein the electrical connector is configured to be mounted to the substrate such that each of the resilient and flexible mating ends is configured to flex from a relaxed position when placed in surface contact with a respective electrical contact pad that is carried by a surface of the substrate, such that the mating end applies a pressure against the contact pad along the transverse direction so as to define a separable interface therewith.

2. The electrical connector as recited in claim 1, wherein the mating end of each of the one or more of the plurality of electrical contacts extends below the housing body when in the relaxed position.

3. The electrical connector as recited in claim 2, wherein the mating end of each of the one or more of the plurality of electrical contacts is disposed in a flexed position when the electrical connector is mounted to the substrate, the flexed position being disposed above the relaxed position.

4. The electrical connector as recited in claim 1, wherein no straight line exists that extends perpendicular to the substrate surface and extends through the mating end of one of the plurality of electrical contacts twice.

5. The electrical connector as recited in claim 1, wherein the housing body defines a plurality of bays, each bay configured to receive an electrical cable.

6. The electrical connector as recited in claim 5, further comprising a cover having a contact portion that covers the at least one electrical contact.

7. The electrical connector as recited in claim 5, wherein the cover comprises a housing portion that covers at least a portion of the connector housing body.

8. The electrical connector as recited in claim 1, wherein each of the one or more of the plurality of electrical contacts is cantilevered from a surface of the housing body that does not face the substrate when the electrical connector is mounted to the substrate.

9. The electrical connector as recited in claim 1, wherein each of the one or more of the plurality of electrical contacts extends forward from a surface of the housing body to a location spaced forward from an entirety of the housing body.

10. The electrical connector as recited in claim 1, wherein the first distance is at least 3 times greater than the second distance.

11. An electrical connector assembly comprising:

the electrical connector as recited in claim 1; and at least one attachment mechanism configured to attach the electrical connector to the substrate so as to maintain the at least one electrical contact in a flexed position against the substrate.

12. The electrical connector assembly as recited in claim 11, wherein the attachment mechanism includes an attachment beam configured to extend over at least a portion of the electrical connector, such that the portion of the electrical connector is disposed between the attachment beam and the substrate, the attachment beam configured to be attached to each of the electrical connector and the substrate so as to secure the electrical connector to the substrate.

13. The electrical connector assembly as recited in claim 12, further comprising a cover that extends over the housing body, wherein the attachment beam is attached to the cover.

14. The electrical connector assembly as recited in claim 11, wherein the at least one attachment mechanism includes a bracket assembly that is configured to secure the electrical connector to the substrate, wherein the bracket assembly includes a bracket body having a compression member and at least one attachment arm that extends from the compression member, the compression member configured to apply a downward force to the electrical connector along the transverse direction from the compression member towards the substrate.

15. The electrical connector assembly as recited in claim 14, wherein the bracket assembly includes at least one fastening feature configured to attach the at least one attachment arm to the substrate.

16. The electrical connector assembly as recited in claim 14, wherein the bracket assembly defines an insertion slot that extends between the compression member and the substrate in the longitudinal direction when the electrical connector is mounted to the substrate, wherein the insertion slot is configured to receive the electrical connector along the longitudinal direction such that the at least one electrical contact wipes against the at least one contact pad.

17. A method of mounting an electrical connector assembly to a substrate, the method comprising the steps of:

placing an electrically insulative connector housing body against a surface of the substrate, wherein the connector housing defines 1) a front end and a rear end opposite the front end along a longitudinal direction, 2) first and second sides that are spaced from each other along a lateral direction that is perpendicular to the longitudinal direction, wherein each of the first and second sides extends from the front end to the rear end, and 3) upper and lower ends spaced from each other along a transverse direction that is perpendicular to each of the lateral direction and the longitudinal direction, such that the lower end faces the surface of the substrate, wherein the placing step causes a mounting end of least one electrical contact to flex and apply a force against a respective at least one contact pad at the surface of the substrate, wherein the at least one electrical contact is supported by the connector housing body, and each electrical contact of one or more of the at least one electrical contact defines 1) a resilient and flexible mating end that extends out from the housing body a first distance along a first direction that includes at least one of the lateral direction and the longitudinal direction, and a second distance along the transverse direction that is less than the first distance, and 2) a mounting end opposite the mating end and configured to be attached to an electrical conductor of an electrical cable.

18. The method as recited in claim 17, further comprising the step of securing the electrical connector to the substrate after the placing step, such that the at least one electrical contact is flexed against the respective at least one contact pad.

19. The method as recited in claim 18, wherein the securing step comprises placing a beam on the electrical connector so as to compress the electrical connector against the substrate.

20. The method as recited in claim 18, wherein the securing step comprises pivoting a compression member onto the electrical connector so as to compress the electrical connector against the substrate.

21. A method of mounting an electrical connector to a substrate, the method comprising the steps of:

placing an electrically insulative connector housing body against a surface of the substrate, thereby causing electrical contacts of the electrical connector to resiliently flex as respective mating ends of the electrical contacts are brought onto respective contact pads at the surface of the substrate, each of the electrical contacts having a respective mounting end that is mounted to an electrical cable, wherein the electrical contacts are supported by the connector housing body, such that the mating ends are cantilevered out from the housing body at a surface of the housing body that does not face the substrate after the placing step.

22. The method as recited in claim 21, further comprising the step of securing the electrical connector to the substrate after the placing step, such that the electrical contacts are resiliently flexed against the contact pads.

23. The method as recited in claim 22, wherein the securing step comprises placing a beam on the electrical connector so as to compress the electrical connector against the substrate.

24. The method as recited in claim 22, wherein the securing step comprises pivoting a compression member onto the electrical connector so as to compress the electrical connector against the substrate.

* * * * *